US008091158B2

(12) United States Patent
Sato et al.

(10) Patent No.: US 8,091,158 B2
(45) Date of Patent: Jan. 10, 2012

(54) SHOWER BATHING APPARATUS

(75) Inventors: Minoru Sato, Kanagawa-ken (JP); Yutaka Aihara, Kanagawa-ken (JP); Tomohisa Kato, Kanagawa-ken (JP)

(73) Assignee: Toto, Ltd., Kitakyusyu-shi, Fukuoka (JP)

( * ) Notice: Subject to any disclaimer, the term of this patent is extended or adjusted under 35 U.S.C. 154(b) by 243 days.

(21) Appl. No.: 11/694,146

(22) Filed: Mar. 30, 2007

(65) Prior Publication Data

US 2007/0226894 A1 Oct. 4, 2007

(30) Foreign Application Priority Data

Mar. 31, 2006 (JP) ..... 2006-100278
Aug. 11, 2006 (JP) ..... 2006-220514

(51) Int. Cl.
*A47K 3/022* (2006.01)

(52) U.S. Cl. ..... 4/611; 4/596; 4/601; 4/621

(58) Field of Classification Search ..... 4/596, 611, 4/615, 621, 601
See application file for complete search history.

(56) References Cited

U.S. PATENT DOCUMENTS

| | | | | |
|---|---|---|---|---|
| 3,169,253 | A * | 2/1965 | Segar | 4/611 |
| 3,971,074 | A * | 7/1976 | Yxfeldt | 4/570 |
| 5,428,850 | A * | 7/1995 | Hiraishi et al. | 4/601 |
| 6,195,814 | B1 * | 3/2001 | Yoshida et al. | 4/601 |
| 6,408,456 | B1 * | 6/2002 | Fike et al. | 4/560.1 |
| 6,920,654 | B2 * | 7/2005 | Noguchi et al. | 4/601 |
| RE38,841 | E * | 10/2005 | Yoshida et al. | 4/601 |
| 2002/0040500 | A1 * | 4/2002 | Noguchi et al. | 4/596 |

FOREIGN PATENT DOCUMENTS

| | | |
|---|---|---|
| GB | 2149299 | 6/1985 |
| JP | 03-090150 | 4/1991 |
| JP | 04-332556 | 11/1992 |
| JP | 05-015570 | 1/1993 |
| JP | 06-35071 | 9/1994 |
| JP | 06-035071 | 9/1994 |
| JP | 09-098898 | 4/1997 |
| JP | 09-098898 A | 4/1997 |
| JP | 10-028656 | 2/1998 |
| JP | 11-276374 A | 10/1999 |
| JP | 2001-112660 | 4/2001 |

(Continued)

OTHER PUBLICATIONS

Office Action from the Japanese patent office for counterpart Japanese application No. 2007-093725 dtd. Oct. 26, 2007.

(Continued)

*Primary Examiner* — Gregory Huson
*Assistant Examiner* — Karen L Younkins
(74) *Attorney, Agent, or Firm* — Banner & Witcoff, Ltd.

(57) ABSTRACT

A shower bathing apparatus is described as including a seat and a first water discharger provided rearward and upward in relation to the seat. The first water discharger is configured to discharge water in a direction forward of the seat. A water discharge direction from the first water discharger and a positional relationship between the first water discharger and the seat may be adjustable so that the water discharged from the first water discharger is able to reach the seat or forward of the seat. The water discharged from the first water discharger may further flow from above a seat occupant's shoulder to the seat occupant's leg.

17 Claims, 43 Drawing Sheets

FOREIGN PATENT DOCUMENTS

| | | |
|---|---|---|
| JP | 2001-245809 | 9/2001 |
| JP | 2001-286408 | 10/2001 |
| JP | 2002-136566 | 5/2002 |
| JP | 2002-136566 A | 5/2002 |
| JP | 2003-052564 | 2/2003 |
| JP | 2003-052786 | 2/2003 |
| JP | 2003-079526 | 3/2003 |
| JP | 2003-199682 | 7/2003 |
| JP | 2003-210344 | 7/2003 |
| JP | 2003-325369 | 11/2003 |
| WO | 9730619 | 8/1997 |

OTHER PUBLICATIONS

Office Action for corresponding Japanese Application No. 2007-093725 dated Apr. 21, 2008.

English Translation of Japanese Application No. JP6-035071, previously submitted to U.S. Patent and Trademark Office via EFS Web on Oct. 5, 2007.

* cited by examiner

SHOWER BATHING APPARATUS

CROSS-REFERENCE TO RELATED APPLICATIONS

This application is based upon and claims the benefit of priorities from the prior Japanese Patent Application No. 2006-100278, filed on Mar. 31, 2006, and the prior Japanese Patent Application No. 2006-220514, filed on Aug. 11, 2006; the entire contents of which are incorporated herein by reference.

BACKGROUND

1. Field of the Invention

This invention relates to a shower bathing apparatus, and more particularly to a shower bathing apparatus enabling a user to take a shower bath in a sitting posture.

2. Description of the Related Art

A shower bathing apparatus enabling a user to take a shower bath in a sitting posture is disclosed, for example, in International Publication WO 97/30619 (hereinafter referred to as "Patent Document 1"). According to this Patent Document 1, an arm extending forward from behind the user in a sitting posture over the user's shoulder has a spray nozzle, which sprays mist toward the user.

However, in using the shower bathing apparatus of Patent Document 1, the arm attached to the bathroom wall is extracted from the wall, and hence narrows the bathroom. The arm extending into the bathroom space may annoy the user. Furthermore, because the water discharged from the arm is directed to the front side of the user's body, the user may suffer from splash to the face or feel dizzy. Moreover, unfortunately, the arm is obstructive to assisted bathing.

SUMMARY

According to an aspect of the invention a shower bathing apparatus may include a seat and a first water discharger provided rearward and upward in relation to the seat and configured to discharge water in a forward direction of the seat. A water discharge direction from the first water discharger and a positional relationship between the first water discharger and the seat are adjustable so that the water discharged from the first water discharger reaches the seat or forward of the seat. Further, the water discharged from the first water discharger may further flow from above a seat occupant's shoulder to the seat occupant's leg.

DETAILED DESCRIPTION

Figure 1:
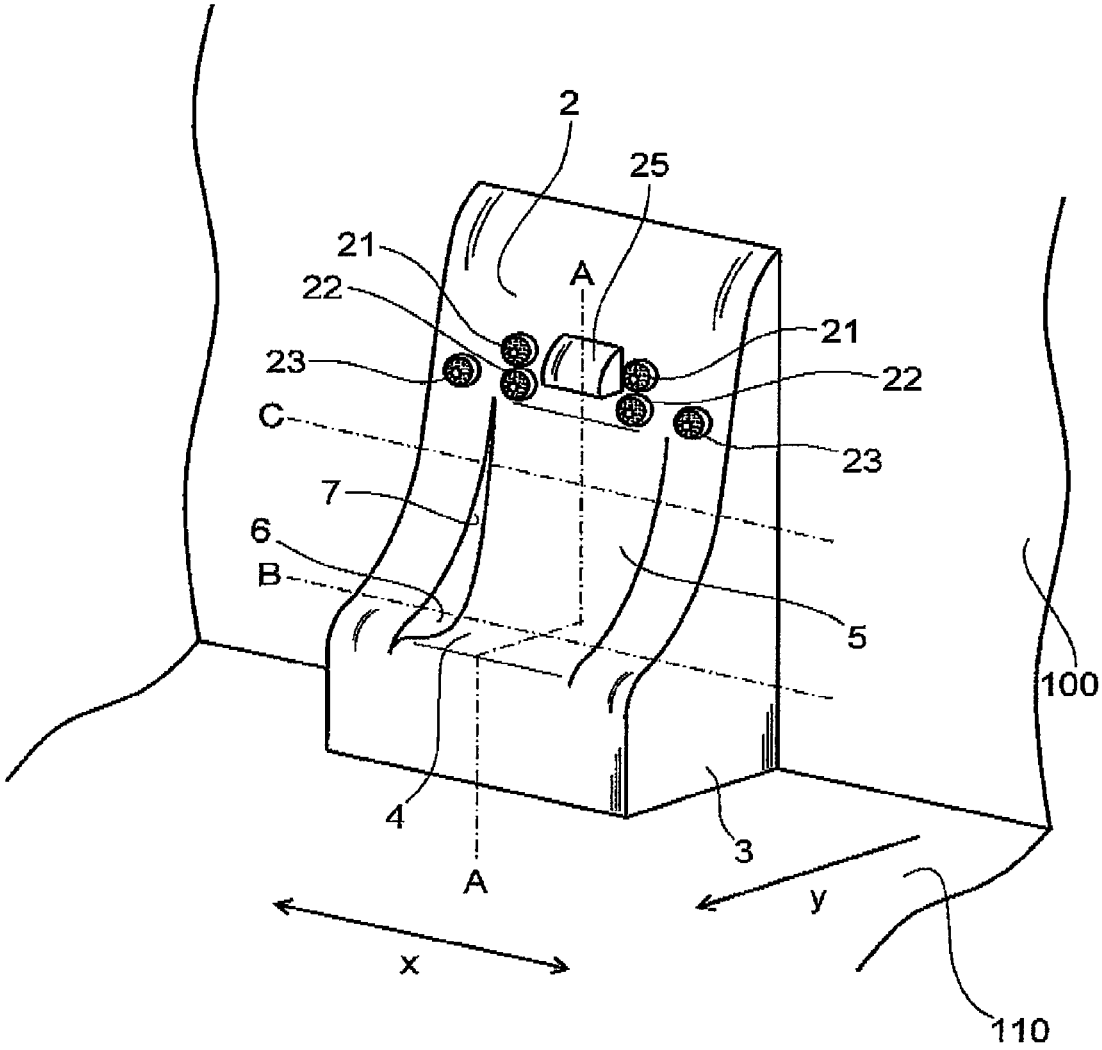
FIG. 1 is a perspective view schematically illustrating the appearance of a shower bathing apparatus according to a first embodiment of the invention.

Embodiments of the invention will now be described with reference to the drawings, where like elements are marked with like reference numerals.

First Embodiment

FIG. 1 is a perspective view schematically illustrating the appearance of a shower bathing apparatus according to a first embodiment of the invention.

Figure 2:
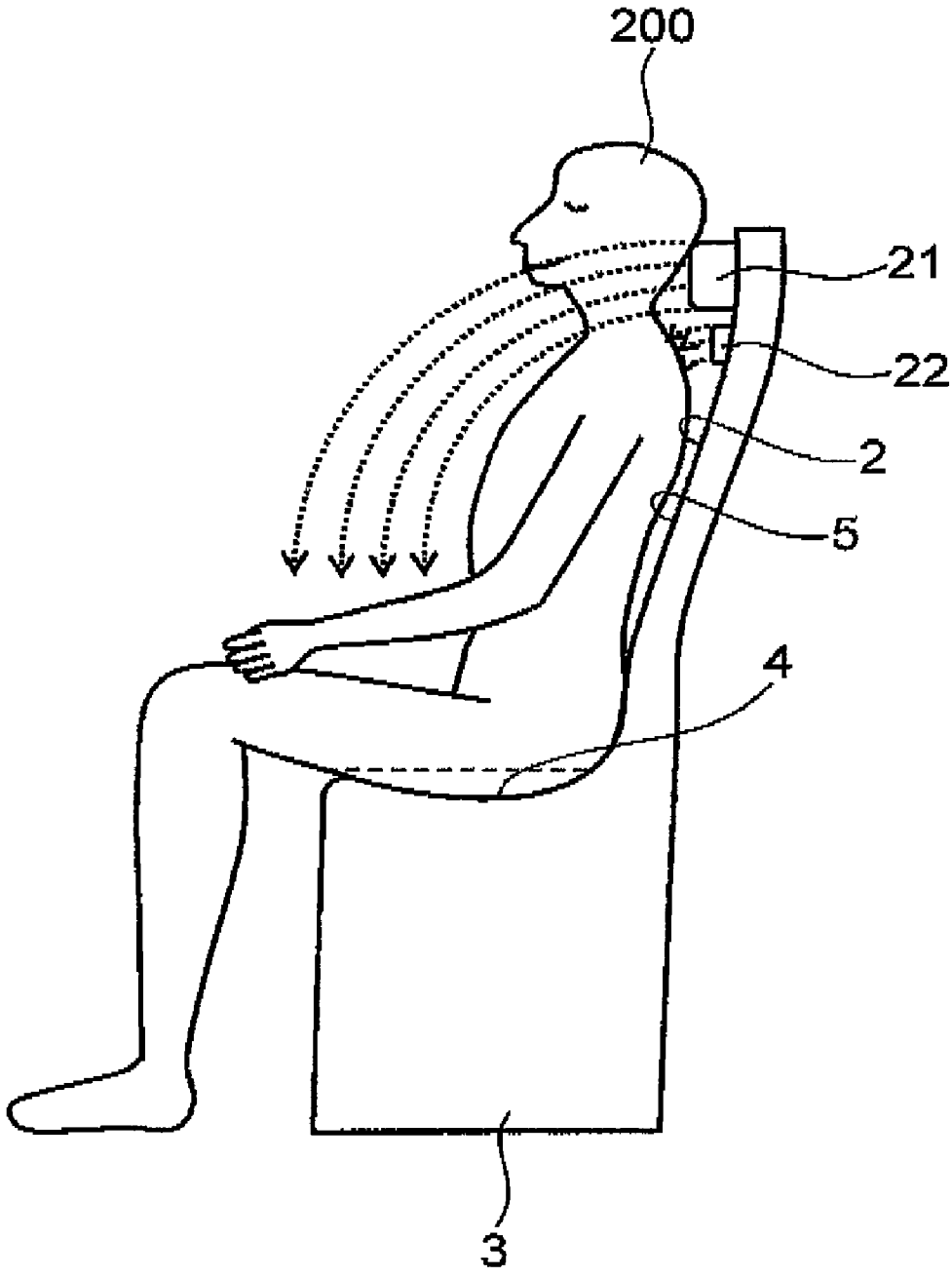
FIG. 2 is the A-A cross-sectional view of FIG. 1.

FIG. 2 is the A-A cross-sectional view of FIG. 1.

FIG. 3 is the B-B cross-sectional view of FIG. 1.

Figure 4:
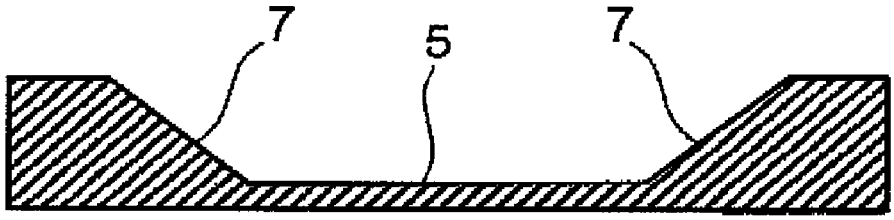
FIG. 4 is the C-C cross-sectional view of FIG. 1.

FIG. 4 is the C-C cross-sectional view of FIG. 1.

The shower bathing apparatus according to this embodiment primarily comprises a back portion 2 provided on a wall 100 of a bathroom and a base portion 3 provided on a floor 110 of the bathroom. In this example, the base portion 3 is integrated with the bottom of the back portion 2. However, the invention is not limited thereto, but the base portion 3 and the back portion 2 may be provided separately.

The base portion 3 protrudes forward (in the direction of arrow y in FIG. 1) of the back portion 2. On the top face of the base portion 3 is formed a concave seat 4, which is recessed toward the floor 110 relative to the other part of the top face. That is, as viewed in a first direction x (along the width of the base portion 3) generally parallel to the bathroom wall 100 and the bathroom floor 110, a step is formed across a wall portion 6 between each end of the top face of the base portion 3 and the seat 4.

The back portion 2 has a concave backrest 5, which is recessed toward the bathroom wall 100 relative to the other part of the back portion 2. That is, as viewed in the first direction x, a step is formed across a wall portion 7 between each end of the back portion 2 and the backrest 5.

The backrest 5 and the seat 4 are formed as a continuous recess. The wall portion 7 on each end of the backrest 5 as viewed in the first direction x (along the width) and the wall portion 6 on each end of the seat 4 as viewed in the first direction x (along the width) are also continuous with each other.

Figure 3A:
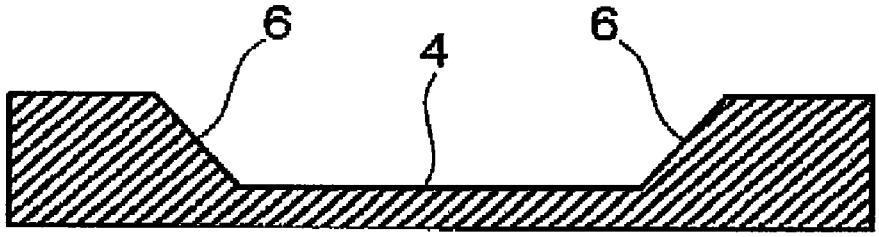
FIG. 3 is the B-B cross-sectional view of FIG. 1.
Figure 3B:
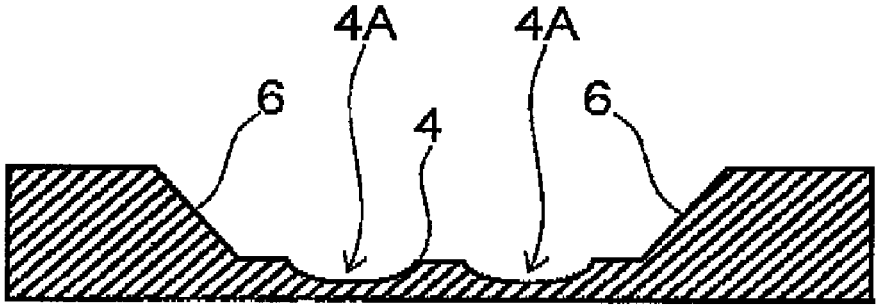

As shown in FIGS. 3A and 3B, the seat 4 is concaved as viewed in the first direction x (along the width). Furthermore, a pair of recesses 4A may be provided as shown in FIG. 3B. These recesses 4A extend in a second direction y and correspond to the thighs of a seat occupant seated on the seat 4. These recesses 4A serve to support the thighs of the seat occupant more stably, and allow the water pooled in the seat 4 to flow toward the legs of the seat occupant.

As shown in FIG. 2, the seat 4 is sloped down along the depth (toward the backrest 5).

That is, the recess of the seat 4 gradually deepens along the depth (toward the backrest 5).

At the upper part of the back portion 2 and generally at its center as viewed in the first direction x (along the width) is provided a head support 25 for supporting the head, or a portion from the neck to the head, of the seat occupant seated on the seat 4. The head support 25 protrudes in the second direction y (the protruding direction of the base portion 3) from the back portion 2.

A pair of first water dischargers 21 is provided on the back portion 2 above the backrest 5. The first water dischargers 21 are provided on both sides, one for each side, of the head support 25 so as to interpose the head support 25 as viewed in the first direction x. When a user is seated on the seat 4, the first water dischargers 21 are located above the shoulders of the seated user. The height between the seat 4 and the first water discharger 21 is larger than the height from the bathroom floor 110 to the seat 4. The two first water dischargers 21 are spaced from each other in the first direction x so that the face or head of the seated user can be located between the pair of first water dischargers 21. That is, the pair of first water dischargers 21 is located so as to interpose the face or head of the user seated on the seat. However, the first water dischargers 21 may be provided at a higher position than the head of the user seated on the seat 4. The water discharge direction of the first water discharger 21 is configured to be a generally horizontal direction, or a slightly downward direction relative to the horizontal direction.

The term "generally horizontal direction" used herein is preferably within ±45°, more preferably within ±30°, and even more preferably within ±20°, relative to the horizontal direction.

More specifically, as described later in detail, the first water dischargers 21 provided above the shoulders of the seat occupant seated on the seat 4 discharge a shower flow falling around the legs of the seat occupant. Here, if the first water dischargers 21 are attached at a low position, the shower flow can be discharged nearly horizontally over the shoulders of the seat occupant and dropped around the legs of the seat occupant. On the other hand, if the first water dischargers 21 are attached at a high position, a horizontally discharged shower flow would fall far from the legs of the seat occupant. Hence water needs to be discharged downward relative to the horizontal direction. That is, water needs to be discharged nearly horizontally for a low attachment position of the first water dischargers 21, and the water discharge direction needs to be made more downward relative to the horizontal direction as the attachment position becomes higher.

For example, if the first water dischargers 21 are attached at a low position and discharge water generally horizontally, the flying distance traveled by the shower flow to fall around the legs of the seat occupant decreases, and consequently the shower flow is less prone to temperature decrease. Furthermore, the shower bathing apparatus can be downsized by lowering the attachment position of the first water dischargers 21. Moreover, the speed of the shower flow falling around the legs of the seat occupant decreases (because the shower flow is less affected by acceleration, which would be greater for downward water discharge). This reduces irritation and water splash of the shower flow to the seat occupant and enables the seat occupant to comfortably take a full body shower for a long time.

In this example, the apparatus includes a pair of first water dischargers 21 on the left and right side. However, the invention is not limited thereto, but the apparatus may be provided with a single first water discharger 21. In this case, the first water discharger 21 extends to both the left and right side of the head support 25.

A pair of second water dischargers 22 is provided on the back portion 2 above the backrest 5 and below the pair of first water dischargers 21, respectively. The water discharge direction of the second water discharger 22 is configured to be more downward than the water discharge direction of the first water discharger 21 and to discharge water toward the shoulders of the seat occupant. In this example, the apparatus includes a pair of second water dischargers 22 on the left and right side. However, the invention is not limited thereto, but the apparatus may be provided with a single second water discharger 22. In this case, the second water discharger 22 is provided around the center.

A pair of third water dischargers 23 is provided on the back portion 2 nearly as high as or slightly above the second water dischargers 22 and outside the first and second water dischargers 21, 22 and the backrest 5 as viewed in the first direction x (along the width of the backrest 5). The water discharge direction of the third water discharger 23 is configured to be more inward than the water discharge direction of the first water discharger 21 as viewed in the first direction x and to discharge water toward the acromia of the seat occupant.

Figure 5:
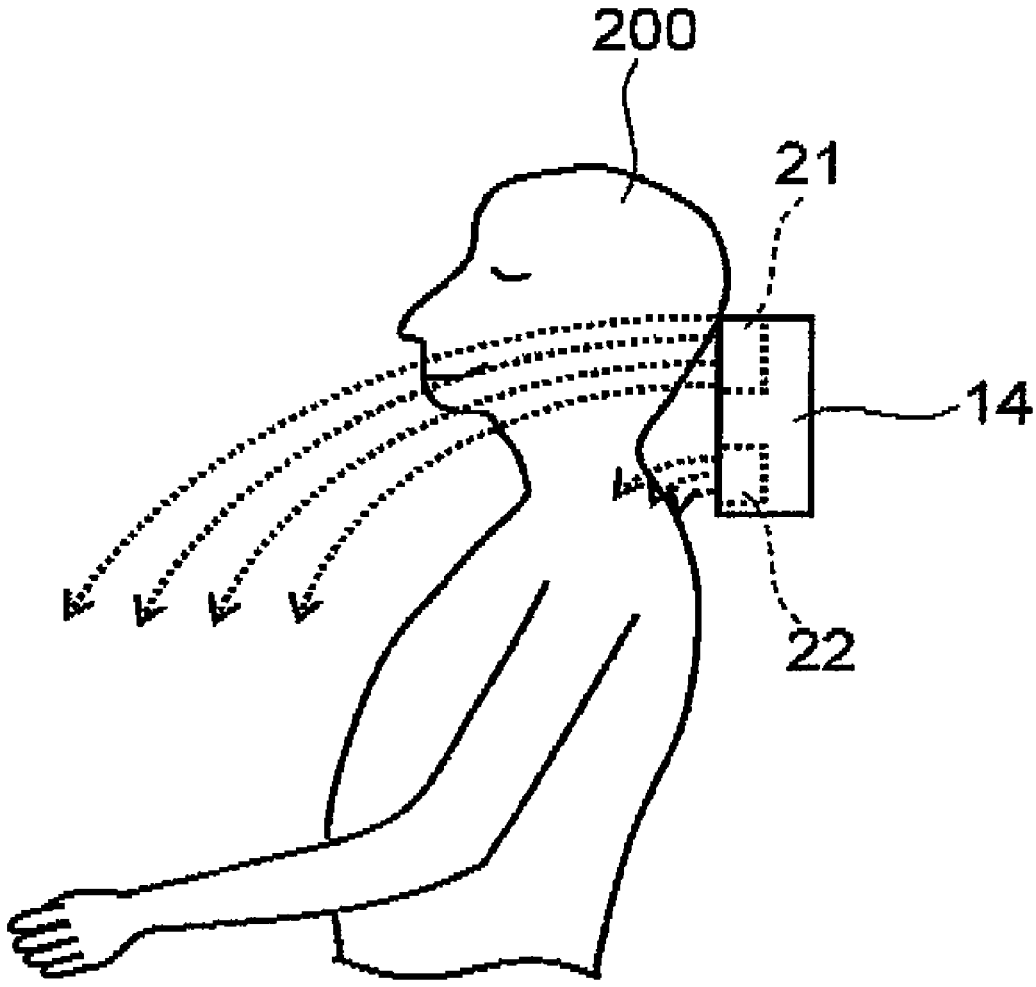
FIG. 5 is a schematic side view showing another example of the water discharger.

Each water discharger 21-23 discharges a shower flow of e.g. about 40 to 45° C. Note that two or more pairs of water dischargers 21-23 may be provided. In the example shown, each water discharger 21-23 separately protrudes from the back portion 2. However, as shown in FIG. 5, the water dischargers (FIG. 5 illustratively shows first and second water dischargers 21, 22) may be built in a single unit body 14.

Next, the function of the shower bathing apparatus according to this embodiment is described.

Figure 6:
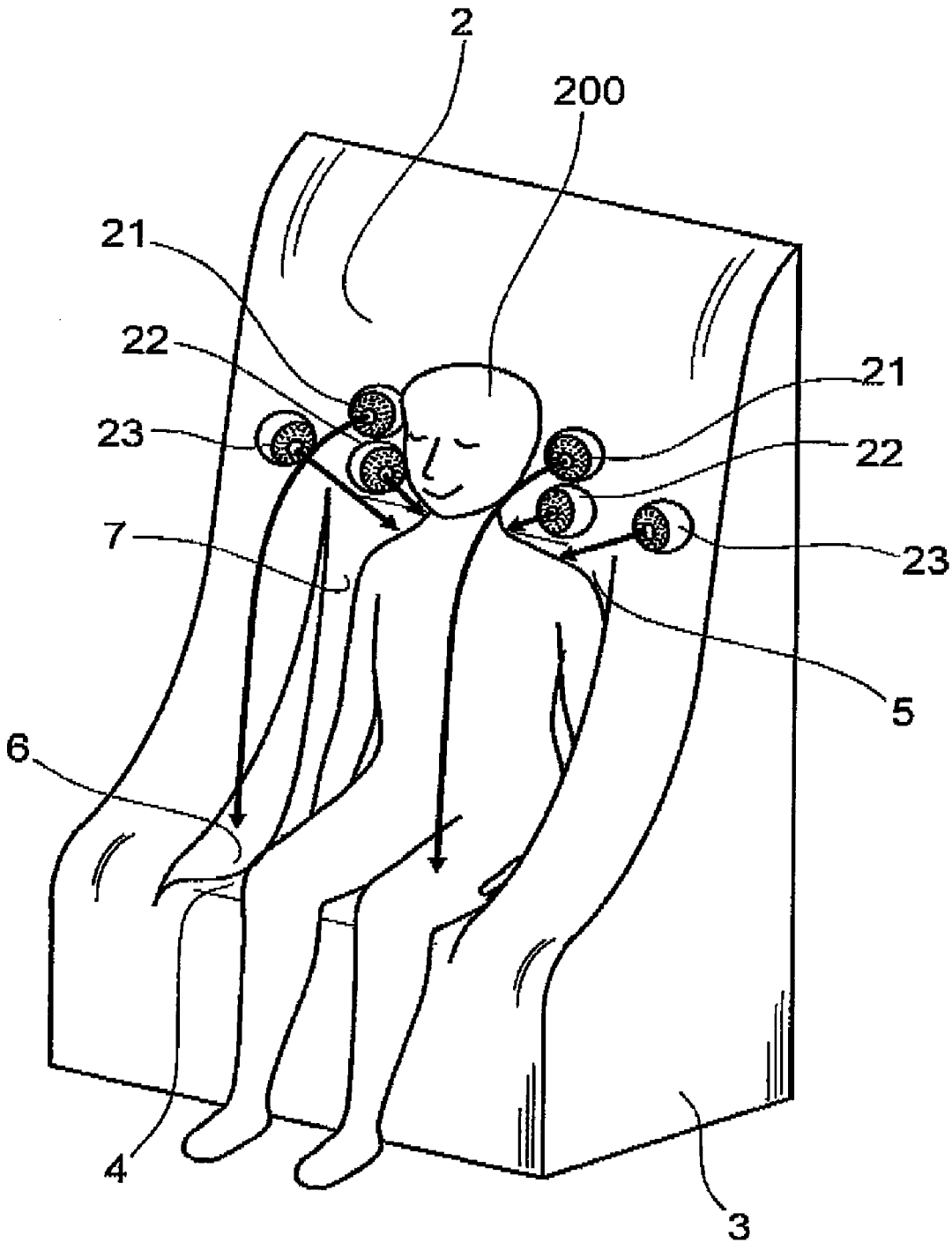
FIG. 6 is a perspective view schematically showing the water discharge of a shower flow from each water discharger to a seat occupant.

FIG. 6 is a perspective view schematically showing the water discharge of a shower flow from each water discharger 21-23 to a seat occupant 200.

As shown in FIGS. 2 and 6, the first water discharger 21 discharges a shower flow that is ejected generally horizontally and falling around the front edge of the seat 4. That is, the first water discharger 21 discharges a shower flow over the shoulder of the seat occupant 200 along an arc extending forward of the seat occupant 200 under its own weight, and the shower flow falls around the leg particularly centering on the thigh of the seat occupant 200. Here the shower flow may fall also on the abdomen in addition to the leg of the seat occupant 200. The shower flow flows on the surface of the leg from the knee toward the foot of the seat occupant 200. This configuration of the water discharge direction enables the water discharge flow to reliably reach the leg without being blocked by the seat occupant 200 and to warm also the leg below the knee by discharging water over the shoulder of the seat occupant 200, despite the configuration where the first water dischargers 21 are provided behind the seat occupant 200 and near the head, which is distant from the legs of the seat occupant 200. Furthermore, the water discharged from such a high position can provide a massage effect by the shower flow acting on the legs like the so-called "Utaseyu" (water falling down on a user's body like a waterfall).

Depending on the angle of the backrest 5 and the posture of the seat occupant 200, the shower flow discharged from the first water discharger 21 can be dropped on the lower abdomen of the seat occupant 200.

The "water discharge over the shoulder" used herein is not limited to the case where the shower flow from the first water discharger 21 passes directly above the shoulder of the seat occupant 200, but also includes the case of passing near the shoulder tip of the seat occupant 200. However, the shower flow passing directly above the shoulder of the seat occupant 200 can reach the leg from the first water discharger 21 provided on the backside of the seat occupant 200 in the shortest distance. That is, it can reduce the temperature decrease of the shower flow discharged from the first water discharger 21 during flying to the leg, and warm the leg with the shower flow at a desired temperature.

The second water discharger 22 discharges a shower flow toward the shoulder near the base of the neck of the seat occupant 200. Part of the shower flow impinging on the shoulder flows on the front surface of the body of the seat occupant 200 centering on the lateral portion extending from the chest to the trunk, and the other part of the shower flow is wrapped around to the back. Thus both the front and back of the body of the seat occupant 200 can be warmed. Furthermore, the massage effect by the shower flow can also be allowed to act on the shoulder. When only a single second water discharger 22 is provided as described above, it discharges a shower flow, for example, from behind the neck of the seat occupant 200 toward both the shoulders near the base of the neck to achieve the same effect.

By discharging the shower flow from the second water discharger 22 toward the shoulder near the base of the neck of the seat occupant 200 and allowing the shower flow to flow on the front and back of the upper body of the seat occupant 200, the entire upper body of the seat occupant 200 can be efficiently warmed with only a pair of second water dischargers 22 provided behind the seat occupant 200. That is, the number of water dischargers can be minimized to reduce cost while providing a high hyperthermic effect.

The water wrapped around to the backside of the seat occupant 200 continuously flows along the back of the seat occupant 200 or the backrest 5 toward the seat 4. That is, a continuous flow of water discharged from the second water discharger 22 into the backrest 5 avoids occurrence of a temperature boundary layer between the back of the seat occupant 200 and the backrest 5 and facilitates conduction of heat from the water to the back of the seat occupant 200. Simultaneous warming of the backside in addition to the front of the body can enhance the hyperthermic effect even at a low flow rate, and also save water and energy by saving the amount of water used.

The backrest 5 is partitioned by the wall portions 7 formed on both ends in the first direction x (along the width) and is formed in a concave configuration continued to the seat 4. Hence it is possible to prevent splash and outflow of the water flowing into the backrest 5 and to reliably guide the water to the seat 4 without waste. That is, the hyperthermic effect is not compromised even at a low flow rate, and it is also possible to save water and energy by saving the amount of water used.

The third water discharger 23 discharges a shower flow toward the acromion (point of the shoulder) of the seat occupant 200. The shower flow impinging on the acromion flows on and warms the part around the center of the arm that cannot be covered by the shower flow from the first and second water dischargers 21, 22. Furthermore, the shower flow can be applied also beyond the acromion toward the chest. The shower flow discharged from only a pair of third water dischargers 23 toward the acromia can cover the arms and other parts that cannot be covered by the first and second water dischargers 21, 22, and thus the cost can be reduced.

The water discharged from the first to third water discharger 21-23 flows along the body surface of the seat occupant 200 or the backrest 5 and is pooled in the concave seat 4. The water pooled in the seat 4 ensures that at least the rear side of the buttocks and thighs of the seat occupant 200 is in contact with water. Thus it is possible to efficiently warm the vicinity of the waist where the discharged water flow from the water dischargers 21-23 does not directly reach. Furthermore, warming the waist and the buttocks also serves to promote healthy intestinal motility.

The seat 4 is partitioned by the wall portions 6 formed on both ends in the first direction x (along the width) and is formed as a recess continued from the backrest 5. Hence it is possible to prevent lateral leakage of water and to efficiently use the water from the water dischargers 21-23 without waste. That is, it is possible to save water and energy by saving the amount of water used.

Along the body surface of the seat occupant 200 or the backrest 5, water continuously flows also into the seat 4. This flow avoids developing a temperature boundary layer between the seat occupant 200 and the seat 4 and facilitates conduction of heat from the water to the buttocks and thighs of the seat occupant 200. Thus the hyperthermic effect can be enhanced.

Furthermore, the water pooled in the seat 4 flows out forward (in the direction y in FIG. 1) and down the legs to the feet of the seat occupant 200. As a result, the feet are also warmed without wasting water. In particular, the recesses 4A as illustrated in FIG. 3B increase efficiency because the water pooled in the seat 4 is then easier to flow toward the legs of the seat occupant 200.

Moreover, the user can take a shower flow from the first to third water discharger 21-23 throughout the body while soaking in the water pooled in the seat 4. Thus the user can enjoy a sense of soaking in water similar to that felt at the beginning of bathing in a bathtub (a sense of bathing), and a high hyperthermic effect is achieved despite shower bathing. Furthermore, water pressure applied to the body is lower than that for soaking in a bathtub and places less strain on the body. Because the apparatus can be used in a seated position without the need to move into and out of the bathtub, elderly and physically challenged users can also easily enjoy a high hyperthermic effect. Furthermore, because the user can take a shower simultaneously throughout the body rather than separately on each part of the body, the user can warm the body by taking a shower in a short time with saving water.

Each water discharger 21-23 discharges a continuous shower flow of water rather than mist. Hence the ambient space is not filled with an atmosphere of high temperature and humidity as in the case of spraying mist, and dizziness can be prevented. Furthermore, because the temperature decrease of discharged water due to heat of vaporization is small, there is no need to set the shower temperature higher than needed, achieving greater economy.

The shower flow discharged from the first to third water discharger 21-23 in the shower bathing apparatus of this embodiment is discharged from a plurality of shower holes provided in each water discharger. The hole diameter is preferably in the range of e.g. 0.2 to 4 mm. In this range, a wide area can be efficiently warmed at a low flow rate.

In Patent Document 1, an arm having a plurality of water dischargers extends forward of a seat occupant. In contrast, according to this embodiment, the water dischargers 21-23 are integrated with the bathroom wall behind the seat occupant 200. Thus the footprint can be reduced in the limited bathroom space. The compact and simple configuration eliminates annoyance in the bathroom without compromising the design. Furthermore, because the apparatus has no arm extending forward, a user in a wheelchair, for example, can be safely and easily transferred to the seat 4 of the shower bathing apparatus and enjoy high user friendliness.

It is possible to provide a shower bath for efficiently warming the entire body of a seat occupant 200 with a small amount of water by suitably configuring the water discharge direction of the shower flow from each water discharger 21-23 as described above. There is no need for many water dischargers in front of the seat occupant 200, but only a minimum number of water dischargers are needed behind to the seat occupant. Minimizing the number of water dischargers also leads to cost reduction. Furthermore, reducing the needed amount of water also serves to save water and energy.

Figure 7:
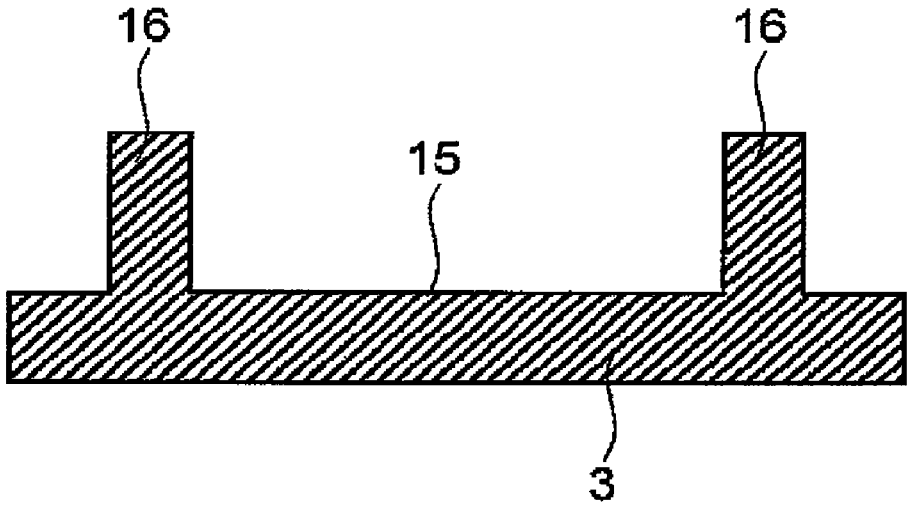
FIG. 7 is a schematic cross-sectional view showing another example of the seat.

FIG. 7 is a schematic cross-sectional view showing another example of the seat.

In this example, wall portions 16 are provided upright on the upper face of the base portion 3 to provide a concave seat 15 partitioned by the wall portions 16 from the other upper face of the base portion 3.

In the following, other embodiments of the invention are described. Elements similar to those described earlier are marked with like reference numerals and not described in detail.

Second Embodiment

Figure 8:
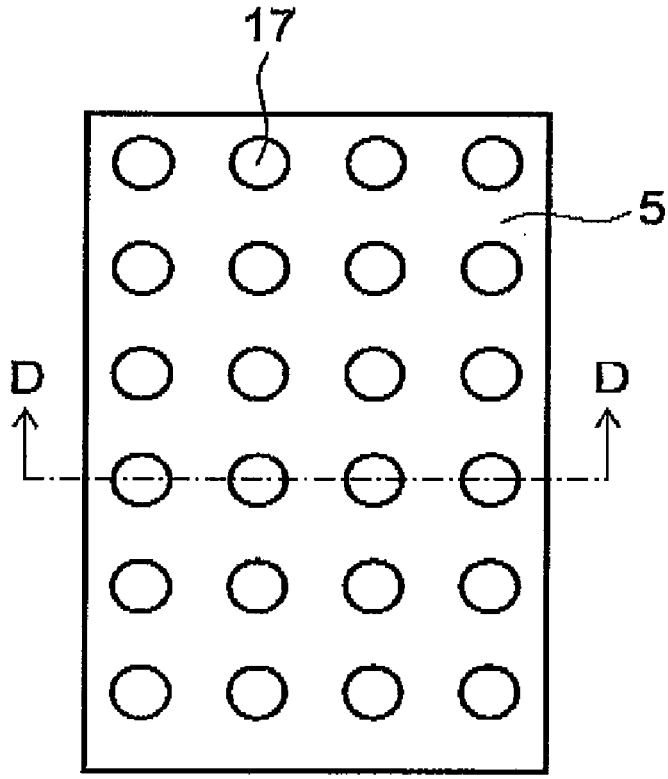
FIG. 8 is a schematic front view of a backrest of a shower bathing apparatus according to a second embodiment of the invention.

FIG. 8 is a schematic front view of a backrest 5 of a shower bathing apparatus according to a second embodiment of the invention.

Figure 9:
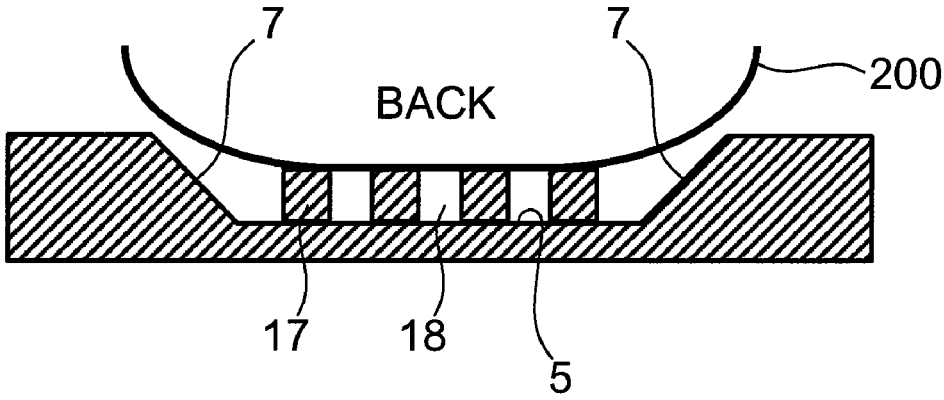
FIG. 9 is the D-D cross-sectional view of FIG. 8.

FIG. 9 is the D-D cross-sectional view of FIG. 8.

In this embodiment, the backrest 5 has irregularity. In the example shown in FIG. 8, the backrest 5 has a plurality of cylindrical protrusions 17, for example.

Figure 10:
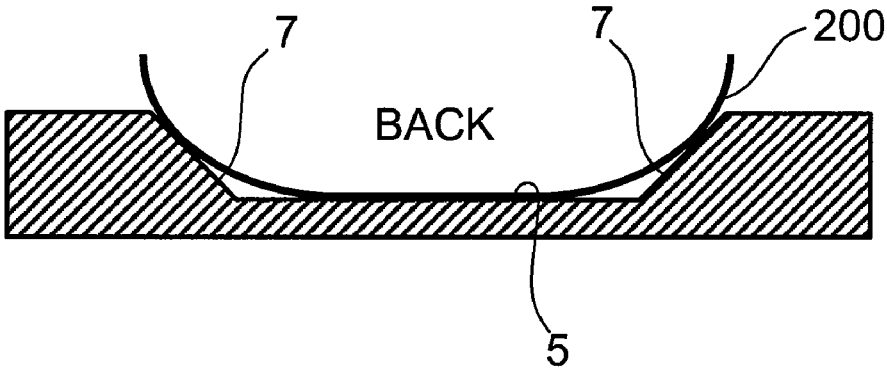
FIG. 10 is a schematic cross-sectional view of a backrest without irregularity.

As shown in FIG. 10, the backrest 5 without irregularity is in close contact with the back of the seat occupant 200, and water is difficult to flow on the back of the seat occupant 200. In contrast, as shown in FIG. 9, the backrest 5 with irregularity (protrusions 17) can ensure channels 18 for the water flowing between the backrest 5 and the back of the seat occupant 200. Thus a flow of water flowing in contact with the back of the seat occupant 200 can be ensured. The flow of water can be allowed to flow into the seat 4 while warming the back of the seat occupant 200.

The number and arrangement of the protrusions 17 are not limited to this example. For example, in contrast to the example illustrated in FIG. 8, the protrusions 17 may be placed in a staggered configuration. Then the vertical channel is interrupted, and water is easy to spread laterally. Hence the back of the seat occupant 200 can be warmed entirely and uniformly.

Furthermore, the protrusion 17 is not limited in shape and size to this example, but may be provided with various shapes such as elliptic or rectangular cylinder. Furthermore, its tip and/or corner can be suitably rounded to adjust stimuli applied to the seat occupant 200. The protrusion 17 may be composed of a curved surface such as hemisphere. Suitable placement of such protrusions 17 also provides a "pressure point massage" effect.

Figure 11:
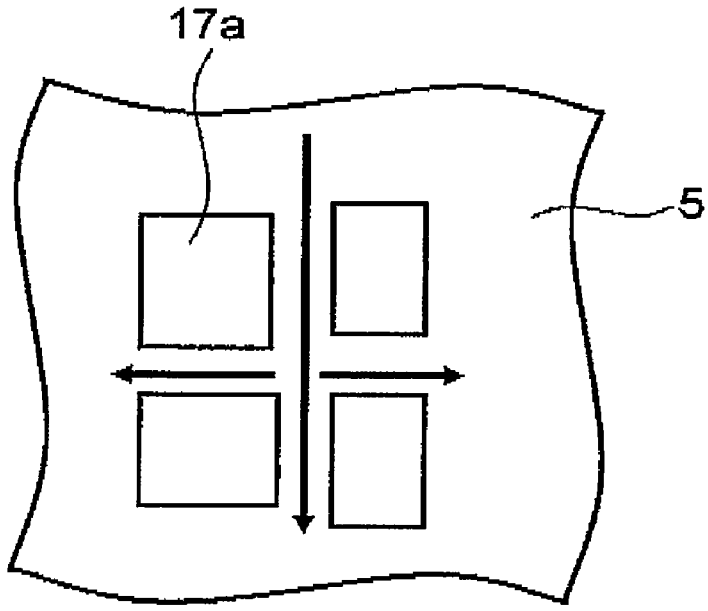
FIG. 11 is a schematic plan view showing another example where irregularity is provided on the backrest.
Figure 12:
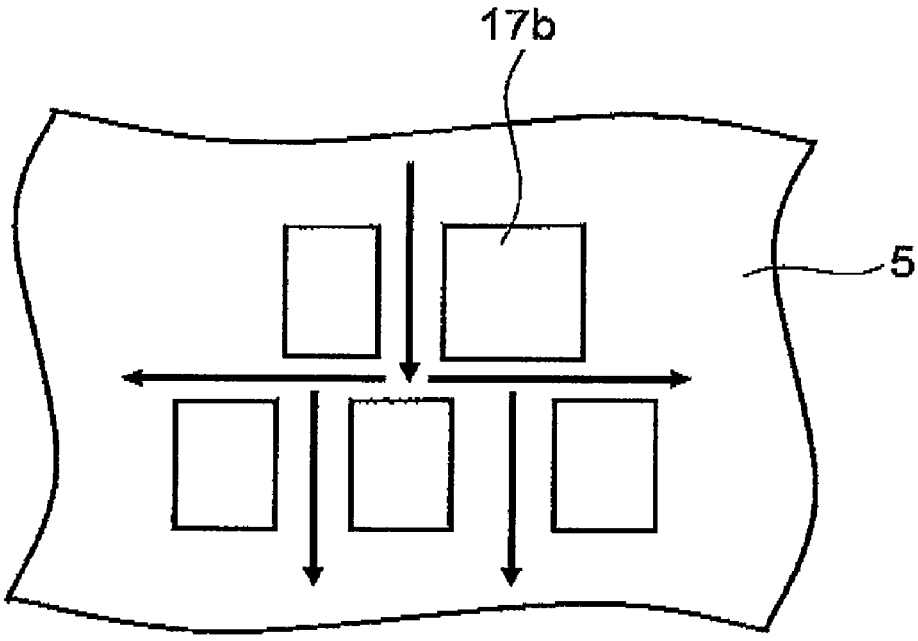
FIG. 12 is a schematic plan view showing still another example where irregularity is provided on the backrest.
Figure 13:
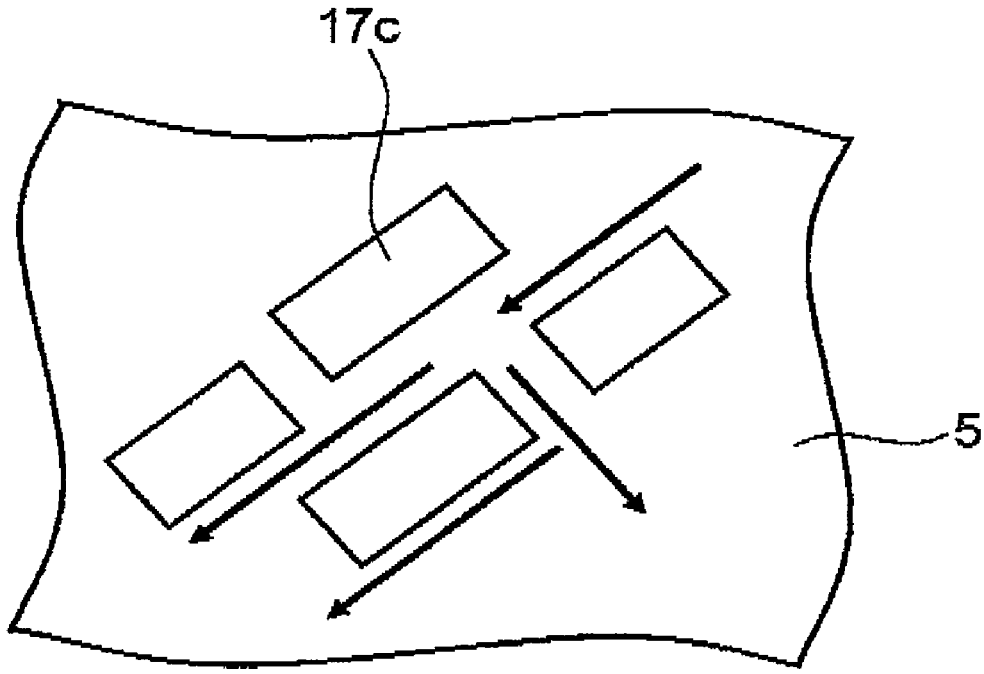
FIG. 13 is a schematic plan view showing still another example where irregularity is provided on the backrest.

FIGS. 11 to 13 show other examples of irregularity provided on the backrest 5.

FIG. 11 shows an example where the backrest 5 has rectangular protrusions 17*a*.

FIG. 12 also shows rectangular protrusions 17*b* as in FIG. 11. However, the vertical channel (the channel along the height of the backrest 5) formed between the protrusions 17*b* is interrupted by another protrusion 17*b*. Thus the channel does not extend continuously from top to bottom, and flowing water is easy to laterally spread on the backrest 5. That is, streams of flowing water are formed entirely on the backrest 5, and the back of the seat occupant 200 can be warmed entirely and uniformly.

In FIG. 13, the channel between the protrusions 17*c* is sloped with respect to the height direction of the backrest 5. This configuration also facilitates forming streams of flowing water entirely on the backrest 5.

Third Embodiment

Figure 14:
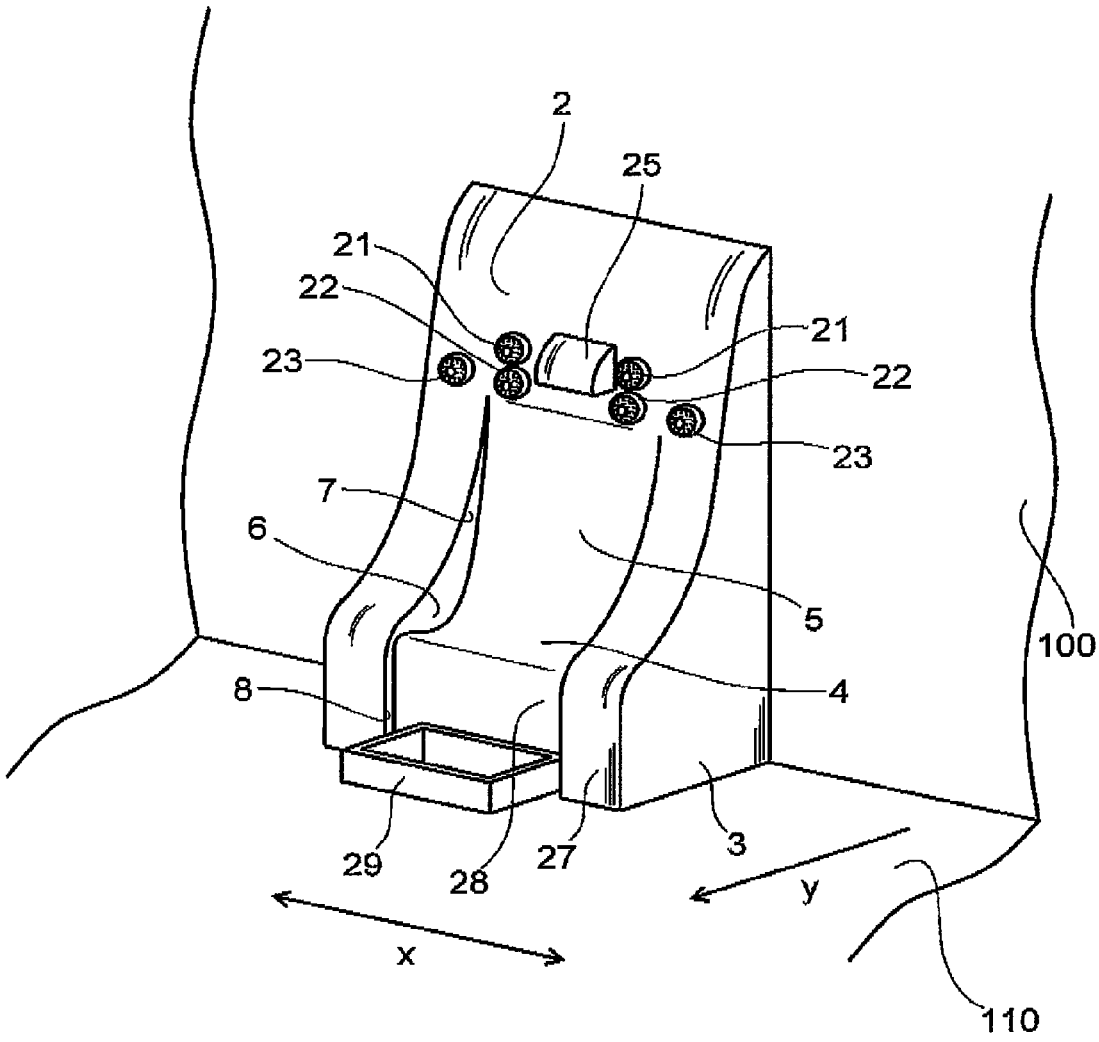
FIG. 14 is a perspective view schematically illustrating the appearance of a shower bathing apparatus according to a third embodiment of the invention.

FIG. 14 is a perspective view schematically illustrating the appearance of a shower bathing apparatus according to a third embodiment of the invention.

In this embodiment, the base portion 3 has a recess 28 on the front portion 27 located on the front side as viewed in the projecting direction (second direction y) of the base portion 3. The recess 28 is recessed toward the bathroom wall 100. As viewed in the first direction x, a step is formed across a wall portion 8 between each end of the front portion 27 and the recess 28. The recess 28 is continued from the seat 4, and the wall portion 8 is continued from the wall portion 6 formed at each end of the seat 4.

Furthermore, a foot bathtub 29 is provided on the bathroom floor 110 in front of the recess 28. The water discharged from the first to third water discharger 21-23 flows along the body surface of the seat occupant or along the backrest 5 and the seat 4 and is pooled in the foot bathtub 29.

Figure 15:
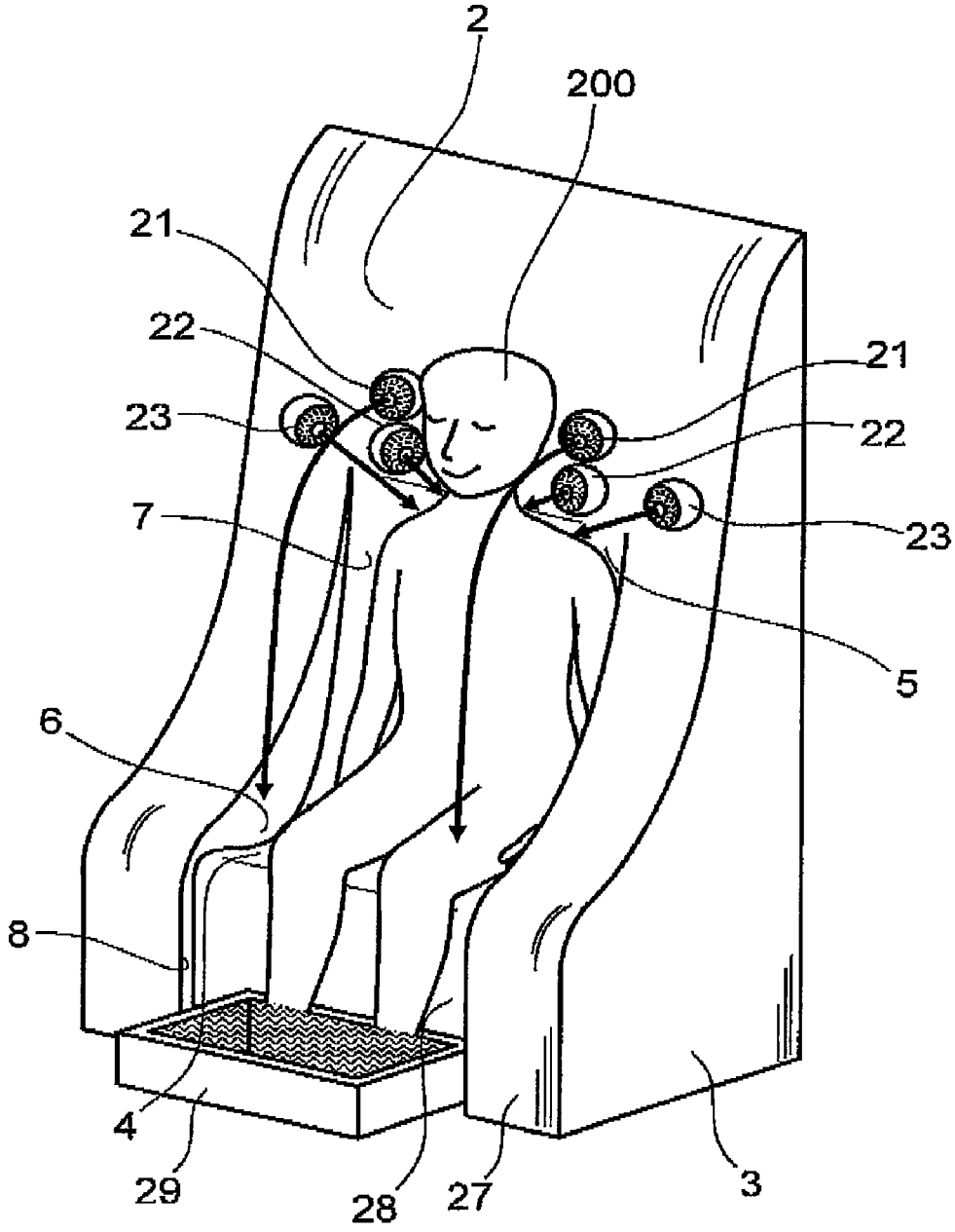
FIG. 15 is a perspective view schematically showing the water discharge of a shower flow from each water discharger to a seat occupant in the third embodiment.

As shown in FIG. 15, the seat occupant 200 can soak the feet in the water pooled in the foot bathtub 29 to enhance the hyperthermic effect on the feet, which are most distant from the first to third water discharger 21-23 and where blood flow is likely to stagnate with low skin temperature. Furthermore, the feet have arteriovenous anastomoses (AVA). Soaking the feet in the water in the foot bathtub 29 results in opening AVA to increase blood flow, thereby further enhancing the hyperthermic effect on the entire body.

Because the recess 28 continued from the seat 4 is provided on the front portion 27 of the base portion 3, the water overflowing the seat 4 can flow along the recess 28 and be pooled in the foot bathtub 29 without lateral leakage. Hence the water from the water dischargers 21-23 can be efficiently used without waste.

Fourth Embodiment

Figure 16:
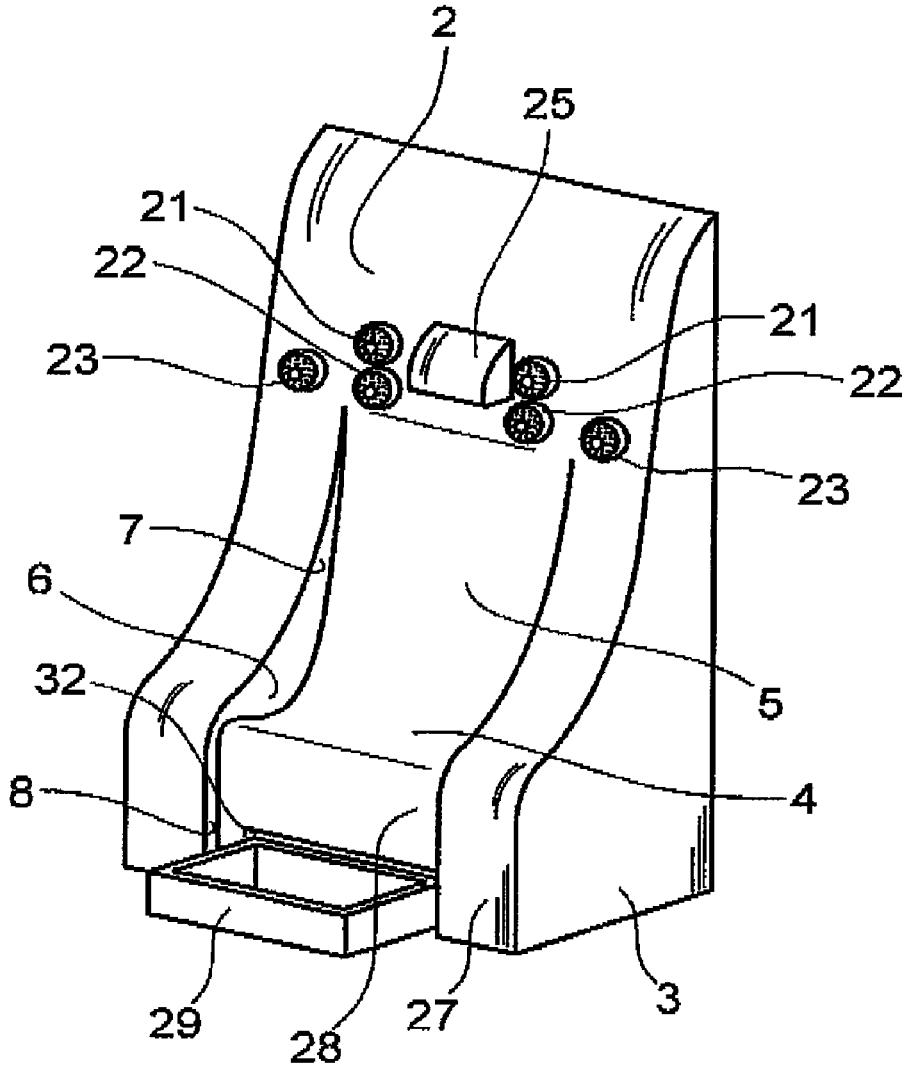
FIG. 16 is a perspective view schematically illustrating the appearance of a shower bathing apparatus according to a fourth embodiment of the invention, where a foot bathtub is placed on the bathroom floor.
Figure 17:
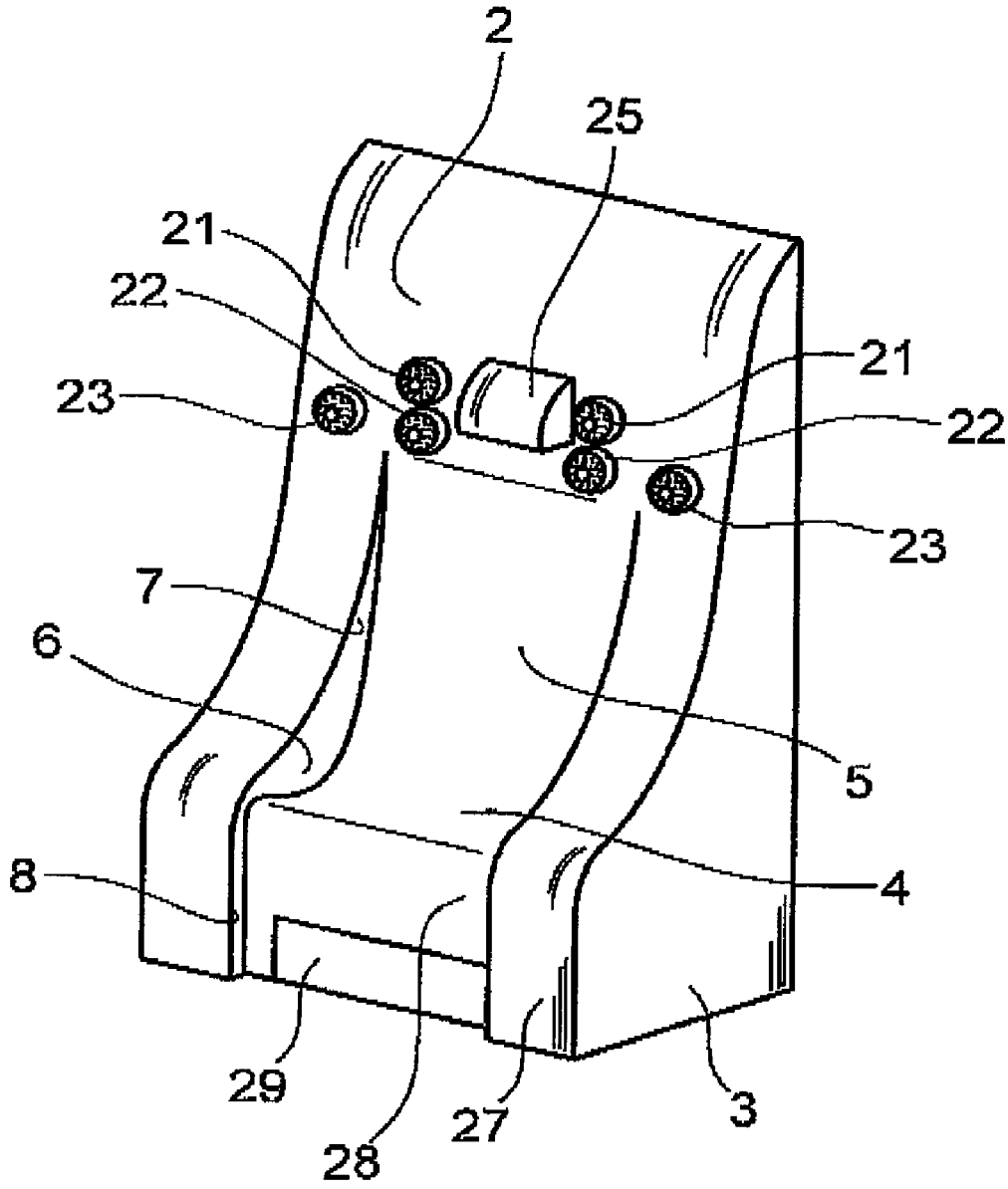
FIG. 17 is a perspective view schematically illustrating the appearance of the shower bathing apparatus according to the fourth embodiment of the invention, where the foot bathtub is housed in the base portion.

FIGS. 16 and 17 are perspective views schematically illustrating the appearance of a shower bathing apparatus according to a fourth embodiment of the invention.

In this embodiment, an opening 32 continued to the space inside the base portion 3 is formed in the recess 28 of the base portion 3 so that the foot bathtub 29 can be moved into and out of the base portion 3 through the opening 32.

When the shower bathing apparatus is not in use, the foot bathtub 29 can be housed in the base portion 3 as shown in FIG. 17. Thus the foot bathtub 29 disappears from the bathroom floor and does not obstruct cleaning, for example. Furthermore, the design is simplified and does not compromise the appearance inside the bathroom. Moreover, the foot bathtub 29 is not obstructive, for example, to the transfer of a user between a wheelchair and the seat 4, thus improving transferability.

Figure 18:
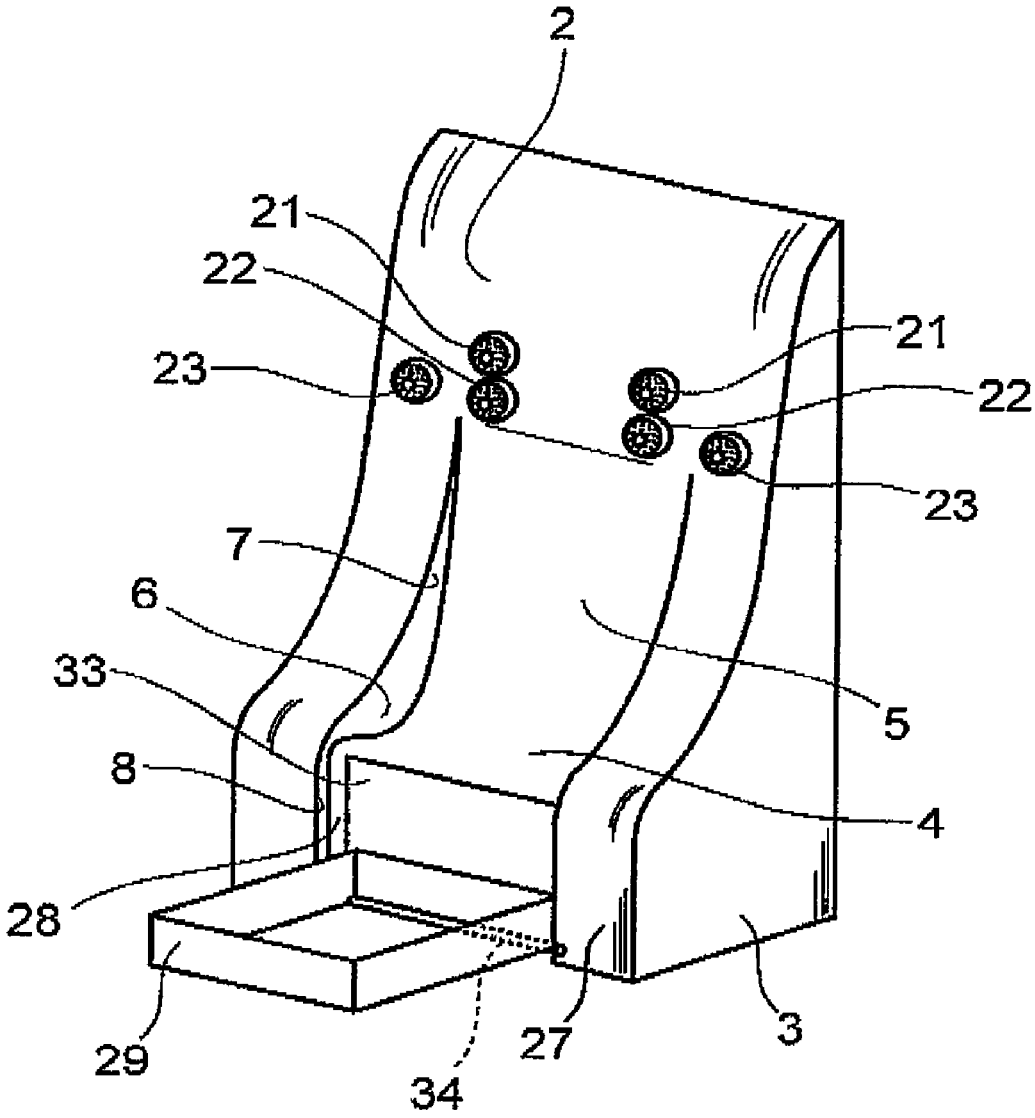
FIG. 18 is a perspective view showing another example structure for housing a foot bathtub, where the foot bathtub is placed on the bathroom floor.
Figure 19:
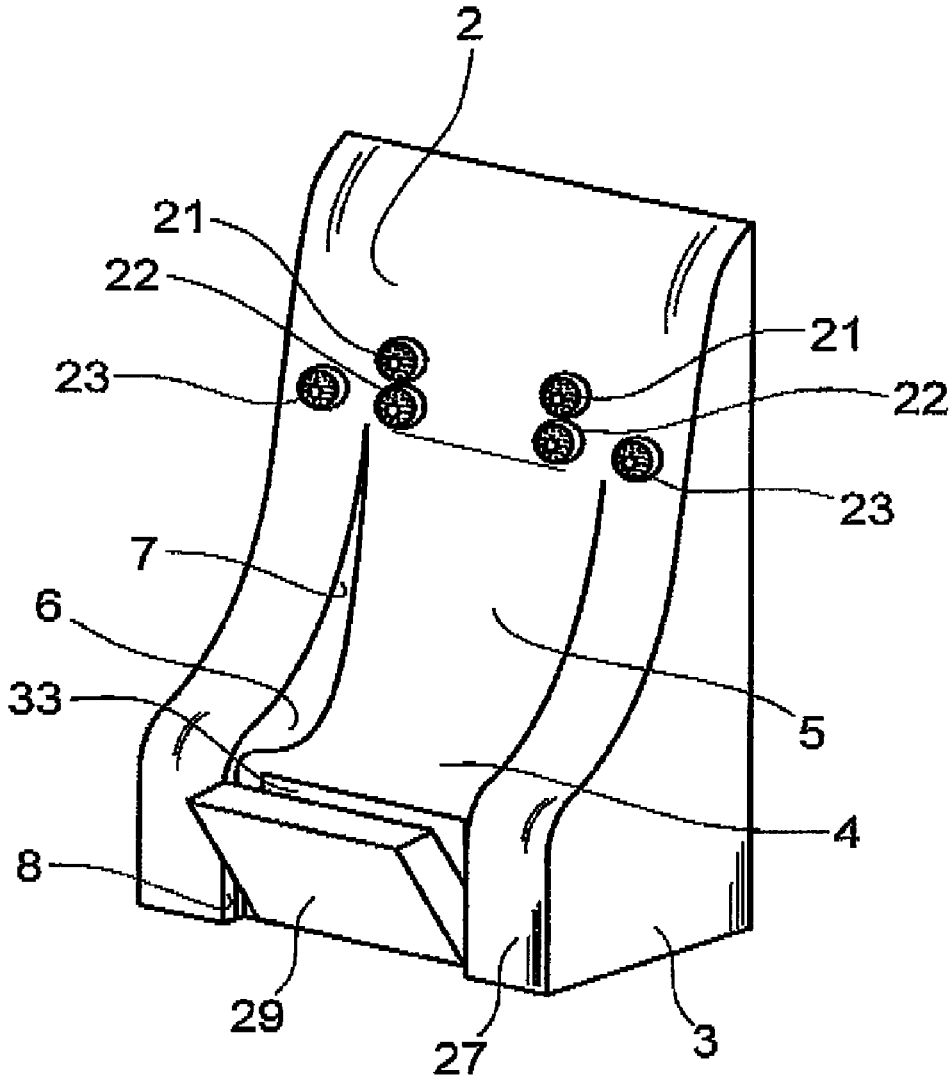
FIG. 19 is a perspective view where the foot bathtub shown in FIG. 18 is in rotation.

FIGS. 18 and 19 show another example structure for housing the foot bathtub 29.

In this example, the foot bathtub 29 is rotatable about a shaft 34 provided at its rear edge. The foot bathtub 29 can be housed in the base portion 3 and placed on the bathroom floor by rotation about the shaft 34. Also in this configuration, the foot bathtub 29 does not obstruct cleaning and has a simplified design and superior transferability.

Fifth Embodiment

Figure 20:
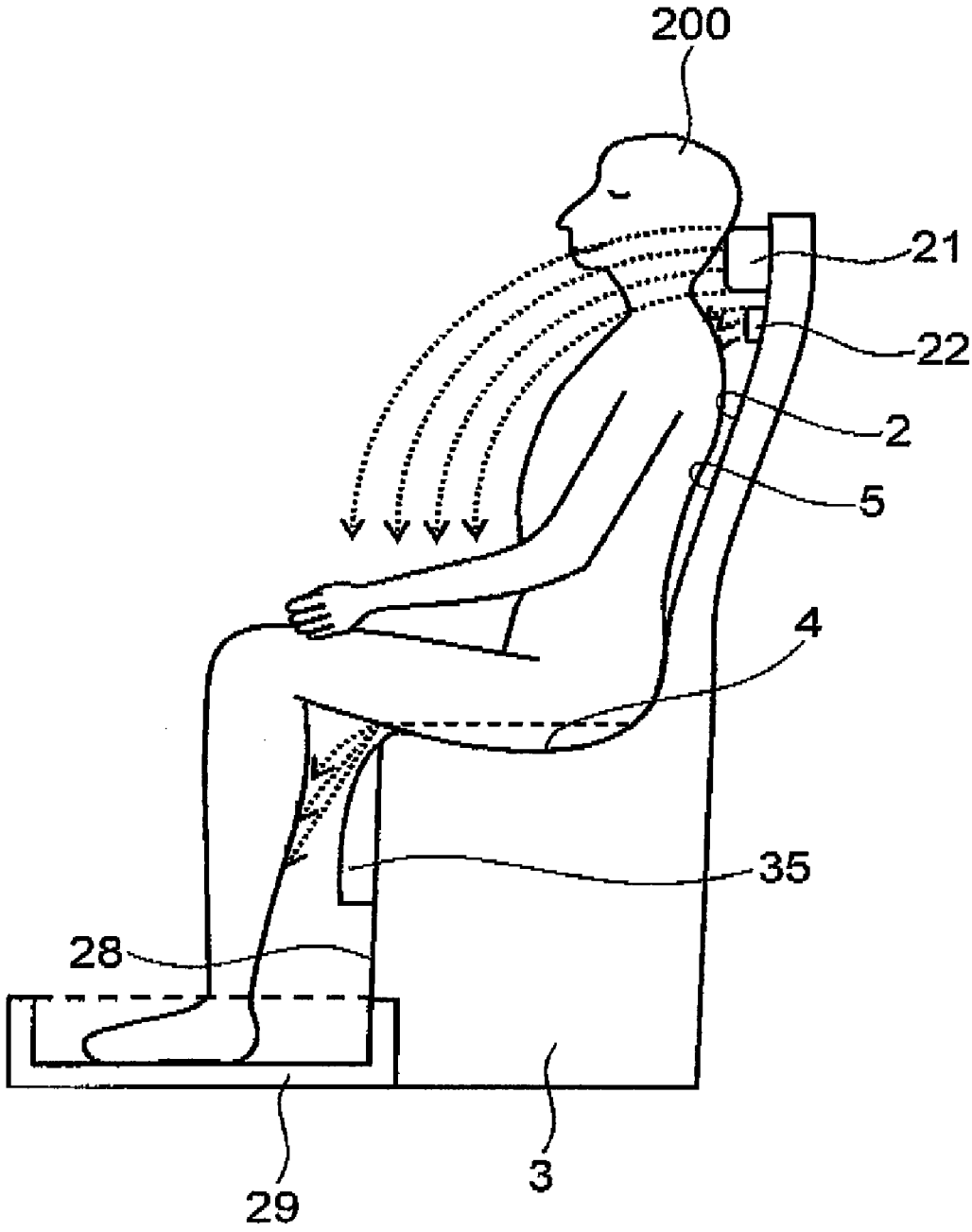
FIG. 20 is a schematic side cross-sectional view of a shower bathing apparatus according to a fifth embodiment of the invention.

FIG. 20 is a schematic side cross-sectional view of a shower bathing apparatus according to a fifth embodiment of the invention.

The recess 28 formed on the front portion of the base portion 3 serves as a guide portion for guiding water from the seat 4 to the foot bathtub 29. Additionally, in this embodiment, a guide portion 35 sloped forward and downward is provided above the recess 28 so as to guide the water falling from the seat 4 to the calves of the seat occupant 200. That is, the water from the seat 4 is allowed to flow in contact with the calves of the seat occupant 200 to the foot bathtub 29. Thus the hyperthermic effect on the calves is enhanced, and a massage effect is achieved by the flow of water sweeping the calves.

Furthermore, wall portions 6 as illustrated in FIGS. 3A and 3B, for example, can be provided on both sides of the guide portion 35. Then the water overflowing forward of the seat 4 can be applied to the calves of the seat occupant 200 and guided to the foot bathtub 29 without lateral leakage. Any apparatus including such a guide portion 35 is also encompassed within the scope of the invention.

Sixth Embodiment

Figure 21:
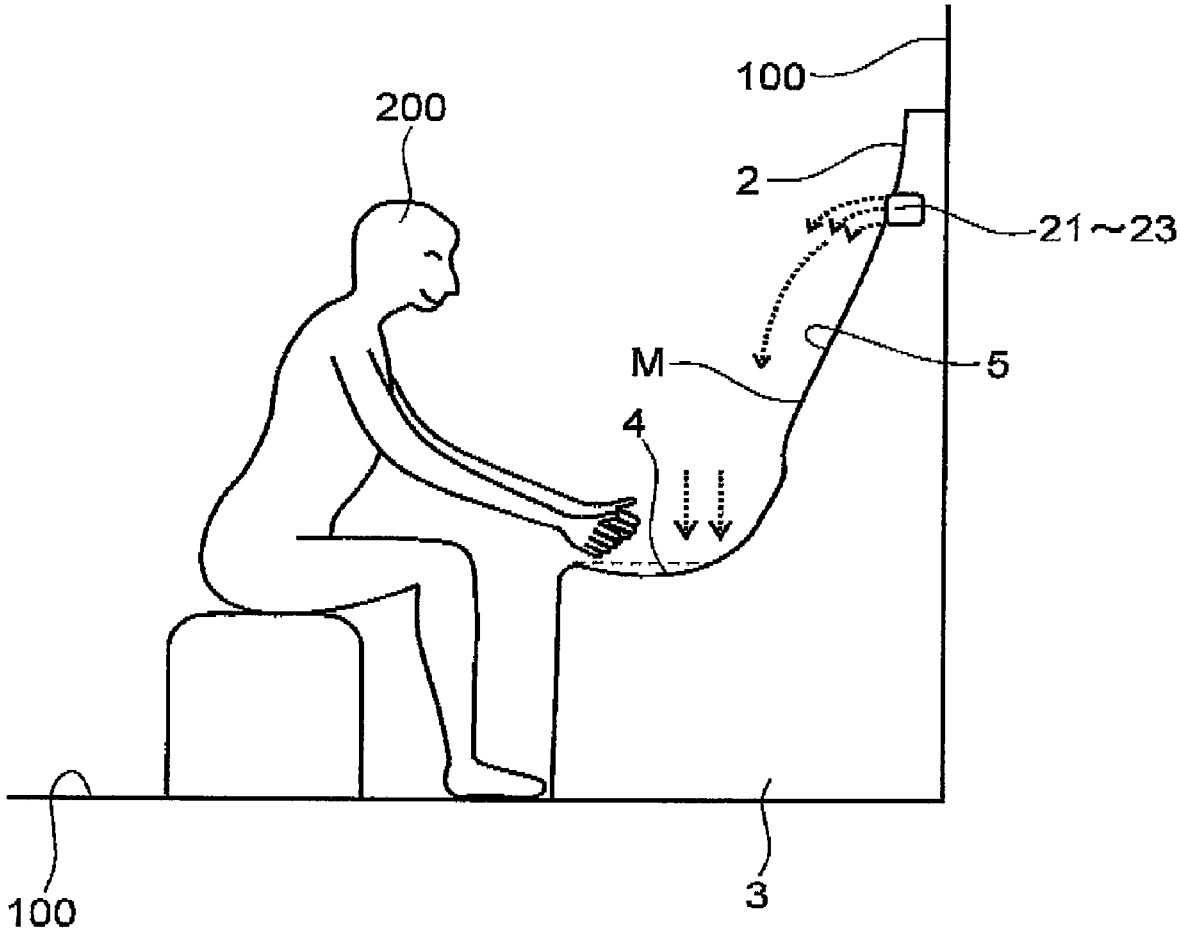
FIG. 21 is a schematic side cross-sectional view of a shower bathing apparatus according to a sixth embodiment of the invention.

FIG. 21 is a schematic side cross-sectional view of a shower bathing apparatus according to a sixth embodiment of the invention.

In this embodiment, a mirror M is provided as needed on the backrest 5 so that the shower bathing apparatus can be used as a washstand. That is, because of the concave configuration, the seat 4 can pool water and serve as a washbasin. This results in space savings and cost reduction because there is no need to prepare a separate washstand and washbasin. Furthermore, the seat 4 can also serve as a handrail, since it is designed to have sufficient strength for supporting a seat occupant seated thereon.

Figure 22:
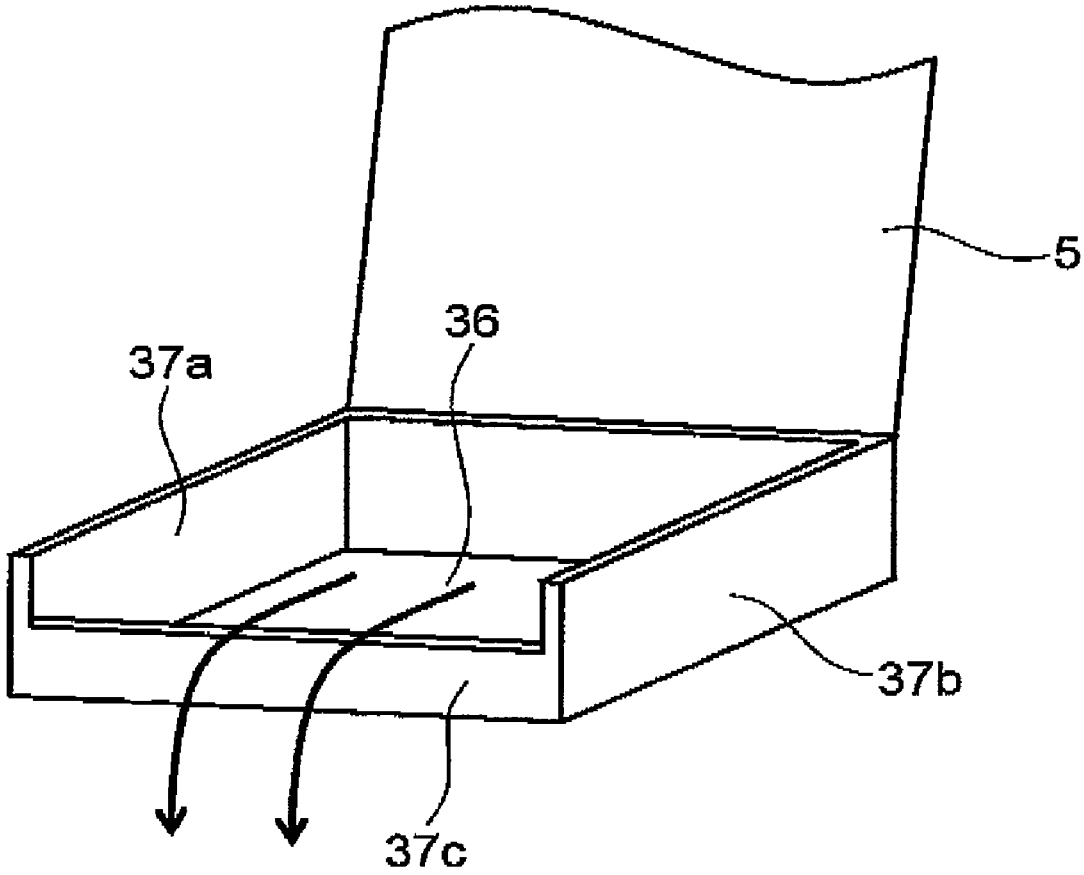
FIG. 22 is a schematic perspective view showing another example of the seat.

As shown in FIG. 22, the seat 36 may be configured as a box surrounded by wall portions 37*a*-37*c* on all four sides. Here, the wall portion 37*c* on the front-end side (on the side of the feet of the seat occupant) is lower than the lateral wall portions 37*a*, 37*b*. Then the water pooled in the seat 36 flows beyond the front-end wall portion 37*c* to the feet of the seat occupant and the foot bathtub without lateral leakage. Thus the feet can be warmed without wasting water.

Seventh Embodiment

Figure 23:
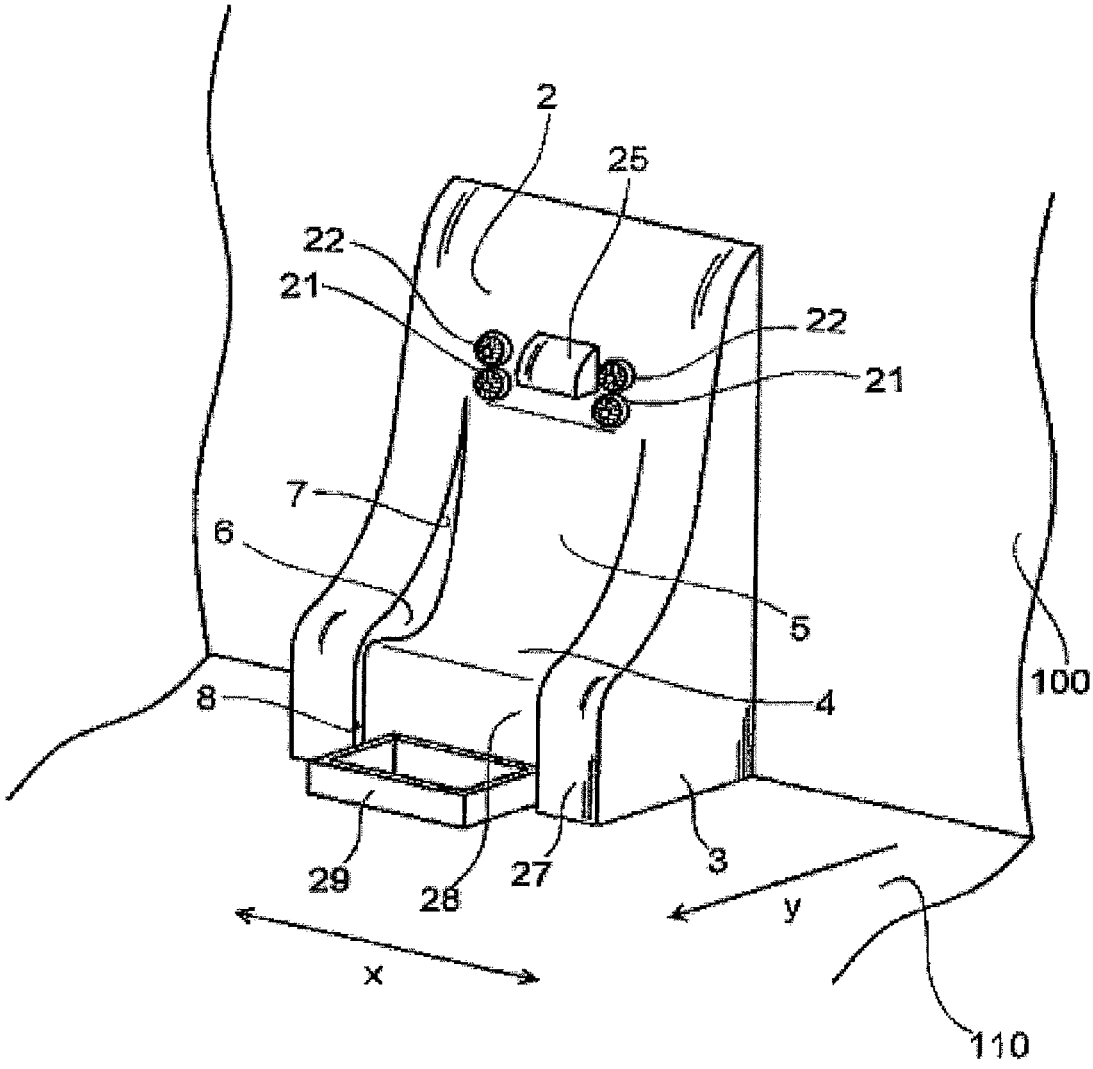
FIG. 23 is a perspective view schematically showing a shower bathing apparatus according to a seventh embodiment of the invention placed in a bathroom.

FIG. 23 is a perspective view schematically showing a shower bathing apparatus according to a seventh embodiment of the invention placed in a bathroom.

Figure 24:
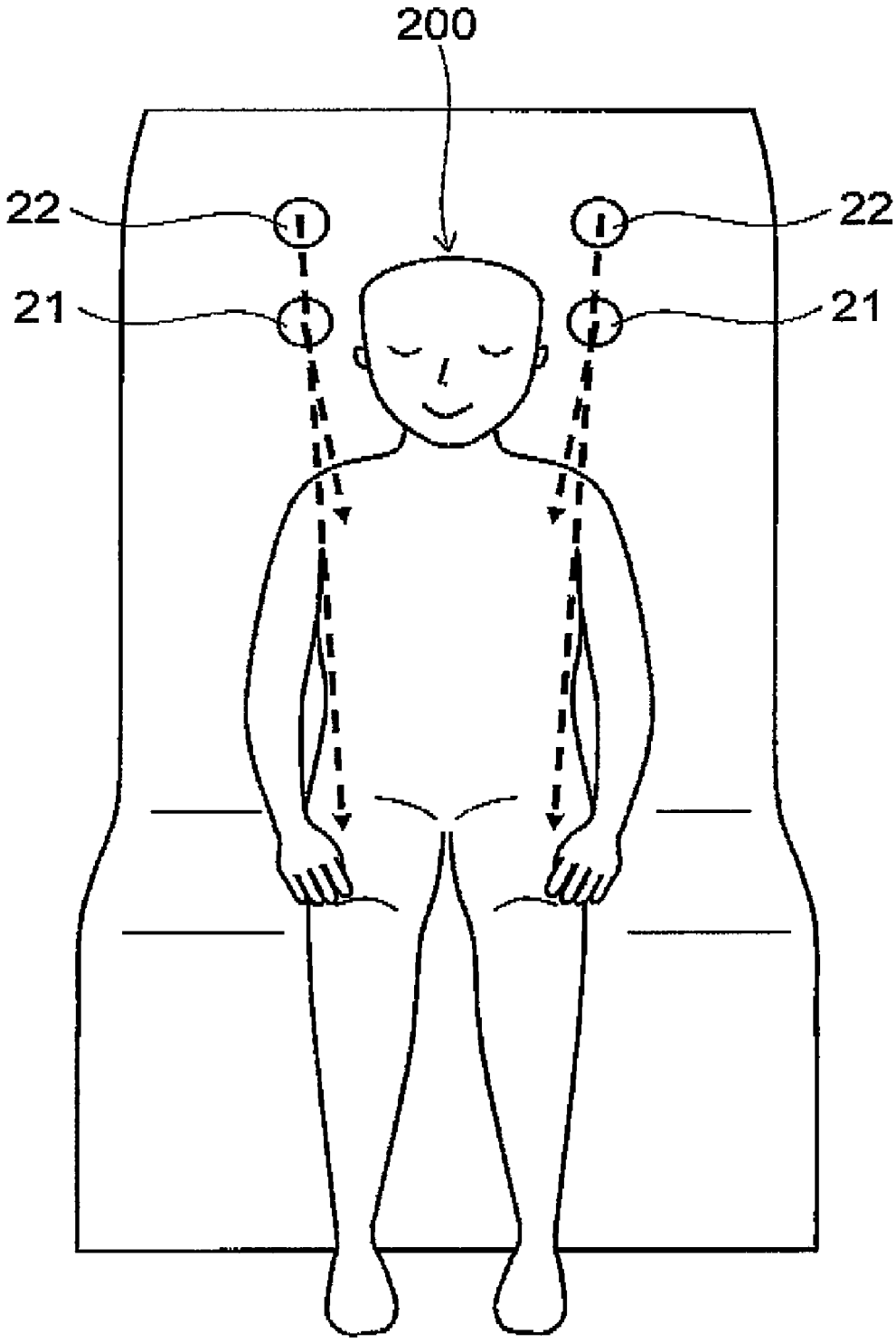
FIG. 24 is a schematic view showing the water discharge direction of the shower flow from each water discharger in the shower bathing apparatus as viewed from the front side.

FIG. 24 is a schematic view showing the water discharge direction of the shower flow from each water discharger in the shower bathing apparatus as viewed from the front side.

Figure 25:
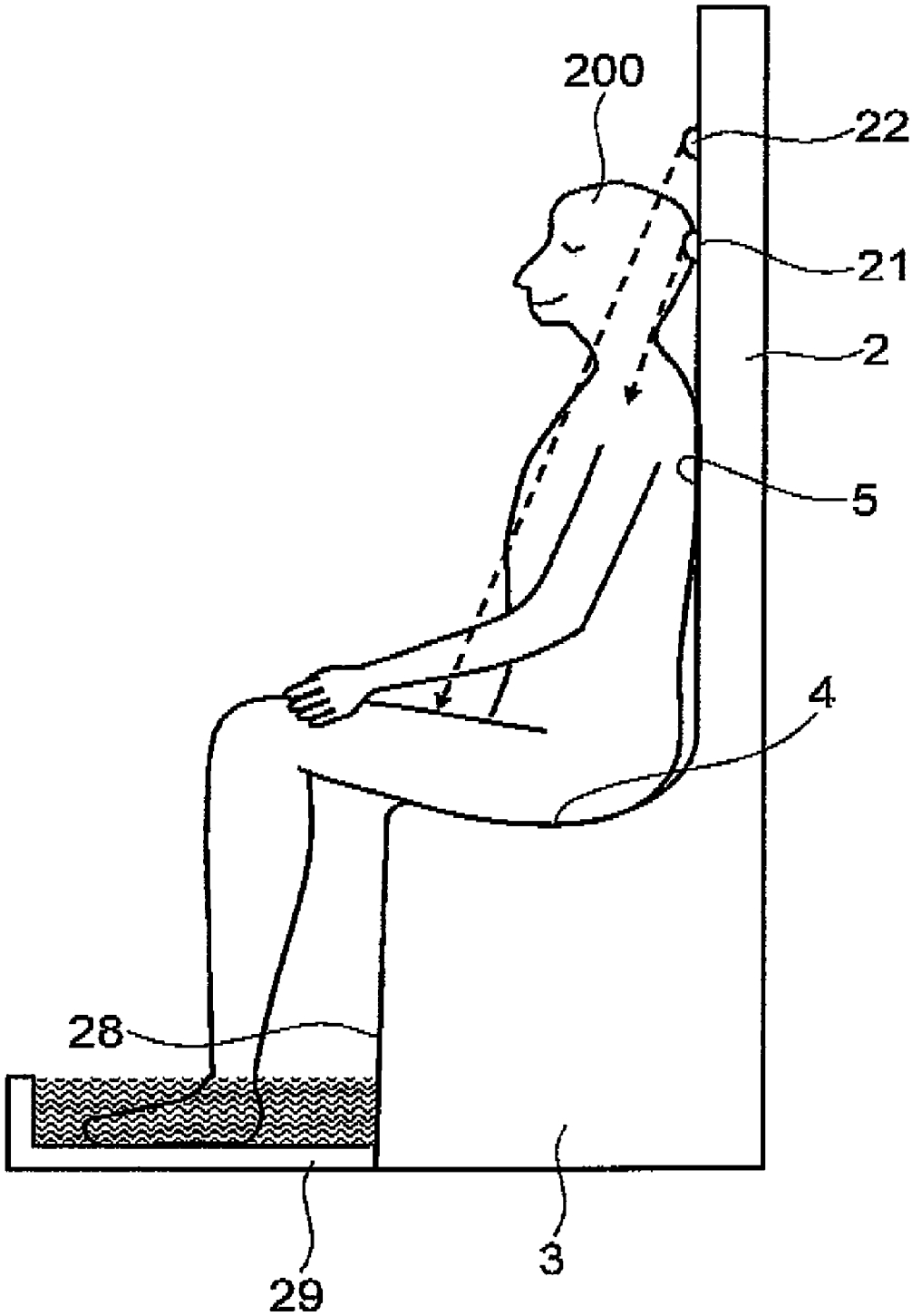
FIG. 25 is a schematic view showing the water discharge direction of the shower flow from each water discharger in the shower bathing apparatus as viewed from the lateral side.

FIG. 25 is a schematic view showing the water discharge direction of the shower flow from each water discharger in the shower bathing apparatus as viewed from the lateral side.

The shower bathing apparatus according to this embodiment primarily comprises a back portion 2 provided on a wall 100 of a bathroom and a base portion 3 provided on a floor 110 of the bathroom. In the figure, the base portion 3 is integrated with the bottom of the back portion 2. However, the base portion 3 and the back portion 2 may be provided separately. Alternatively, the back portion may be constituted by the bathroom wall. That is, the entire bathroom wall may be used to serve as a back portion for receiving the back of a seat occupant.

The base portion 3 protrudes forward (in the direction of arrow y in FIG. 23) of the back portion 2. On the top face of the base portion 3 is formed a concave seat 4, which is recessed toward the floor 110 relative to the other part of the top face. The back portion 2 has a concave backrest 5, which is recessed toward the bathroom wall 100 relative to the other part of the back portion 2. The backrest 5 and the seat 4 are formed as a continuous recess.

The seat 4 is sloped down along the depth (toward the backrest 5). That is, the recess of the seat 4 gradually deepens along the depth (toward the backrest 5).

At the upper part of the back portion 2 and generally at its center in a first direction x (along the width of the base portion 3) generally parallel to the bathroom wall 100 and the bathroom floor 110 is provided a head support 25 for supporting the head, or a portion from the neck to the head, of a seat occupant seated on the seat 4. The head support 25 protrudes in a second direction y (the protruding direction of the base portion 3) from the back portion 2.

A pair of first water dischargers 21 is provided on the back portion 2 above the backrest 5. The first water dischargers 21 are provided on both sides, one for each side, of the head support 25 so as to interpose the head support 25 as viewed in the first direction x. When a user is seated on the seat 4, the first water dischargers 21 are located above the shoulders of the seated user. The height between the seat 4 and the first water discharger 21 is larger than the height from the bathroom floor 110 to the seat 4. The two first water dischargers 21 are spaced from each other in the first direction x so that the face or head of the seated user can be located between the pair of first water dischargers 21. That is, the pair of first water dischargers 21 is located so as to interpose the face or head of the user seated on the seat 4. However, the first water dischargers 21 may be provided at a higher position than the head of the seat occupant seated on the seat 4.

A pair of second water dischargers 22 is provided on the back portion 2 above the backrest 5 and above the pair of first water dischargers 21, respectively.

The water discharge direction of each water discharger 21, 22 is configured to be an obliquely downward direction relative to the horizontal direction. Each water discharger 21, 22 discharges a shower flow of e.g. about 40 to 45° C.

The base portion 3 has a recess 28 on the front portion 27 located on the front side along the projecting direction (second direction y) of the base portion 3. The recess 28 is recessed toward the bathroom wall 100. The recess 28 is continued from the seat 4.

A foot bathtub 29 is provided on the bathroom floor 110 in front of the recess 28. The water discharged from the water dischargers 21, 22 flows along the body surface of the seat occupant or along the backrest 5 and the seat 4 and is pooled in the foot bathtub 29.

Next, the function of the shower bathing apparatus according to this embodiment is described.

In FIGS. 24 and 25, the shower flow from each water discharger 21, 22 is shown by a dashed arrow.

The second water discharger 22 discharges a shower flow that is ejected obliquely downward relative to the horizontal direction and falling around the front edge of the seat 4. That is, without the intermediary of any arm extending into the bathroom space as disclosed in the above-mentioned Patent Document 1, the second water discharger 22 provided on the back portion 2 discharges a shower flow falling directly around the front edge of the seat 4. Here, when a seat occupant is seated on the seat 4, the water discharge flow reaches on the seat occupant and does not fall directly around the front edge of the seat 4. Hence, when a seat occupant is seated on the seat 4, the term "falling around the front edge of the seat 4" also includes "falling around the legs of a seat occupant seated on the seat 4". From another viewpoint, the second water discharger 22 discharges a shower flow obliquely downward over the shoulder of the seat occupant 200, and the shower flow falls around the leg particularly centering on the thigh of the seat occupant 200. Here the shower flow may fall also on the abdomen in addition to the leg of the seat occupant 200. The shower flow flows on the surface of the leg from the knee toward the foot of the seat occupant 200.

The second water dischargers 22 are provided behind the seat occupant 200 and near the head, which is distant from the legs of the seat occupant 200. Even in this configuration, the water discharge flow can reliably reach the leg without being blocked by the seat occupant 200 and warm also the leg below the knee by discharging water over the shoulder of the seat occupant 200.

The second water dischargers 22 are provided above the head of the seat occupant 200. The water discharged from such a high position can provide a massage effect by the shower flow acting on the legs like the so-called "Utaseyu". Because the shower flow from the second water discharger 22 is dropped from a high position, the falling acceleration of water droplets increases, and the increase of flying distance results in coupling between droplets, which facilitates increasing the droplet diameter and enhancing stimuli to the legs. This can promote blood circulation, and prevent regurgitation of lymph to promote smooth lymphatic flow. Even if the stimuli of the shower flow are not applied along the lymphatic flow in the body, intermittent stimuli applied to the lymphatic pathway can prevent regurgitation of lymph to promote smooth lymphatic flow. Promotion of lymphatic flow can serve to excrete waste accumulated in the body, to remove edema, stiffness, and fatigue, and to enhance immune function.

The first water discharger 21 discharges a shower flow toward the shoulder near the base of the neck of the seat occupant 200. Part of the shower flow impinging on the shoulder flows on the front and lateral portion of the body extending from the chest to the trunk of the seat occupant 200, and the other part of the shower flow impinging on the shoulder is wrapped around to the back. Thus both the front and back of the body of the seat occupant 200 can be warmed. Furthermore, the massage effect by the shower flow can also be allowed to act on the shoulder.

By discharging the shower flow from the first water discharger 21 toward the shoulder near the base of the neck of the seat occupant 200 and allowing the shower flow to flow on the front and back of the upper body of the seat occupant 200, the entire upper body of the seat occupant 200 can be efficiently warmed with only a pair of first water dischargers 21 provided behind the seat occupant 200. That is, the number of water dischargers can be minimized to reduce cost while providing a high hyperthermic effect.

The water wrapped around to the backside of the seat occupant 200 continuously flows along the back of the seat occupant 200 or the backrest 5 toward the seat 4. That is, a continuous flow of water discharged from the first water discharger 21 into the backrest 5 avoids occurrence of a temperature boundary layer between the back of the seat occupant 200 and the backrest 5 and facilitates conduction of heat from the water to the back of the seat occupant 200. Simultaneous warming of the backside in addition to the front of the body can enhance the hyperthermic effect even at a low flow rate, and also save water and energy by saving the amount of water used.

The backrest 5 is formed in a concave configuration continued to the seat 4. Hence it is possible to prevent splash and outflow of the water flowing into the backrest 5 and to reliably guide the water to the seat 4 without waste. That is, the hyperthermic effect is not compromised even at a low flow rate, and it is also possible to save water and energy by saving the amount of water used.

The water discharged from the water dischargers 21, 22 flows along the body surface of the seat occupant 200 or the backrest 5 and is pooled in the concave seat 4. The water pooled in the seat 4 ensures that at least the rear side of the buttocks and thighs of the seat occupant 200 is in contact with water. Thus it is possible to efficiently warm the vicinity of the waist where the discharged water flow from the water dischargers 21, 22 does not directly reach. Furthermore, warming the waist and the buttocks also serves to promote healthy intestinal motility.

The seat 4 is formed as a recess continued from the backrest 5. Hence it is possible to prevent lateral leakage of water and to efficiently use the water from the water dischargers 21, 22 without waste. That is, it is possible to save water and energy by saving the amount of water used.

Along the body surface of the seat occupant 200 or the backrest 5, water continuously flows also into the seat 4. This flow avoids occurrence of a temperature boundary layer between the seat occupant 200 and the seat 4 and facilitates conduction of heat from the water to the buttocks and thighs of the seat occupant 200. Thus the hyperthermic effect can be enhanced.

The water pooled in the seat 4 flows out to the recess 28 provided on the front portion 27 of the base portion 3 and down the legs to the feet of the seat occupant 200. As a result, the feet are also warmed without wasting water. Because the recess 28 continued from the seat 4 is provided on the front portion 27 of the base portion 3, the water overflowing the seat 4 can flow along the recess 28 and be pooled in the foot bathtub 29 without lateral leakage. Hence the water from the water dischargers 21, 22 can be efficiently used without waste.

The seat occupant 200 can soak the feet in the water pooled in the foot bathtub 29 to enhance the hyperthermic effect on the feet, which are most distant from the water dischargers 21, 22 and where blood flow is likely to stagnate with low skin temperature. Furthermore, the feet have arteriovenous anastomoses (AVA). Soaking the feet in the water in the foot bathtub 29 results in opening AVA to increase blood flow, thereby further enhancing the hyperthermic effect on the entire body.

According to this embodiment, the user can take a shower flow from the water dischargers 21, 22 throughout the body while soaking in the water pooled in the seat 4. Thus the user can enjoy a sense of soaking in water similar to that felt at the beginning of bathing in a bathtub (a sense of bathing), and a high hyperthermic effect is achieved despite shower bathing. Furthermore, water pressure applied to the body is lower than that for soaking in a bathtub and places less strain on the body. Because the apparatus can be used in a seated position without the need to move into and out of the bathtub, elderly and physically challenged users can also easily enjoy a high hyperthermic effect. Furthermore, because the user can take a shower simultaneously throughout the body rather than separately on each part of the body, the user can warm the body by taking a shower in a short time with saving water.

Each water discharger 21, 22 discharges a continuous shower flow of water rather than mist. Hence the ambient space is not filled with an atmosphere of high temperature and humidity as in the case of spraying mist, and dizziness can be prevented. Furthermore, because the temperature decrease of discharged water due to heat of vaporization is small, there is no need to set the shower temperature higher than needed, achieving greater economy.

The shower flow discharged from the water dischargers 21, 22 in the shower bathing apparatus of this embodiment is discharged from a plurality of shower holes drilled in each water discharger 21, 22. The hole diameter is preferably in the range of e.g. 0.2 to 4 mm. In this range, a wide area can be efficiently warmed at a low flow rate. The term "shower flow" used herein includes both a shower flow that is discharged in a linear continuous flow and a shower flow that is discharged in droplets (mist flow) at the moment of being discharged from the water discharger.

In Patent Document 1, an arm having a plurality of water dischargers extends forward of a seat occupant. In contrast, according to this embodiment, the water dischargers 21, 22 are integrated with the bathroom wall behind the seat occupant 200. Thus the footprint can be reduced in the limited bathroom space. The compact and simple configuration eliminates annoyance in the bathroom without compromising the design. Furthermore, because the apparatus has no arm extending forward, a user in a wheelchair, for example, can be safely and easily transferred to the seat 4 of the shower bathing apparatus and enjoy high user friendliness. Moreover, because the apparatus has no arm, the user can wash the body and hair in a sitting position on the seat 4 or near the shower bathing apparatus without obstruction.

It is possible to provide a shower bath for efficiently warming the entire body of a seat occupant 200 with a small amount of water by suitably configuring the water discharge direction of the shower flow from each water discharger 21, 22 as described above. There is no need for many water dischargers in front of the seat occupant 200, but only a minimum number of water dischargers are needed behind the seat occupant. Minimizing the number of water dischargers also leads to cost reduction. Furthermore, reducing the needed amount of water also serves to save water and energy.

Eighth Embodiment

Figure 26:
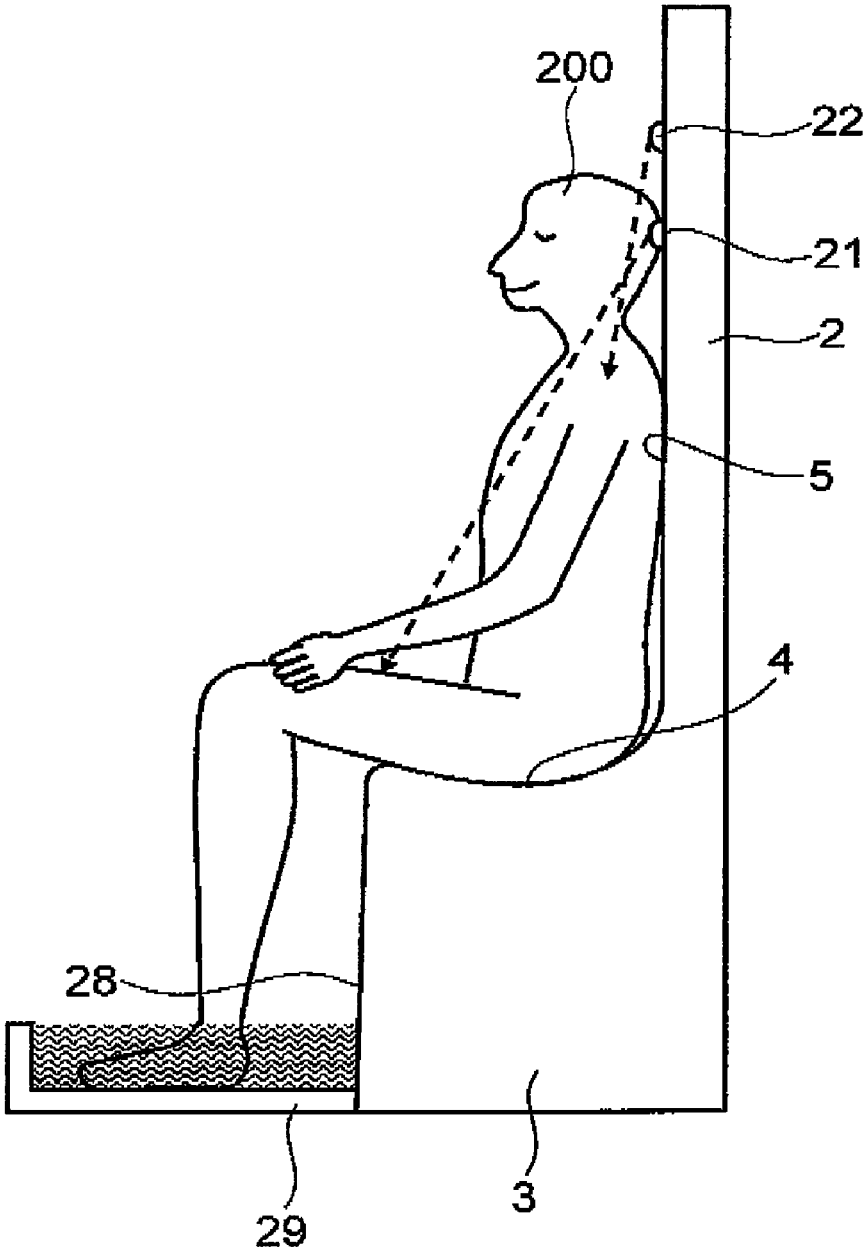
FIG. 26 is a schematic view showing the water discharge direction of the shower flow from each water discharger in a shower bathing apparatus according to an eighth embodiment of the invention as viewed from the lateral side.

FIG. 26 is a schematic view showing the water discharge direction of the shower flow from each water discharger in a shower bathing apparatus according to an eighth embodiment of the invention as viewed from the lateral side.

In this embodiment, the water discharge direction of each water discharger 21, 22 is configured to be an obliquely downward direction relative to the horizontal direction, and each water discharger 21, 22 discharges a shower flow. However, contrary to the seventh embodiment, the first water discharger 21 discharges a shower flow that is ejected obliquely downward relative to the horizontal direction and falling around the front edge of the seat 4, and the second water discharger 22 discharges a shower flow toward the shoulder of the seat occupant 200.

The first water discharger 21 discharges a shower flow obliquely downward over the shoulder of the seat occupant 200, and the shower flow falls around the leg particularly centering on the thigh of the seat occupant 200. Part of the shower flow discharged from the second water discharger 22 and impinging on the shoulder flows on the front and lateral portion of the body extending from the chest to the trunk of the seat occupant 200, and the other part of the shower flow impinging on the shoulder is wrapped around to the back.

In this embodiment, the first water discharger 21, which is nearer to the legs, discharges a shower flow toward the legs. This enables the shower flow to reach the legs in a shorter distance than in the seventh embodiment. That is, it can reduce the temperature decrease of the shower flow discharged from the first water discharger 21 during flying to the leg, and warm the leg with the shower flow at a desired temperature.

Furthermore, the difference between the flying distance of the shower flow from the first water discharger 21 to the legs and the flying distance of the shower flow from the second water discharger 22 to the shoulders can be made smaller than that in the seventh embodiment. That is, it is possible to reduce the difference between the temperature decreases of the shower flow discharged from the water dischargers 21, 22 during flying to decrease the temperature difference between the legs and the body trunk. Thus it is possible to provide a more comfortable shower bath.

Ninth Embodiment

Figure 27:
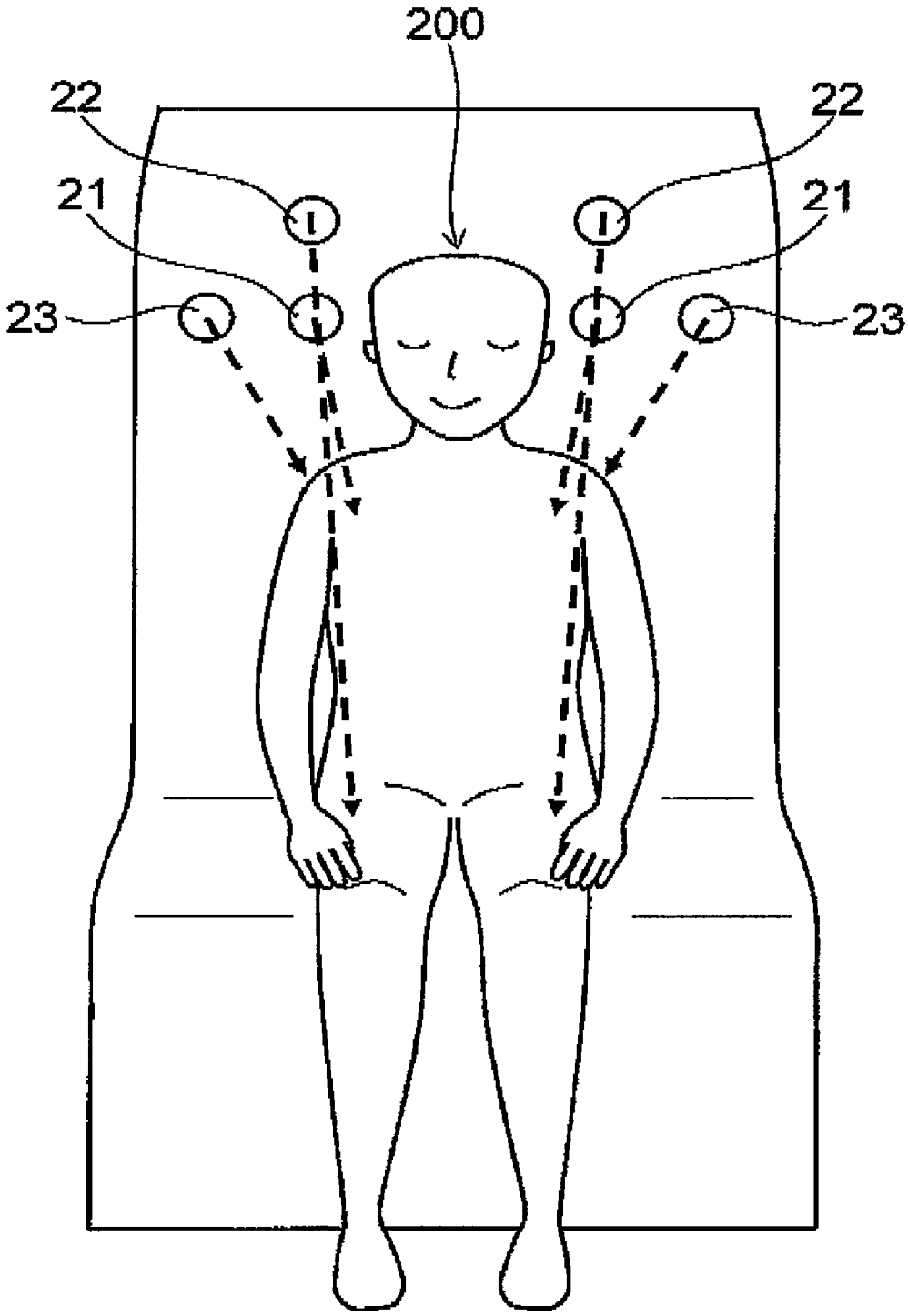
FIG. 27 is a schematic view showing the water discharge direction of the shower flow from each water discharger in a shower bathing apparatus according to a ninth embodiment of the invention as viewed from the front side.

FIG. 27 is a schematic view showing the water discharge direction of the shower flow from each water discharger in a shower bathing apparatus according to a ninth embodiment of the invention as viewed from the front side.

In this embodiment, third water dischargers 23 are provided in addition to the first water dischargers 21 and the second water dischargers 22 described above. That is, a pair of third water dischargers 23 is provided on the back portion 2 nearly as high as the first water dischargers 21 and outside the first water dischargers 21 (outside as viewed in the x-direction in FIG. 23).

The third water discharger 23 discharges a shower flow toward the acromion (point of the shoulder) of the seat occupant 200. The shower flow impinging on the acromion flows on and warms the part around the center of the arm and the lateral portion of the trunk that cannot be covered by the shower flow from the first and second water dischargers 21, 22. Furthermore, the shower flow can be applied also beyond the acromion toward the chest. The first to third water dischargers 21-23 and the foot bathtub 29 can serve to warm the entire body including the body trunk, arms, legs, and toes of the seat occupant 200.

Tenth Embodiment

Figure 28:
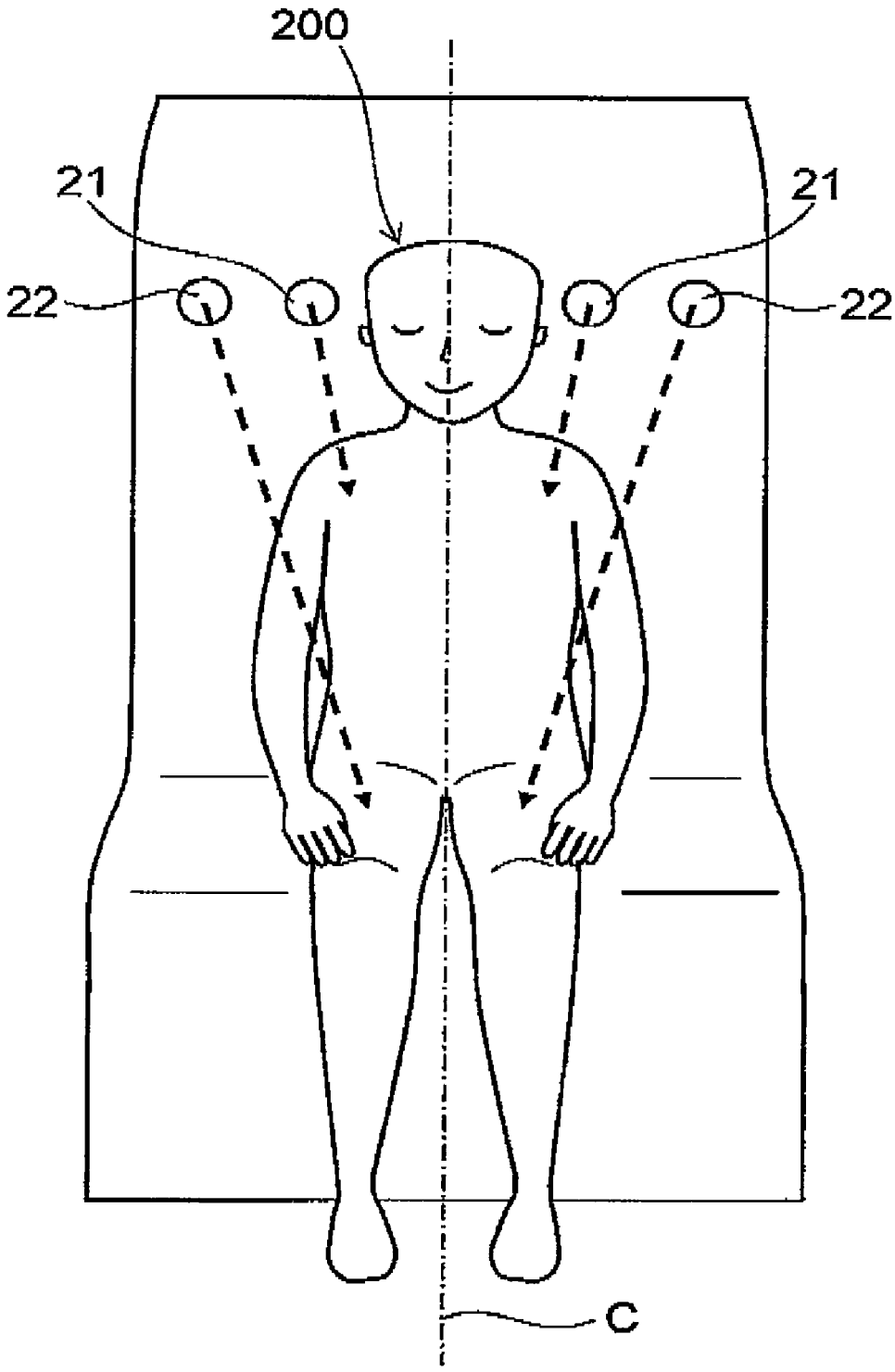
FIG. 28 is a schematic view showing the water discharge direction of the shower flow from each water discharger in a shower bathing apparatus according to a tenth embodiment of the invention as viewed from the front side.

FIG. 28 is a schematic view showing the water discharge direction of the shower flow from each water discharger in a shower bathing apparatus according to a tenth embodiment of the invention as viewed from the front side.

In this embodiment, the second water dischargers 22 are provided, instead of above the first water dischargers 21, nearly as high as the first water dischargers 21 and outside the first water dischargers 21 (outside as viewed in the x-direction in FIG. 23).

The first water discharger 21 discharges a shower flow toward the shoulder of the seat occupant 200, and the second water discharger 22 discharges a shower flow that is ejected obliquely downward relative to the horizontal direction and falling around the front edge of the seat 4. That is, from the second water discharger 22, a shower flow falls around the leg particularly centering on the thigh of the seat occupant 200.

The second water discharger 22, which is more distant from the center c of the seat occupant 200 or the seat 4, discharges water obliquely downward toward the leg. Hence the falling acceleration of droplets increases, and the increase of flying distance results in coupling between droplets, which facilitates increasing the droplet diameter and enhancing stimuli to the legs. This can promote blood circulation, and prevent regurgitation of lymph to promote smooth lymphatic flow.

Eleventh Embodiment

Figure 29:
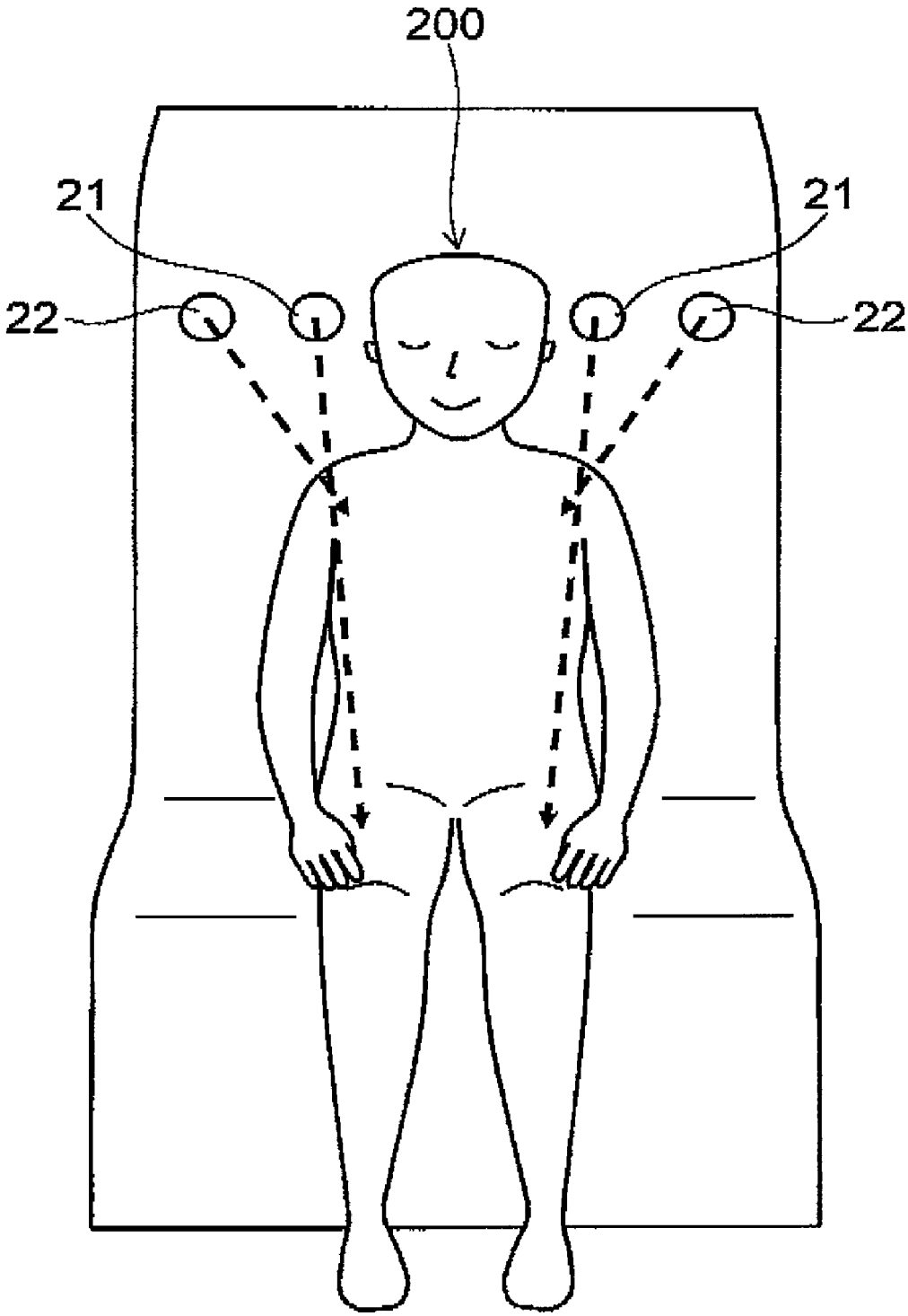
FIG. 29 is a schematic view showing the water discharge direction of the shower flow from each water discharger in a shower bathing apparatus according to an eleventh embodiment of the invention as viewed from the front side.

FIG. 29 is a schematic view showing the water discharge direction of the shower flow from each water discharger in a shower bathing apparatus according to an eleventh embodiment of the invention as viewed from the front side.

In this embodiment, contrary to the tenth embodiment described with reference to FIG. 28, the first water discharger 21 discharges a shower flow that is ejected obliquely downward relative to the horizontal direction and falling around the front edge of the seat 4, and the second water discharger 22 discharges a shower flow toward the shoulder of the seat occupant 200. The first water discharger 21 discharges a shower flow obliquely downward over the shoulder of the seat occupant 200, and the shower flow falls around the leg particularly centering on the thigh of the seat occupant 200.

In this embodiment, the difference between the flying distance of the shower flow from the first water discharger 21 to the legs and the flying distance of the shower flow from the second water discharger 22 to the shoulders can be made smaller than that in the tenth embodiment. That is, it is possible to reduce the difference between the temperature decreases of the shower flow discharged from the water dischargers 21, 22 during flying to decrease the temperature difference between the legs and the body trunk. Thus it is possible to provide a more comfortable shower bath.

Twelfth Embodiment

Figure 30:
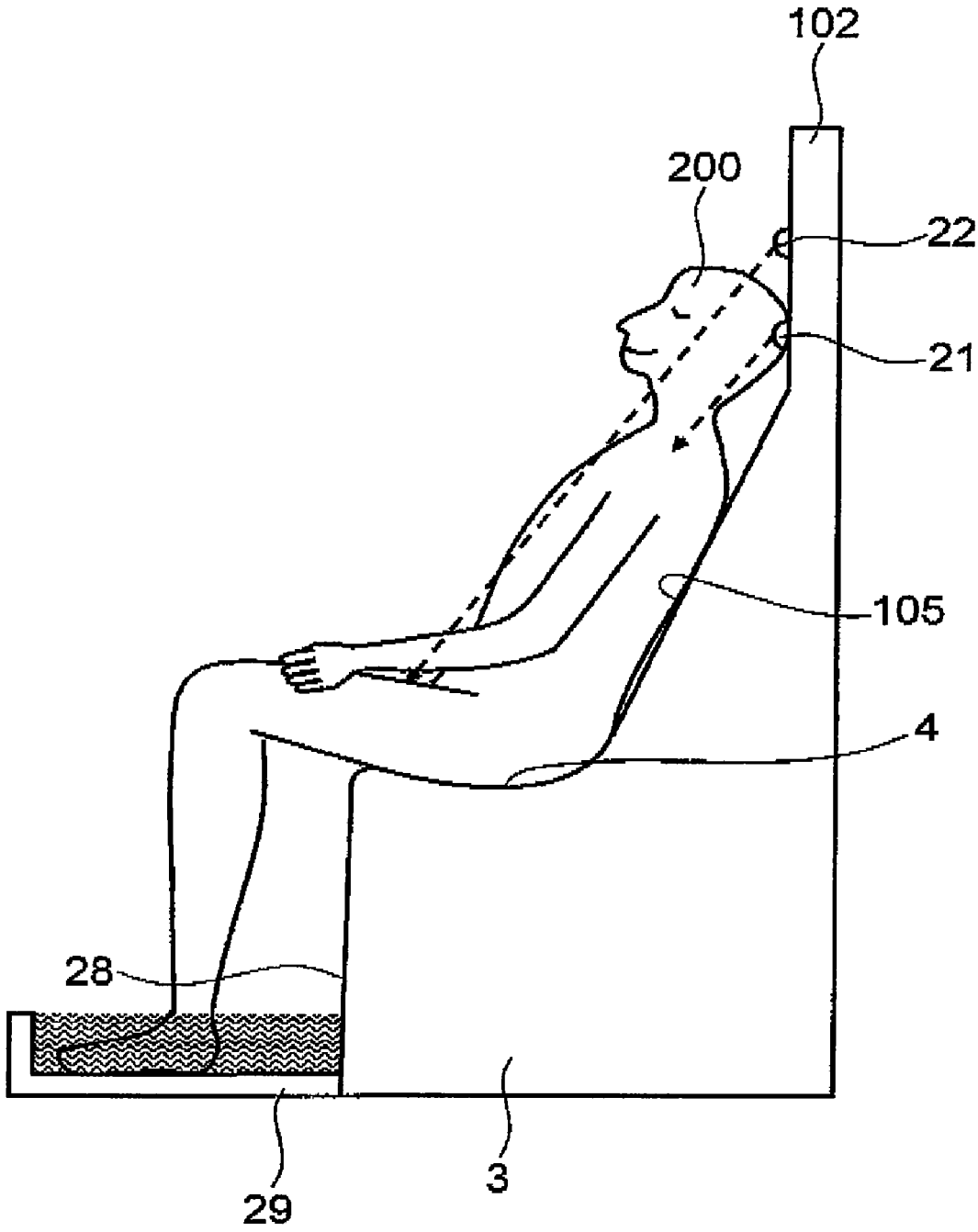
FIG. 30 is a schematic view showing the water discharge direction of the shower flow from each water discharger in a shower bathing apparatus according to a twelfth embodiment of the invention as viewed from the lateral side.

FIG. 30 is a schematic view showing the water discharge direction of the shower flow from each water discharger in a shower bathing apparatus according to a twelfth embodiment of the invention as viewed from the lateral side.

The back portion 102 of the shower bathing apparatus according to this embodiment has a backrest 105 sloped relative to the vertical direction. That is, in this embodiment, in contrast to the seventh embodiment shown in FIG. 25, the backrest 105 receiving the back of the seat occupant 200 is sloped to lean backward. The seat occupant 200 assumes a posture in which the head is reclined backward and the body trunk is laid obliquely.

This posture enables the abdomen and waist to be nearer to the vicinity of the front edge of the seat 4 than the posture in FIG. 25. Hence the shower flow discharged obliquely downward to the vicinity of the front edge of the seat 4 can be applied not only to the legs but also to the abdomen and waist directly or by splash from the legs. As a result, the hyperthermic effect and massage effect on the abdomen and waist can be enhanced. Furthermore, the seat occupant 200 can take a relaxed posture and enjoy a shower bath with greater comfort and satisfaction.

Thirteenth Embodiment

Figure 31:
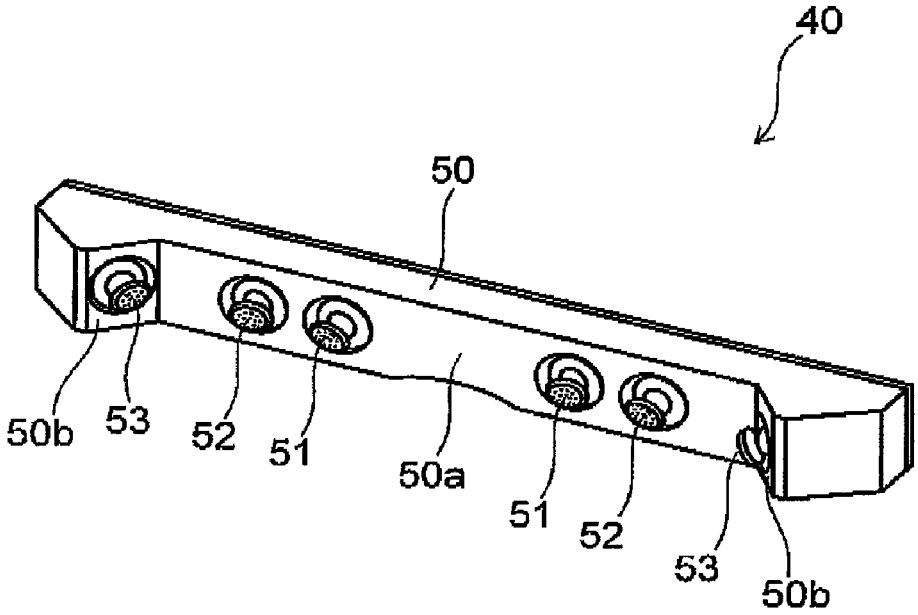
FIG. 31 is a perspective view of a water discharge unit in a shower bathing apparatus according to a thirteenth embodiment of the invention.

FIG. 31 is a perspective view of a water discharge unit 40 in a shower bathing apparatus according to a thirteenth embodiment of the invention.

Figure 32:
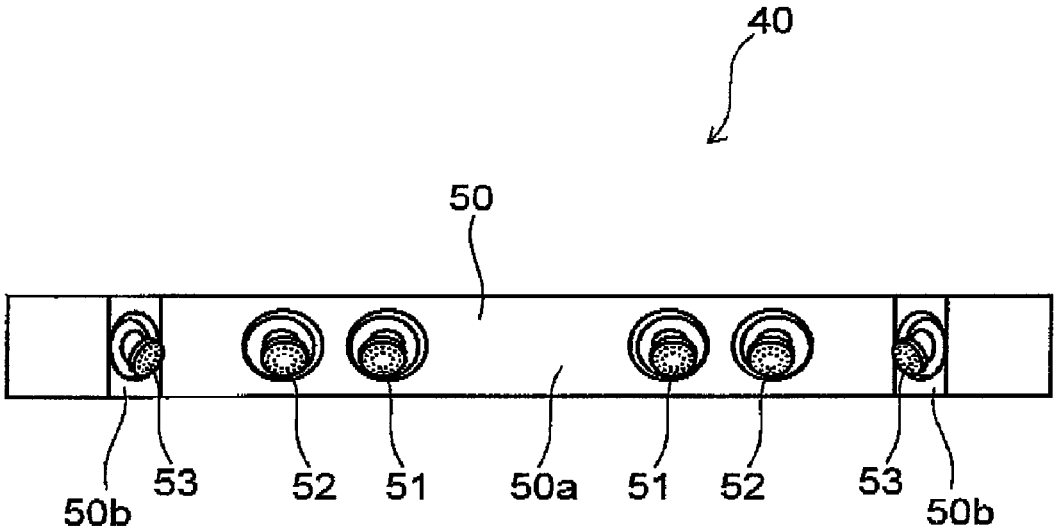
FIG. 32 is a front view of the water discharge unit.

FIG. 32 is a front view of the water discharge unit 40.

Figure 33:
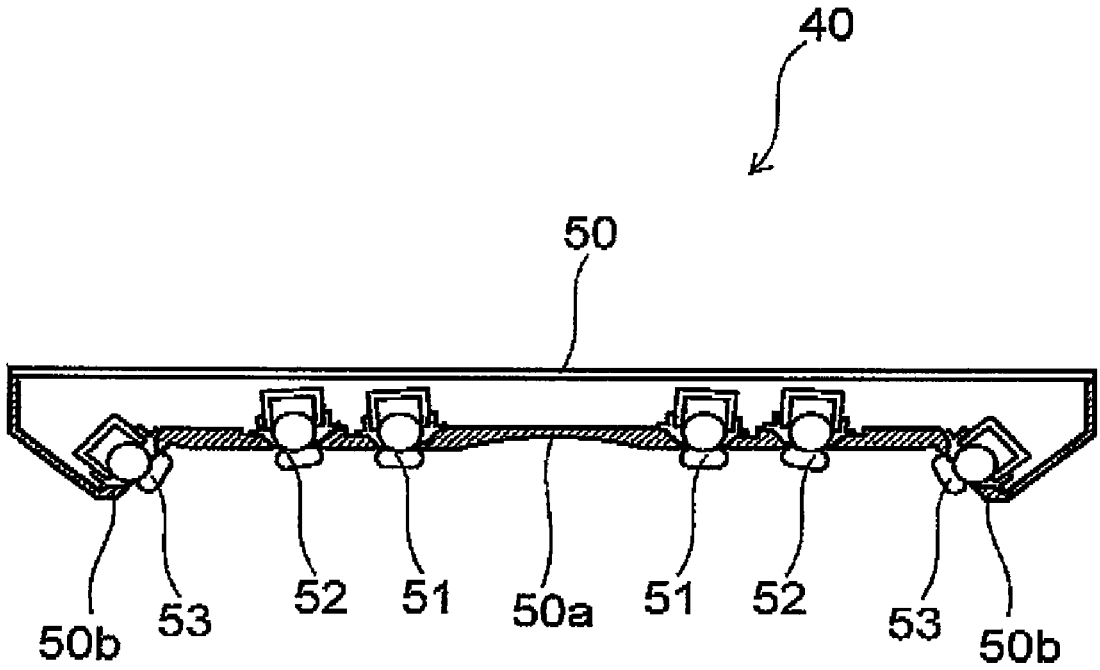
FIG. 33 is a horizontal cross-sectional view of the water discharge unit.

FIG. 33 is a horizontal cross-sectional view of the water discharge unit 40.

In this embodiment, first to third water dischargers 51-53 are attached to the above-described back portion 2 not separately, but a holder 50 collectively holds the first to third water dischargers 51-53 to form a water discharge unit 40, and the first to third water dischargers 51-53 are attached to the back portion 2 integrally with the water discharge unit 40.

The first to third water dischargers 51-53 are arranged longitudinally along the holder 50. The first water dischargers 51 and the second water dischargers 52 are provided in the front portion 50*a*, and the third water dischargers 53 are provided in the slope portions 50*b*, which are provided at both longitudinal ends of the front portion 50*a* at an obtuse angle therewith.

The first water dischargers 51 are provided on both sides, one for each side, of the center along the x-direction of the seat 4 in FIG. 23 so as to interpose the center. When a user is seated on the seat 4, the first water dischargers 51 are located above the shoulders of the seated user. The face or head of the user seated on the seat 4 can be located between the pair of first water dischargers 51. However, the first water dischargers 51 may be provided at a higher position than the head of the seat occupant seated on the seat 4.

A pair of second water dischargers 52 is provided nearly as high as the first water dischargers 51 and outside the first water dischargers 51 (outside as viewed in the x-direction in FIG. 23).

A pair of third water dischargers 53 is provided nearly as high as the first and second water dischargers 51, 52 and outside the second water dischargers 52 (outside as viewed in the x-direction in FIG. 23). The third water dischargers 53 are provided in the slope portions 50*b* sloped relative to the front portion 50*a* and are directed from outside the seat occupant seated on the seat 4 (outside as viewed in the x-direction in FIG. 23) to the vicinity of the acromia.

The first to third water dischargers 51-53 are attached to the back portion 2 with being held collectively in the holder 50, hence providing high handleability and assemblability.

The first water discharger 51 discharges a shower flow toward the shoulder near the base of the neck of the seat occupant. Part of the shower flow impinging on the shoulder flows on the front and lateral portion of the body extending from the chest to the trunk of the seat occupant, and the other part of the shower flow impinging on the shoulder is wrapped around to the back. Thus both the front and back of the body of the seat occupant can be warmed. Furthermore, the massage effect by the shower flow can also be allowed to act on the shoulder.

The second water discharger 52 discharges a shower flow that is ejected obliquely downward relative to the horizontal direction and falling around the front edge of the seat 4. That is, the second water discharger 52 discharges a shower flow obliquely downward over the shoulder of the seat occupant, and the shower flow falls around the leg particularly centering on the thigh of the seat occupant. Thus the leg below the knee can be reliably warmed.

The third water discharger 53 discharges a shower flow toward the acromion of the seat occupant. The shower flow impinging on the acromion flows on and warms the part around the center of the arm and the lateral portion of the trunk that cannot be covered by the shower flow from the first and second water dischargers 51, 52. Furthermore, the shower flow can be applied also beyond the acromion toward the chest. Also in this embodiment, the first to third water dischargers 51-53 can serve to warm the entire body of the seat occupant.

Figure 34:
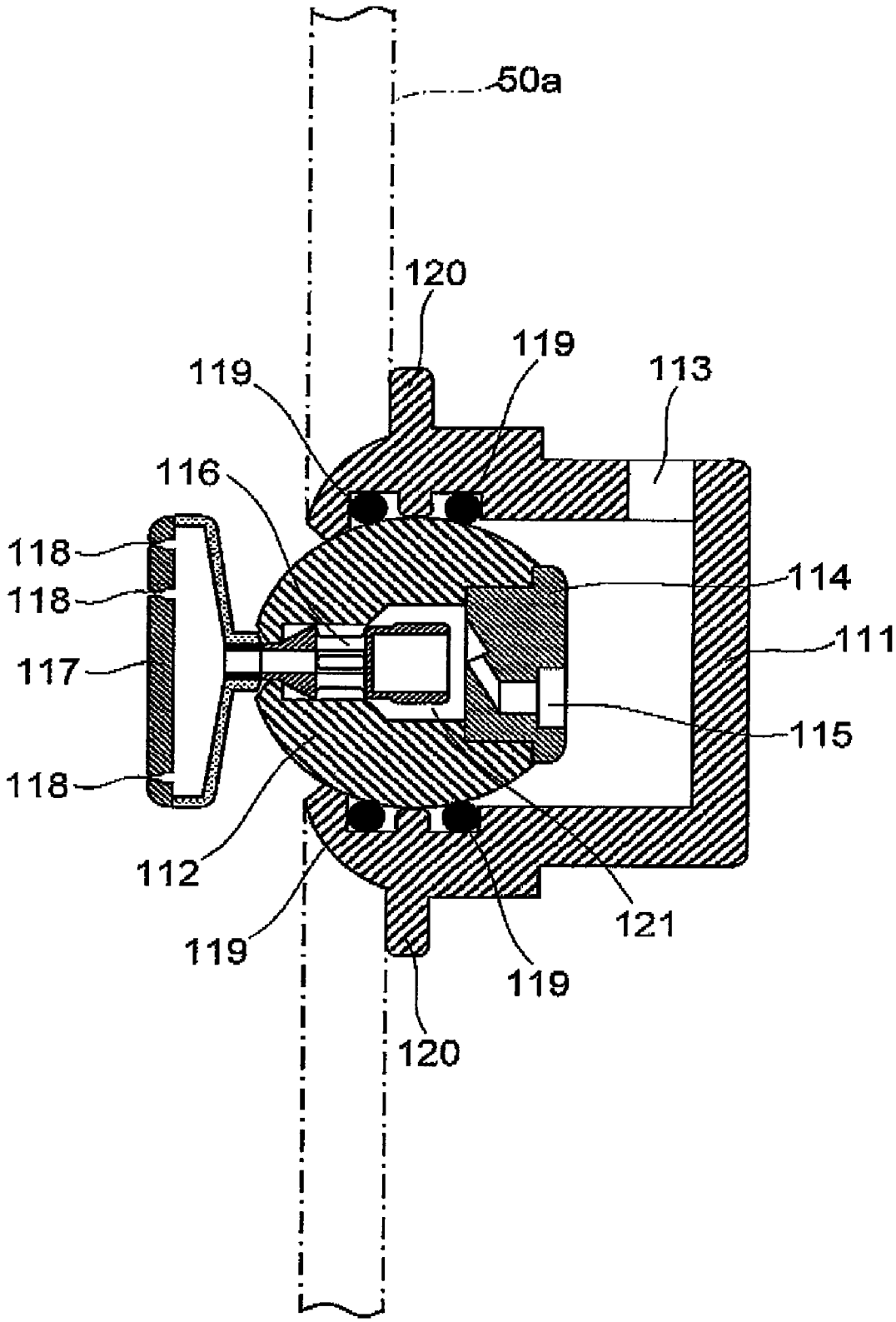
FIG. 34 is a schematic view illustrating the cross-sectional structure of each water discharger in the water discharge unit.

Furthermore, in this embodiment, each water discharger 51-53 is held in the holder 50 so that its water discharge direction and water discharge position can be adjusted. The water dischargers 51-53 have the same structure. FIG. 34 is a schematic view illustrating the cross-sectional structure of each water discharger 51-53.

In a casing 111 having a front opening, a ball body 112 is liquid-tightly and rotatably held via an O-ring 119. A flange 120 is provided on the front side of the casing 111 and fixed to the rear side of the front portion 50*a* of the holder 50.

A stepped hole 121 penetrates inside the ball body 112. A lid 114 is fit into one end of the stepped hole 121. A tube 116 is inserted into the stepped hole 121. On one end of the tube 116 is provided a shower plate 117 having a plurality of water discharge ports 118. The shower plate 117 protrudes outside from the front portion 50*a* of the holder 50.

The water supplied from a feedwater channel, not shown, flows into the casing 111 through the inflow port 113 opening in the casing 111, passes through a channel 115 formed inside the lid 114, and is guided to the stepped hole 121 inside the ball body 112. The water then passes inside the tube 116 inserted in the stepped hole 121 and is ejected outside from the water discharge ports 118 of the shower plate 117.

The water flow that has passed through the channel 115 in the lid 114 flows into the stepped hole 121 obliquely relative to the axis of the stepped hole 121 and produces a swirling flow in the stepped hole 121. The end of the tube 116 on the lid 114 side slightly wobbles with respect to the ball body 112 under the water pressure of the swirling flow. The tube 116 inclines and wobbles in the range of e.g. 3° about the axis of the stepped hole 121. Thus the shower plate 117 discharges a slightly swirling shower flow.

The ball body 112 is rotatably held in the casing 111. Rotation of the ball body 112 with respect to the casing 111 enables the shower plate 117 to move vertically, horizontally, and obliquely (to change its direction). For example, the shower plate 117 is movable in the range of about 30° vertically, horizontally, and obliquely from the state shown in FIG. 34.

By the rotation of the ball body 112, it is possible to change the direction of the shower plate 117, that is, the water discharge direction of the shower flow. Suitable configuration of the water discharge direction can ensure that the shower flow from each water discharger 51-53 reaches a desired site of the seat occupant depending on the frame or physique of the seat occupant, the way of sitting such as sitting deep or shallow, and the preference as to which site the seat occupant desires the shower flow to reach. Thus, without wasting water, it is possible to efficiently warm the entire body of the seat occupant even with saving water. Furthermore, there is no need for many water dischargers depending on the physique of the seat occupant, thus also achieving cost reduction. The invention is not limited to the case where the water discharge direction of all the first to third water discharger 51-53 is adjustable. It is also possible that only the water discharge direction of at least one of the first to third water discharger 51-53 is adjustable.

Fourteenth Embodiment

FIG. 35 is a perspective view of a water discharge unit in a shower bathing apparatus according to a fourteenth embodiment of the invention.

FIG. 36 is a side view of the water discharge unit.

In this embodiment, the above-described holder 50 is rotatable about a horizontal axis. Specifically, shafts 56 are provided at both axial ends of the holder 50. The shaft 56 is rotatably supported by a bearing 57 fixed to an attachment plate 55. The attachment plate 55 is attached to the back portion 2 described above. Alternatively, the bearing 57 may be directly provided on the back portion 2.

Figure 35A:
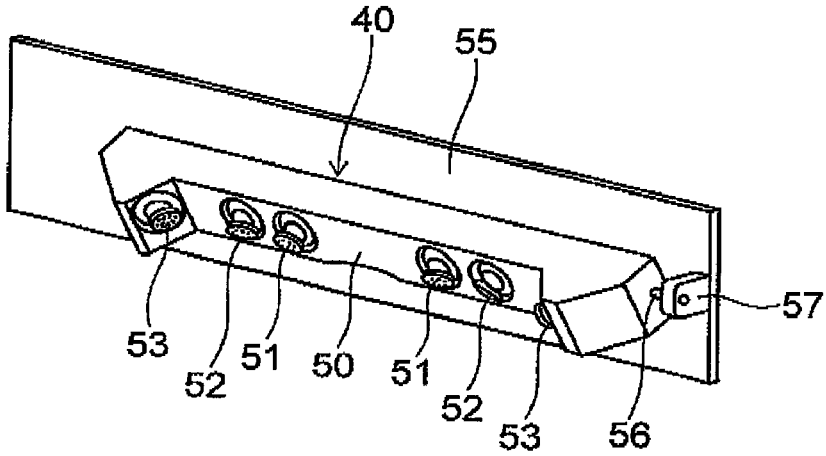
FIG. 35 is a perspective view of a water discharge unit in a shower bathing apparatus according to a fourteenth embodiment of the invention.
Figure 36A:
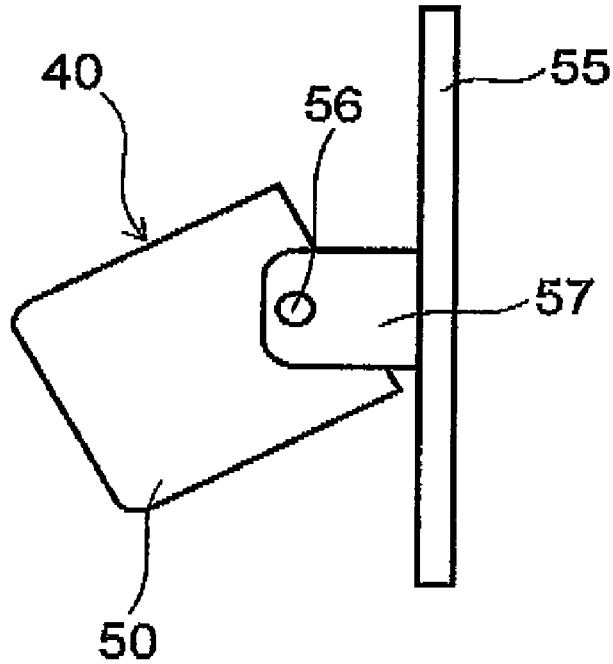
FIG. 36 is a side view of the water discharge unit.

In FIGS. 35A and 36A, the holder 50 is rotated downward, and the water discharge direction of the shower flow from the water dischargers 51-53 is turned downward relative to the horizontal direction.

Figure 35B:
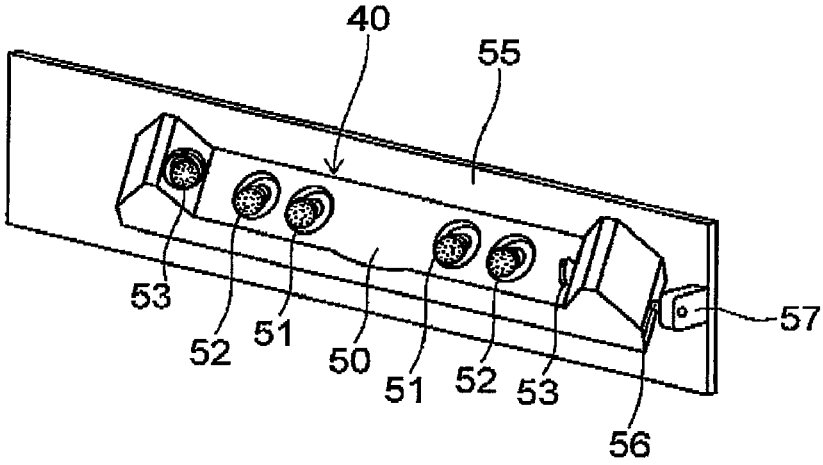
Figure 36B:
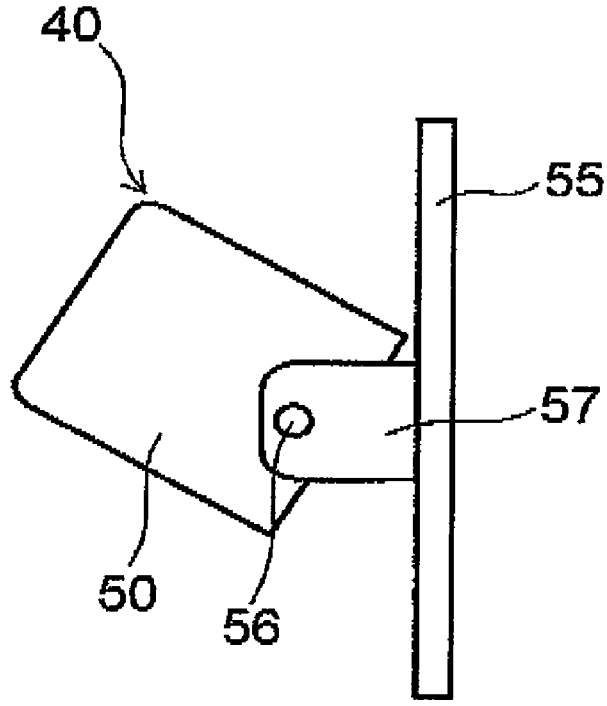

In FIGS. 35B and 36B, the holder 50 is rotated upward, and the water discharge direction of the shower flow from the water dischargers 51-53 is turned upward relative to the horizontal direction.

Rotation of the holder 50 about the horizontal axis allows the first to third water dischargers 51-53 held in the holder 50 to wobble vertically. Thus the water discharge direction of the shower flow from the water dischargers 51-53 can be adjusted. The adjustment is not cumbersome because the water discharge direction of the first to third water dischargers 51-53 can be adjusted simultaneously and collectively.

In the configuration of this embodiment, the water dischargers 51-53 can be each freely wobbled with respect to the holder 50 as in the thirteenth embodiment described above, or can be fixed to the holder 50. In the former configuration, the water discharge direction can be adjusted more precisely. Furthermore, a configuration is also possible where the water discharge position can be adjusted in addition to the water discharge direction.

Fifteenth Embodiment

Figure 37A:
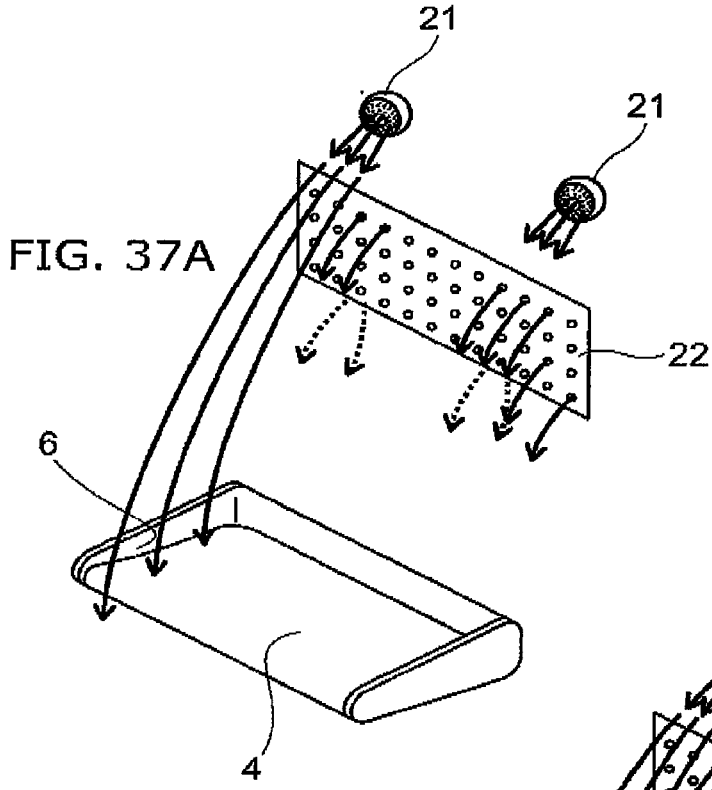
FIG. 37 is a schematic view of a shower bathing apparatus according to a fifteenth embodiment of the invention.
Figure 37B:
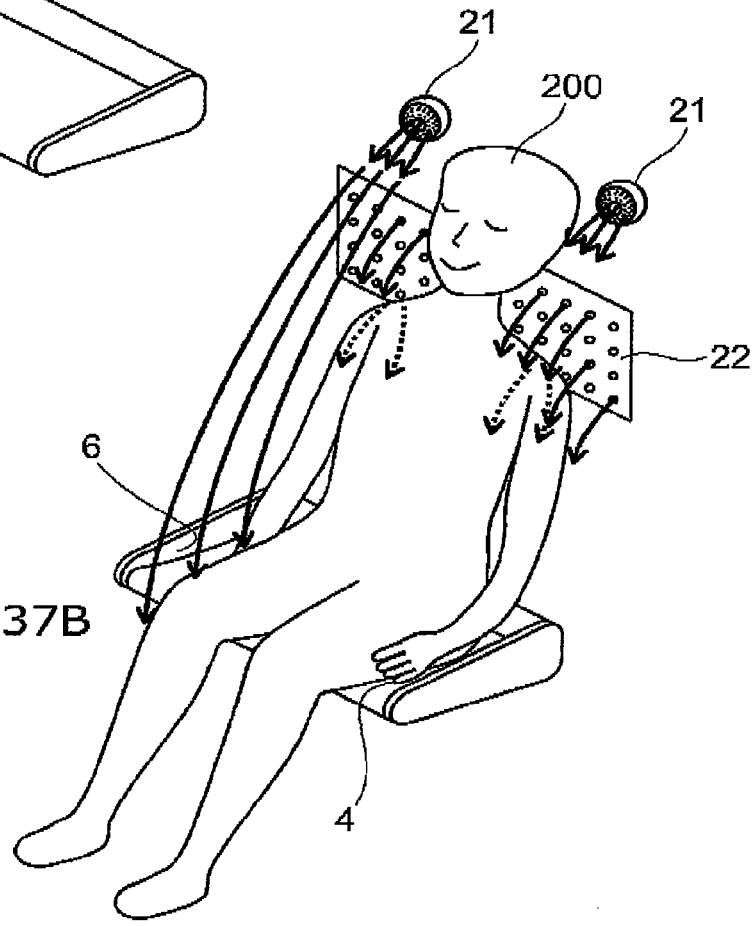

FIGS. 37A and 37B are schematic views of a shower bathing apparatus according to a fifteenth embodiment of the invention.

The shower bathing apparatus of this embodiment includes a pair of first water dischargers 21 provided at or above the head of a seat occupant 200 and a second water discharger 22 provided below the first water dischargers 21. The water discharge direction of the first water discharger 21 is configured to be a generally horizontal or obliquely downward direction. As shown in FIG. 37B, at least part of the discharged shower flow falls around the leg centering on the thigh of the seat occupant 200 seated on the seat 4.

On the other hand, the second water discharger 22 has a plurality of shower holes provided two-dimensionally behind the neck and shoulders of the seat occupant 200 seated on the seat 4. The direction of water discharge from these shower holes is also configured to be a generally horizontal or obliquely downward direction. As shown in FIG. 37B, the shower flow discharged from the second water discharger 22 covers the area including the neck, shoulders, and acromia (points of the shoulders) of the seat occupant 200. Because the second water discharger 22 extends also directly behind to the seat occupant 200, the shower flow can be evenly applied also on the neck and back of the seat occupant 200 from directly behind. Thus almost the entire body below the neck of the seat occupant 200 can be evenly warmed.

The first water dischargers 21 may be integrated with the second water discharger 22. That is, the first water dischargers 21 and the second water discharger 22 may be formed in a common substrate (not shown). It is then possible to simultaneously adjust the water discharge direction and water discharge position of the first water dischargers 21 and the second water discharger 22 by changing the angle and position of the substrate.

Alternatively, as shown in FIGS. 37A and 37B, the first water dischargers 21 may be formed separately from the second water discharger 22. That is, the first water dischargers 21 and the second water discharger 22 may be formed in separate substrates, respectively. It is then possible to adjust the water discharge direction and water discharge position of the first water dischargers 21 independently of the water discharge direction and water discharge position of the second water discharger 22.

Sixteenth Embodiment

Figure 38A:
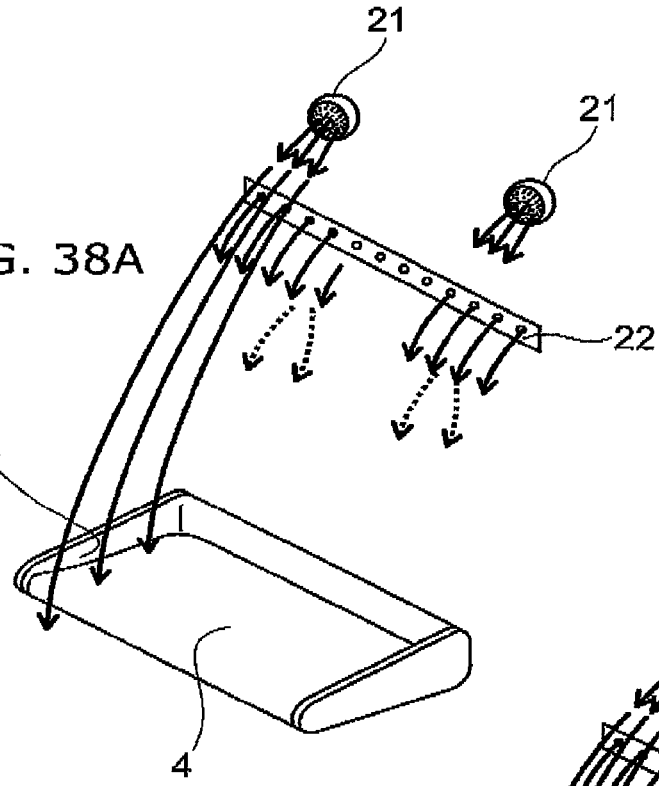
FIG. 38 is a schematic view of a shower bathing apparatus according to a sixteenth embodiment of the invention.
Figure 38B:
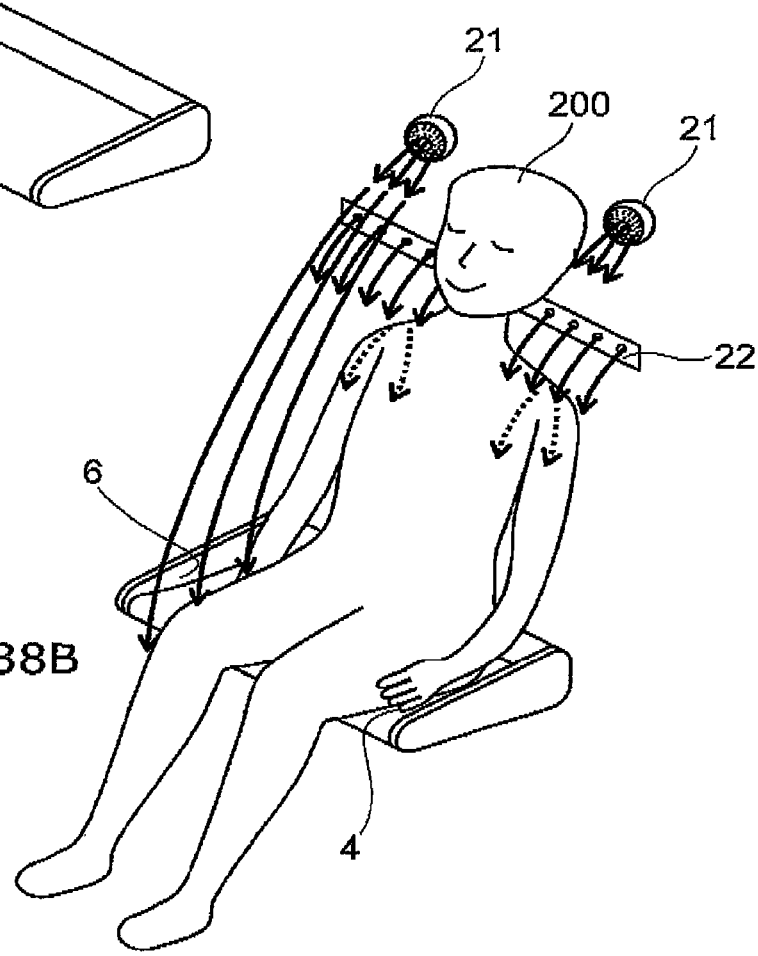

FIGS. 38A and 38B are schematic views of a shower bathing apparatus according to a sixteenth embodiment of the invention.

Like the shower apparatus of the fifteenth embodiment, the shower bathing apparatus of this embodiment also includes a pair of first water dischargers 21 provided at or above the head of a seat occupant 200 seated on the seat 4 and a second water discharger 22 provided below the first water dischargers 21. The water discharge direction of the first water discharger 21 is configured to be a generally horizontal or obliquely downward direction. As shown in FIG. 38B, at least part of the discharged shower flow falls around the leg centering on the thigh of the seat occupant 200.

On the other hand, the second water discharger 22 has a plurality of shower holes arranged in a horizontal line behind the neck and shoulders of the seat occupant 200 seated on the seat 4. The direction of water discharge from these shower holes is also configured to be a generally horizontal or obliquely downward direction. As shown in FIG. 38B, a row of shower flows discharged from the second water discharger 22 covers the area including the neck, shoulders, and acromia (points of the shoulders) of the seat occupant 200 seated on the seat 4. Furthermore, the shower flow can be applied also beyond the acromion toward the chest. Also in this embodiment, because the second water discharger 22 extends also directly behind the seat occupant 200, the shower flow can be evenly applied also on the neck and back of the seat occupant 200 from directly behind. Thus almost the entire body below the neck of the seat occupant 200 can be evenly warmed.

Also in this embodiment, the first water dischargers 21 may be integrated with the second water discharger 22 so that the water discharge direction and water discharge position can be simultaneously adjusted. Alternatively, as shown in FIGS. 38A and 38B, the first water dischargers 21 and the second water discharger 22 may be formed separately so that the water discharge direction and water discharge position thereof can be independently adjusted.

Seventeenth Embodiment

Figure 39A:
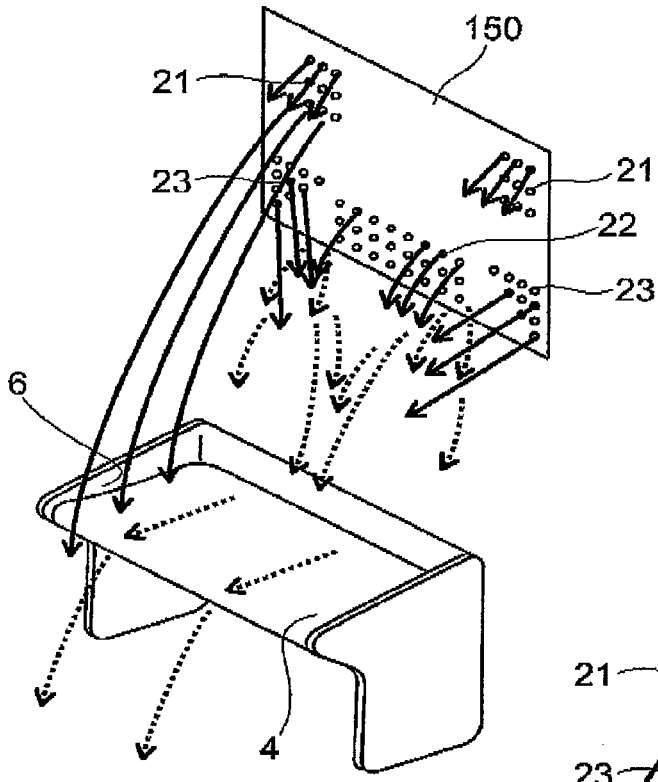
FIG. 39 is a schematic view of a shower bathing apparatus according to a seventeenth embodiment of the invention.
Figure 39B:
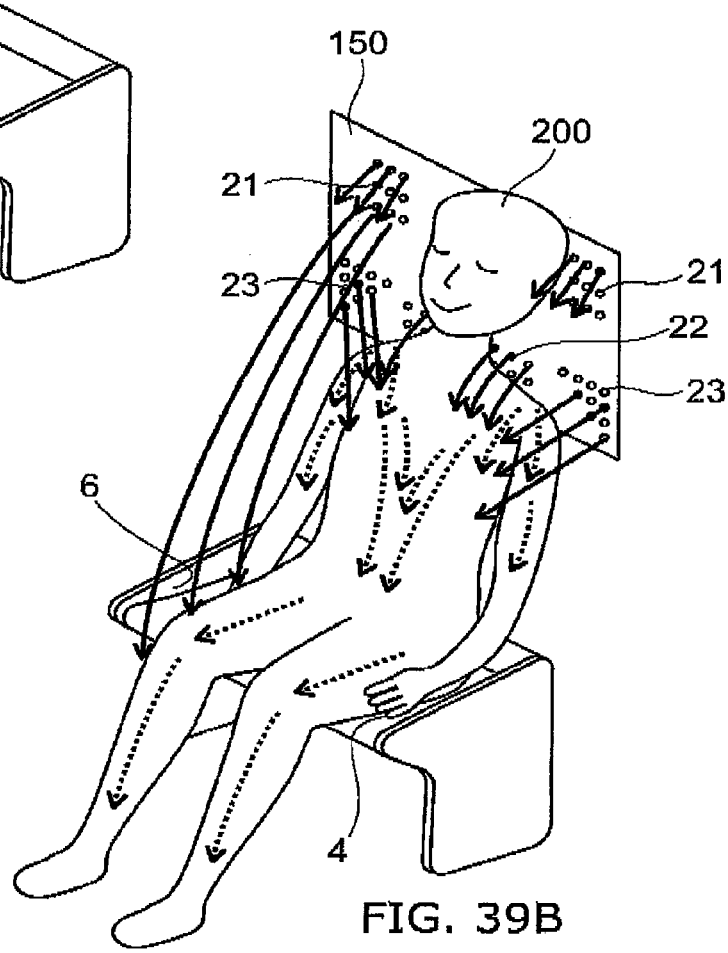

FIGS. 39A and 39B are schematic views of a shower bathing apparatus according to a seventeenth embodiment of the invention.

The shower bathing apparatus of this embodiment includes a pair of first water dischargers 21 provided at or above the head of a seat occupant 200 seated on the seat 4, a pair of third water dischargers 23 provided below the first water dischargers 21, and a second water discharger 22 provided between the third water dischargers 23. The water dischargers 21, 22, 23 have a plurality of shower holes provided two-dimensionally, respectively.

The water discharge direction of the first water discharger 21 is configured to be a generally horizontal or obliquely downward direction. As shown in FIG. 39B, at least part of the discharged shower flow falls around the leg centering on the thigh of the seat occupant 200. The shower flow discharged from the second water discharger 22 covers the area extending from the neck to the shoulders of the seat occupant 200. Because the second water discharger 22 extends also directly behind the seat occupant 200, the shower flow can be evenly applied also on the neck and back of the seat occupant 200 from directly behind. The shower flow from the third water discharger 23 is discharged so as to enclose the seat occupant 200 from both sides and covers the area including the acromia (points of the shoulders) and the vicinity of the arms. Furthermore, the shower flow can be applied also beyond the acromion toward the chest. Thus almost the entire body below the neck of the seat occupant 200 can be evenly warmed.

Also in this embodiment, the first water dischargers 21 may be integrated with the second water discharger 22 so that the water discharge direction and water discharge position can be simultaneously adjusted. Alternatively, the first water dischargers 21 and the second water discharger 22 may be formed separately so that the water discharge direction and water discharge position thereof can be independently adjusted.

Also in this embodiment, as shown in FIGS. 39A and 39B, it is possible to simultaneously adjust the water discharge direction of the first to third water discharger(s) 21, 22, 23 by forming them in a common substrate 150 and changing the direction of the substrate 150.

Eighteenth Embodiment

Figure 40:
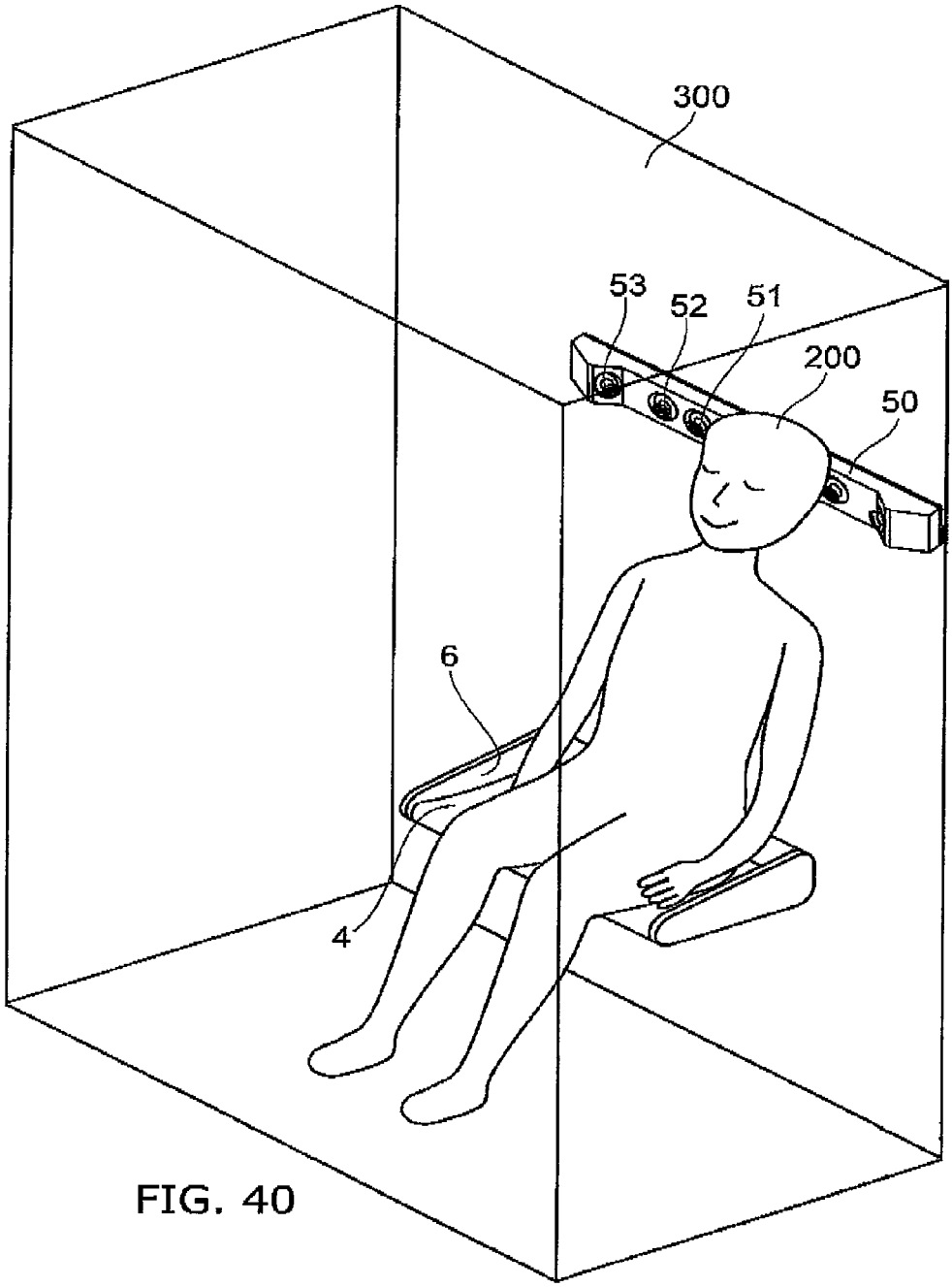
FIG. 40 is a schematic view of a shower bathing apparatus according to an eighteenth embodiment of the invention.

FIG. 40 is a schematic view of a shower bathing apparatus according to an eighteenth embodiment of the invention.

FIG. 41 is a schematic view of the seat 4 of this shower bathing apparatus.

Figure 41A:
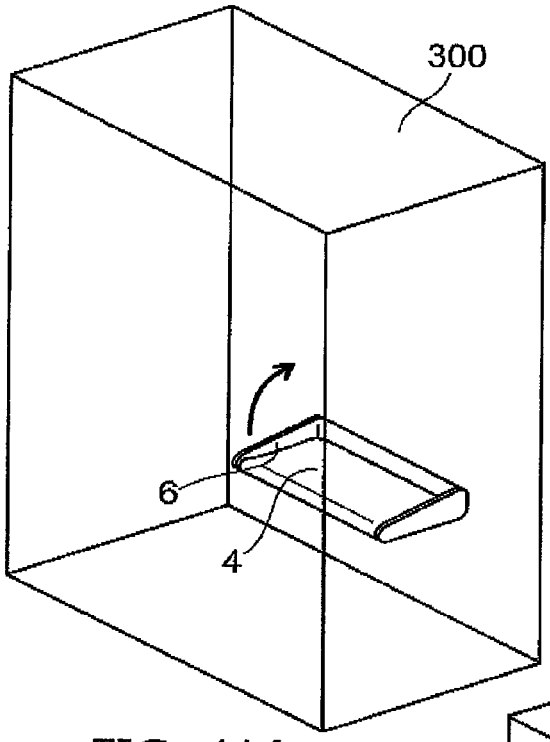
FIG. 41 is a schematic view of the seat 4 of the shower bathing apparatus shown in FIG. 40.
Figure 41B:
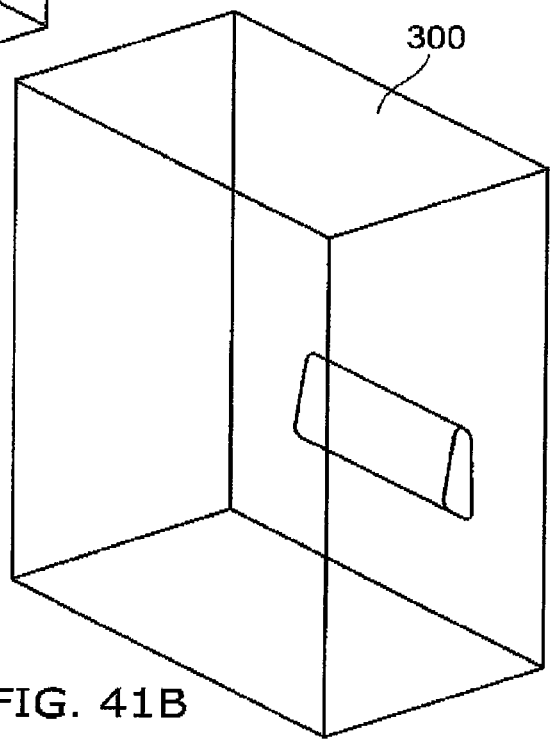
Figure 42:
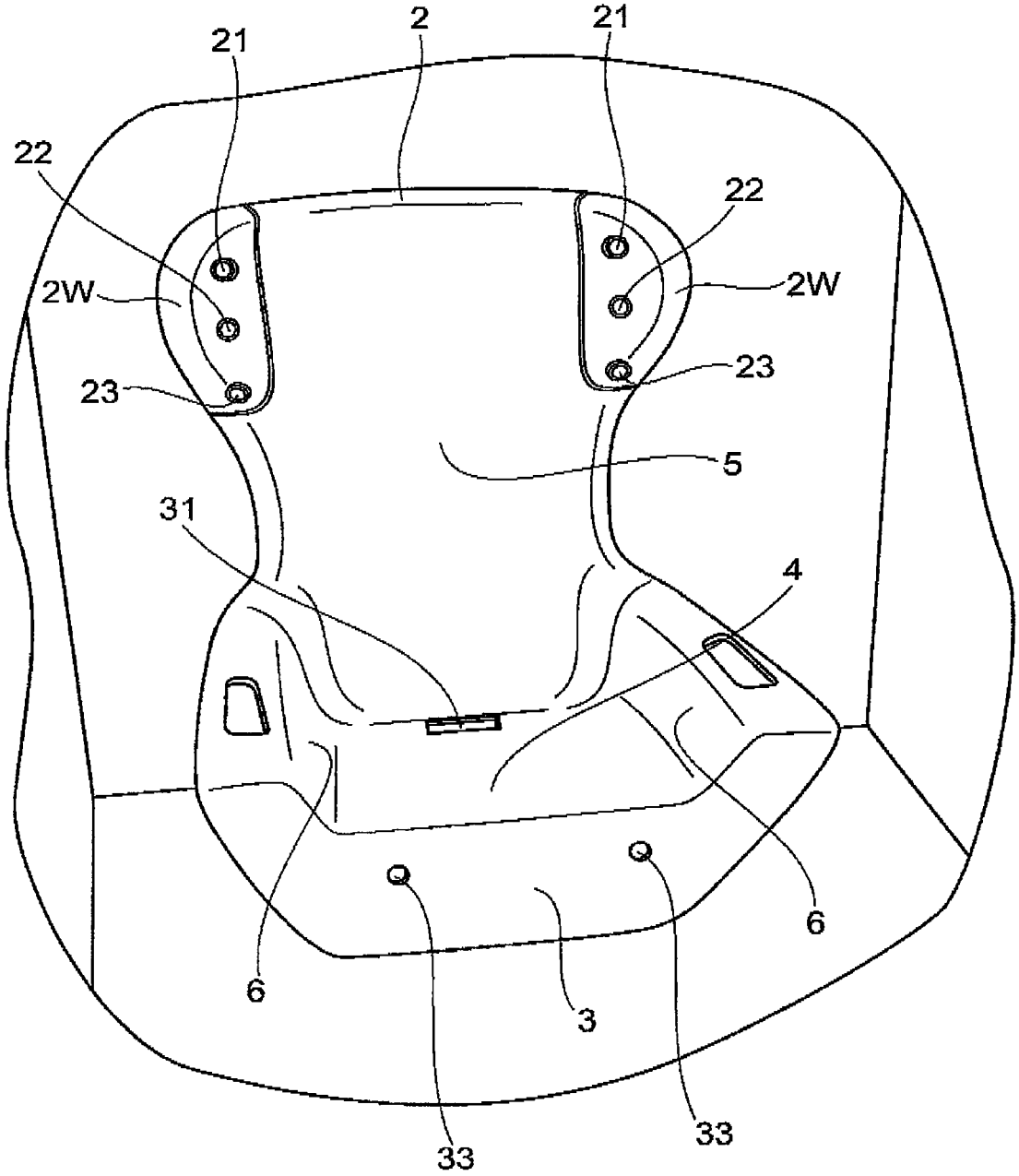
FIG. 42 is a schematic view of a shower bathing apparatus according to a nineteenth embodiment of the invention.

The shower bathing apparatus of this embodiment is installed in a shower booth 300. That is, the water dischargers 51, 52, 53 described above with reference to the thirteenth embodiment are installed on the wall of the shower booth 300. A seat 4 is provided below the water dischargers 51, 52, 53. FIG. 41A shows a situation where the seat 4 is in use, and FIG. 41B shows a situation where the seat 4 is retracted. Thus, because the seat 4 is retractable, the seat 4 is not obstructive when the user takes a shower in a standing position in the shower booth.

In this embodiment, instead of the water dischargers 51, 52, 53 of the thirteenth embodiment, any one of the water dischargers 21, 22, 23, 51, 52, 53 described above with reference to the eleventh to twelfth or the fourteenth to seventeenth embodiment may be used.

Nineteenth Embodiment

FIGS. 42 to 45 are schematic views of a shower bathing apparatus according to a nineteenth embodiment of the invention.

The shower bathing apparatus of this embodiment is configured as a chair having a back portion 2 and a base portion 3. The back portion 2 has a backrest 5, and the base portion 3 has a seat 4. At the upper part of the back portion 2, a pair of wings 2W extends obliquely forward from both sides of the backrest 5.

Figure 43:
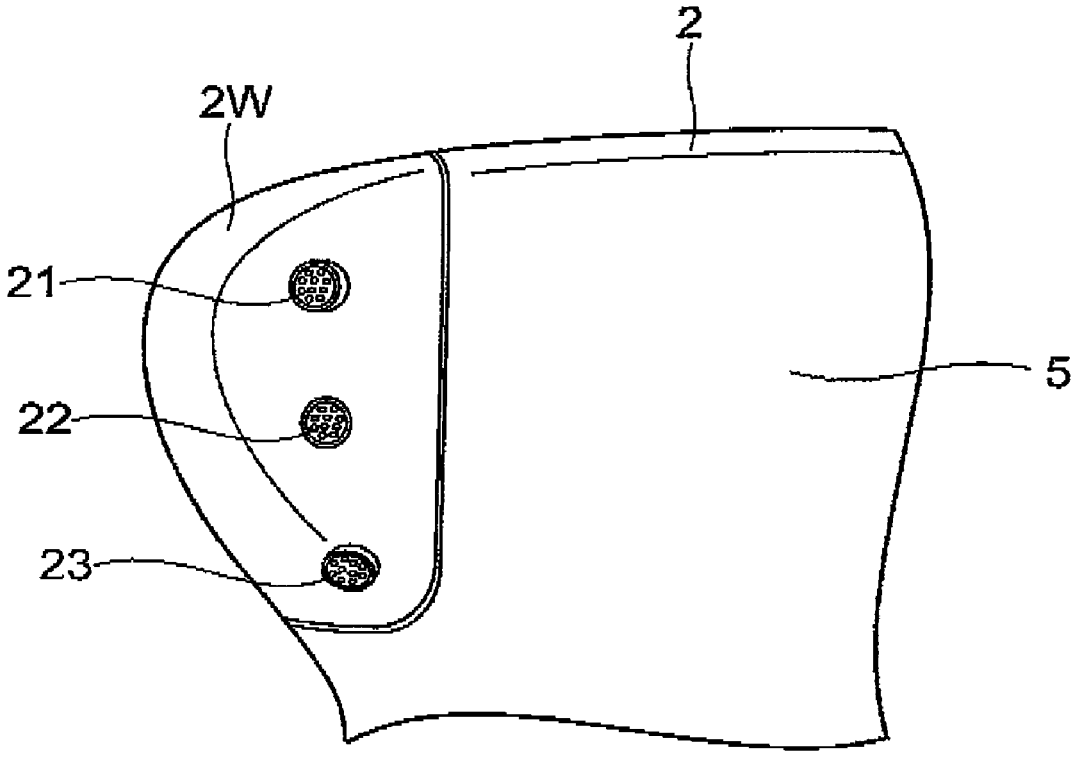
FIG. 43 is a schematic view of a shower bathing apparatus according to a nineteenth embodiment of the invention.
Figure 44:
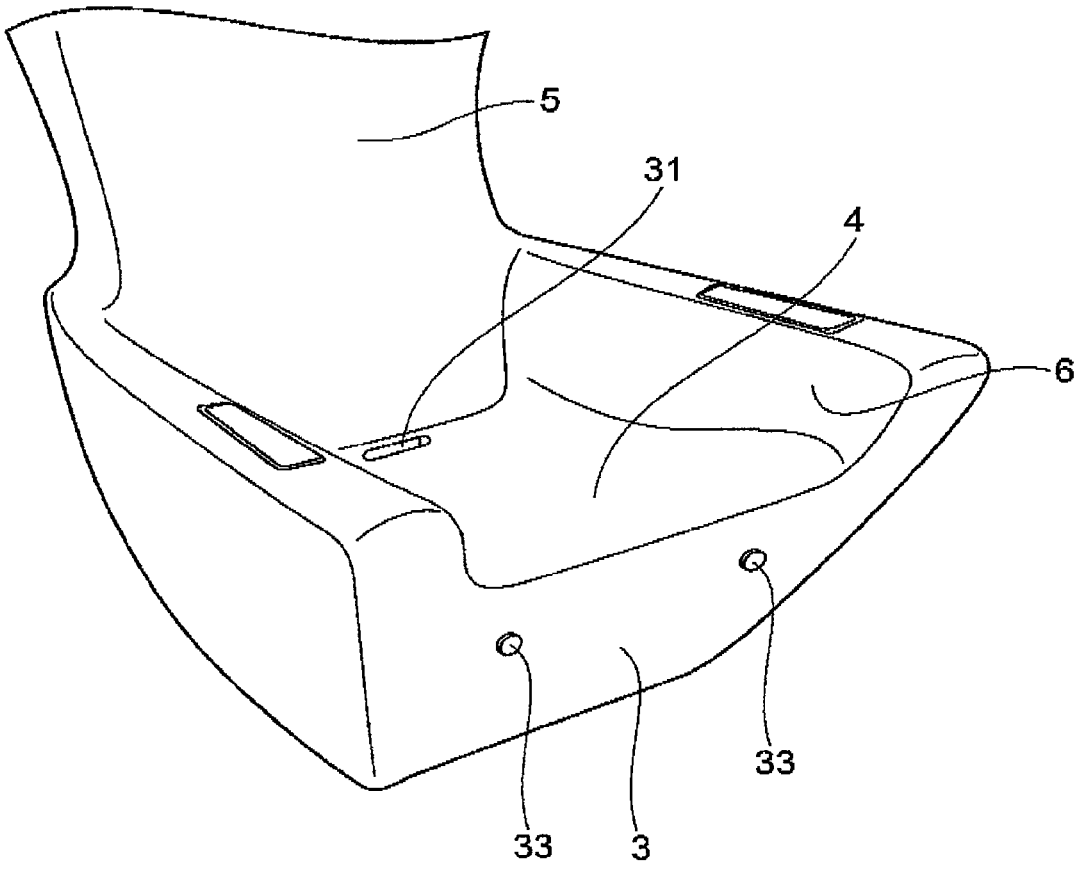
FIG. 44 is a schematic view of a shower bathing apparatus according to a nineteenth embodiment of the invention.

As shown in FIG. 43, the wing 2W has a first water discharger 21, a second water discharger 22, and a third water discharger 23. Each of the water dischargers 21, 22, 23 can discharge one or more shower flows. On the other hand, the seat 4 has a slope surface sloped downward from its front edge to the backrest 5. The seat 4 thus formed can pool water in cooperation with the wall portions 6 provided at both side edges thereof and the backrest 5. Furthermore, an opening 31 is provided at the vertical bottom of the seat 4. On the other hand, a pair of legback water dischargers 33 is provided on the front of the base portion 3. The legback water dischargers 33 are in communication with the opening 31. That is, the water discharged from the water dischargers 21, 22, 23 and falling on the seat 4 is guided through the opening 31 to the legback water dischargers 33 and discharged toward the rear side of the legs of the seat occupant seated on the seat 4 as shown by arrows D in FIG. 45. Thus the seat occupant can be warmed and enjoy a massage effect by the shower flow to the entire body including the rear side of the legs. Note that, instead of using the water falling on the seat 4 for water discharge from the legback water dischargers 33, water supplied from a water supply may be guided to the legback water dischargers 33 for water discharge.

Figure 45:
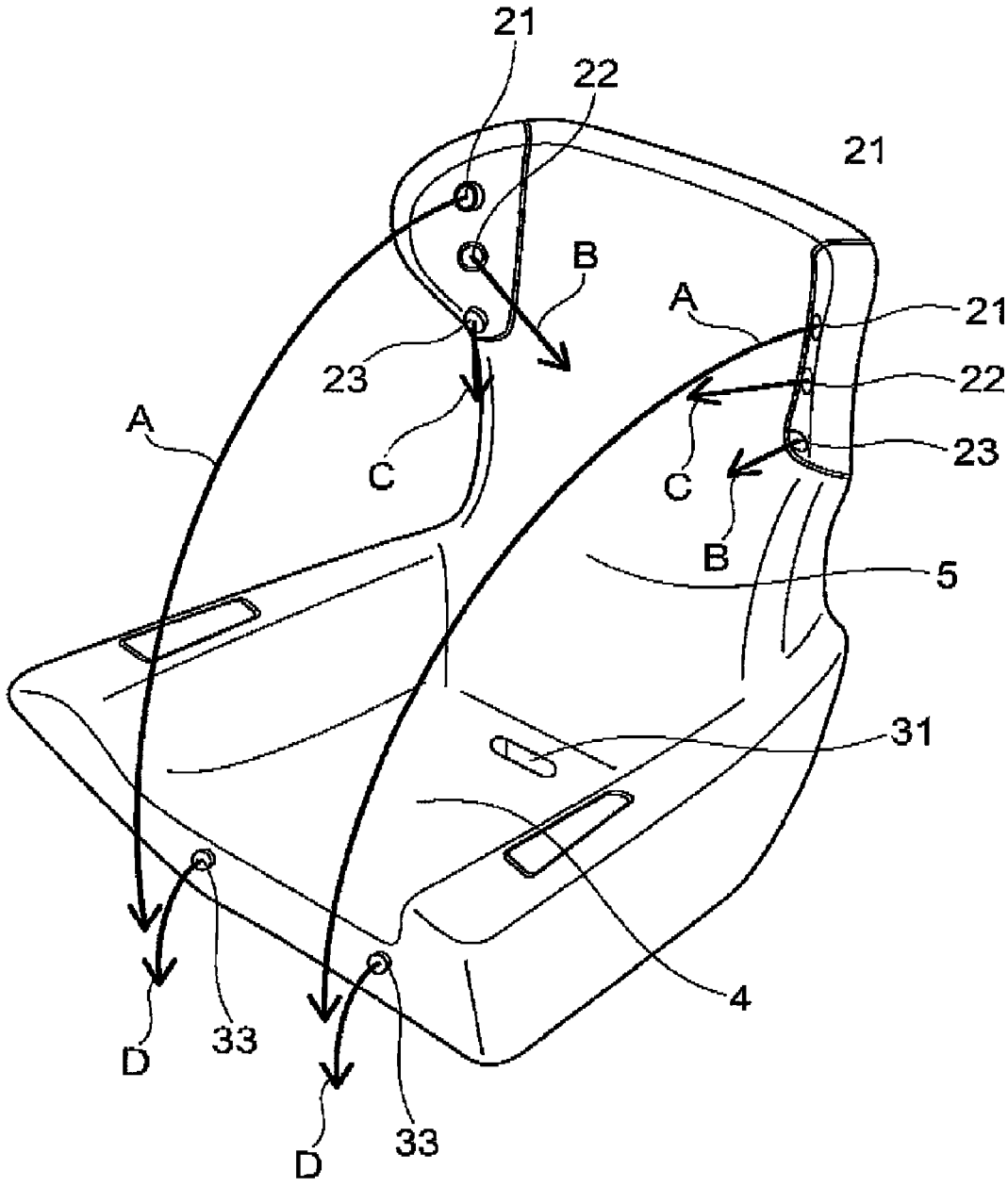
FIG. 45 is a schematic view of a shower bathing apparatus according to a nineteenth embodiment of the invention.

As shown by arrows A in FIG. 45, the water discharged from the first water dischargers 21 falls around the legs centering on the thighs of the seat occupant seated on the seat 4. As shown by arrows B in FIG. 45, the water discharged from the second water dischargers 22 reaches the area extending from the neck to the shoulders of the seat occupant seated on the seat 4. As shown by arrows C in FIG. 45, the water discharged from the third water dischargers 23 covers the area including the acromia (points of the shoulders) and the vicinity of the arms so as to enclose the seat occupant seated on the seat 4 from both sides. Furthermore, the shower flow can be applied also beyond the acromion toward the chest. Moreover, part of the discharged water and the water flowing down from the body of the seat occupant is pooled in the seat 4. That is, the underside of the buttocks and thighs of the seat occupant seated on the seat 4 is warmed by the water pooled in the seat 4. Thus almost the entire body below the neck of the seat occupant 200 can be evenly warmed.

The shower bathing apparatus of this embodiment is configured as a stand-alone chair. Hence it can be easily installed without any work on the shower booth and the bathroom. Furthermore, it enables a user to comfortably take a full body shower in a relaxed sitting posture as in a sofa. Moreover, a vibrator can be installed on the rear side of the seat 4 and/or the backrest 5 of this shower bathing apparatus to provide a vibrating massage effect on the seat occupant. Then the relaxing and massage effect by shower bathing can be combined with the vibrating massage effect to provide greater advantage.

WORKING EXAMPLE

Next, a working example implemented by the inventor is described.

The inventor performed experiments for measuring the warming effect of shower bathing in the shower bathing apparatus of the first embodiment, bathing in a bathtub filled with water, shower bathing with a conventional hand shower, and shower bathing in the shower bathing apparatus disclosed in Patent Document 1.

The experiment for the shower bathing apparatus of the first embodiment was performed in a case (case A) where the temperature of the water supplied to the water dischargers 21, 22, 23 was set to 43° C. and the total amount of water discharged from these water dischargers was set to 10 liters per minute. Bathing in a bathtub filled with water (case C) was performed by filling the bathtub with 230 liters of water at 40° C. In the case of a conventional hand shower (case D), the temperature of the water supplied to the shower head was also set to 43° C., and the flow rate was set to 8 liters per minute. In the case of the shower bathing apparatus disclosed in Patent Document 1 (case E), shower bathing was performed by ejecting water as a mist at 10 liters per minute. In all these cases, the temperature variation on the body surface of a subject was measured using a radiation thermometer immediately before bathing and after bathing for 5 minutes.

Figure 46:
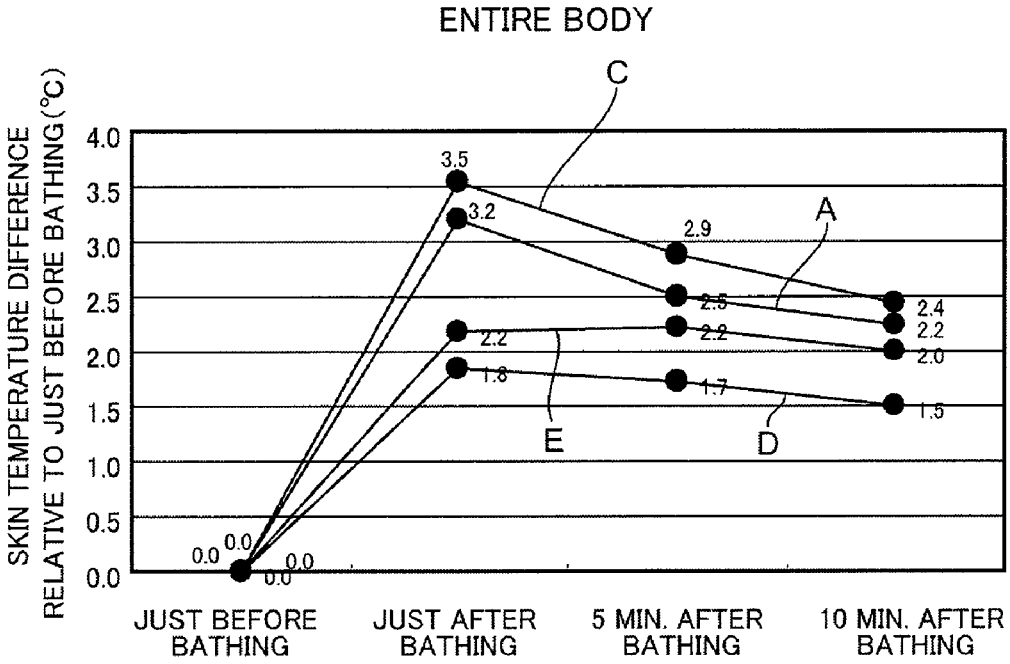
FIG. 46 is a graph showing the temperature variation of the entire body surface of a subject.

FIG. 46 is a graph showing the temperature variation of the entire body surface of a subject. The vertical axis represents the temperature increase with reference to the temperature immediately before bathing. Here, the average temperature of the body surface below the neck was used as the temperature of the entire body.

In comparison with immediately before bathing, the temperature increase immediately after 5 minutes' bathing was 3.5° C. for the bathtub (C), 3.2° C. for the shower bathing apparatus of this embodiment (A), 2.2° C. for the shower bathing apparatus of Patent Document 1 (E), and 1.8° C. for the conventional shower (D). That is, according to this result, the temperature is highest in the case of bathtub bathing (C), and a comparable temperature is achieved in this embodiment (A). In contrast, the temperature increase is small for the shower bathing apparatus disclosed in Patent Document 1 (E) and the conventional hand shower (D).

When 5 minutes elapsed after bathing, the temperature increase was 2.9° C. (C), 2.5° C. (A), 2.2° C. (E), and 1.7° C. (D). When 10 minutes elapsed after bathing, it was 2.4° C. (C), 2.2° C. (A), 2.0° C. (E), and 1.5° C. (D). That is, when 10 minutes elapsed after bathing, shower bathing in the shower bathing apparatus of this embodiment achieves the same temperature as bathtub bathing. This is presumably because the shower bathing apparatus of this embodiment provides not only a hyperthermic effect by water, but also a massage effect and an effect of promoting blood circulation by full body shower in a relaxed posture.

Figure 47:
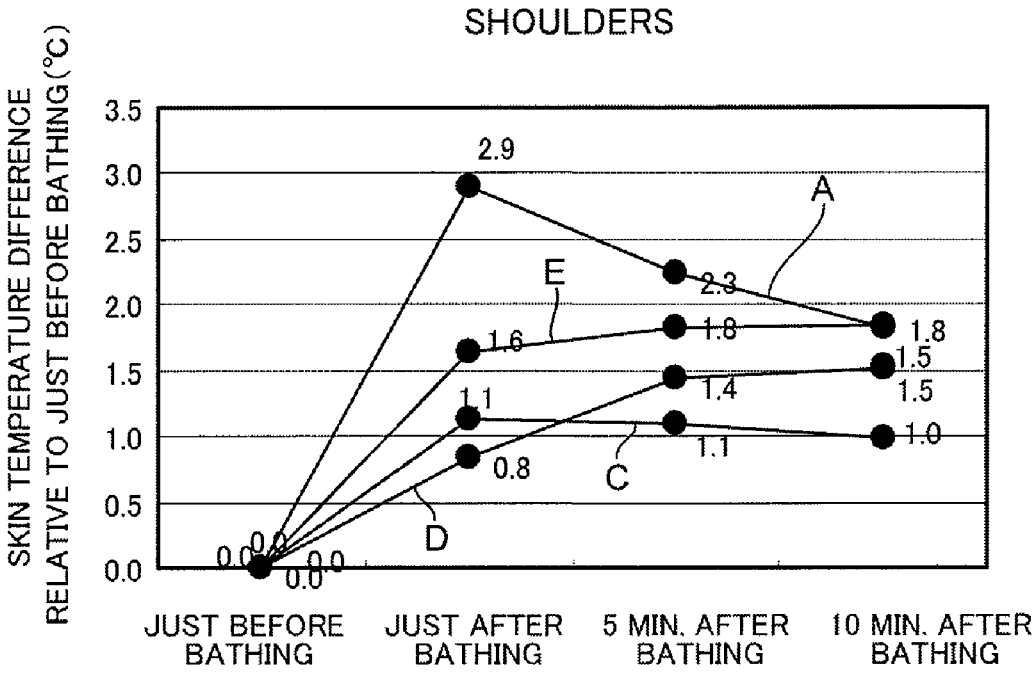
FIG. 47 is a graph showing the temperature variation of the body surface of the subject's shoulder.

FIG. 47 is a graph showing the temperature variation of the body surface of the subject's shoulder. Again, the vertical axis represents the temperature increase with reference to the temperature immediately before bathing.

In comparison with immediately before bathing, the temperature increase of the shoulders immediately after 5 minutes' bathing was 2.9° C. for the shower bathing apparatus of this embodiment (A), 1.6° C. for the shower bathing apparatus of Patent Document 1 (E), 1.1° C. for the bathtub (C), and 0.8° C. for the conventional shower (D). That is, according to this result, the temperature is prominently high for the shower bathing apparatus of this embodiment, but relatively low for the shower bathing apparatus disclosed in Patent Document 1 (E), the bathtub (C), and the conventional shower (D). This is presumably because, in the shower bathing apparatus of this embodiment, the shower flow from the second water dischargers 22 and the third water dischargers 23 (see FIG. 1) evenly reaches and can sufficiently warm the shoulders of the seat occupant. In contrast, in the shower bathing apparatus disclosed in Patent Document 1 (E), for example, the mist sprayed from the arm may fail to sufficiently warm the seat occupant including the shoulders. In the case of the bathtub (C), it is painful for the bather to keep the shoulders fully soaked in water for a long time, and inevitable to bathe with the shoulders being out of water. Hence it is difficult to warm the shoulders even if the body is warmed. Furthermore, in the case of the conventional hand shower (D), the shower flow from the shower head does not always reach the body of the bather, and it is not easy to evenly and efficiently warm the entire body of the bather.

When 5 minutes elapsed after bathing, the temperature increase was 2.3° C. (A), 1.8° C. (E), 1.4° C. (D), and 1.1° C. (C). When 10 minutes elapsed after bathing, it was 1.9° C. (A), 1.8° C. (E), 1.5° C. (D), and 1.0° C. (C). That is, even when 10 minutes elapsed after bathing, shower bathing in the shower bathing apparatus of this embodiment (A) achieves the highest temperature. In the case of the conventional hand shower (D) and the shower bathing apparatus disclosed in Patent Document 1 (E), the temperature was gradually increased after 5 minutes and after 10 minutes with reference to the temperature immediately after bathing. This is presumably because, in these cases, the shoulders were particularly less warmed than the other parts of the body and received heat from the other parts of the body through blood flow after bathing.

Figure 48:
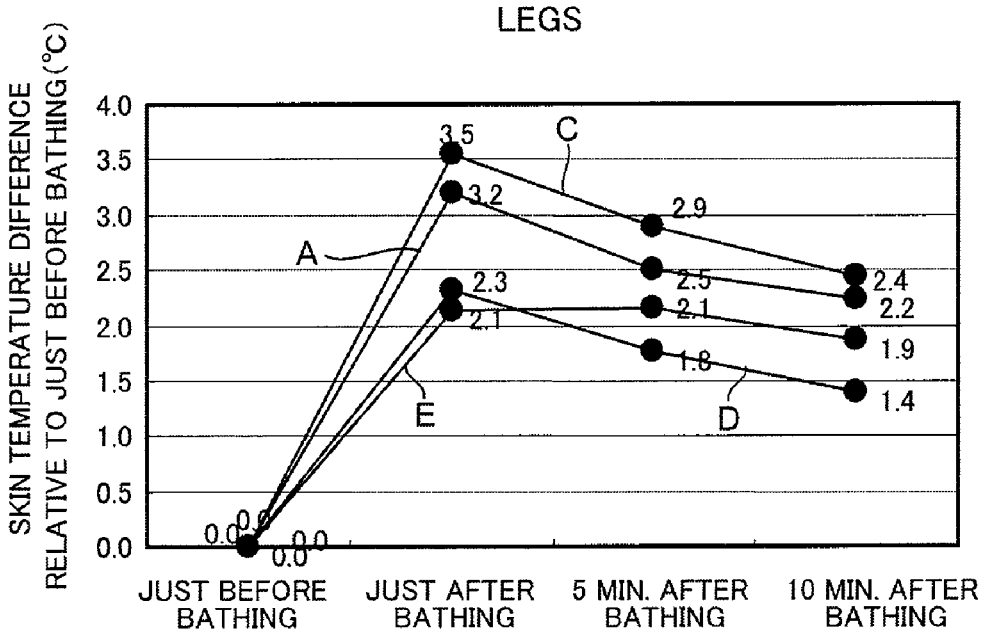
FIG. 48 is a graph showing the temperature variation of the body surface of the subject's leg.

FIG. 48 is a graph showing the temperature variation of the body surface of the subject's leg. Again, the vertical axis represents the temperature increase with reference to the temperature immediately before bathing.

In comparison with immediately before bathing, the temperature increase of the legs immediately after 5 minutes' bathing was 3.5° C. for the bathtub (C), which was the highest. However, it was 3.2° C. for the shower bathing apparatus of this embodiment (A), which was comparable to the temperature increase for the bathtub (C). That is, according to this embodiment, the water discharged from the first water dischargers 21 (see FIG. 1) and directly falling on the legs of the seat occupant and the water discharged from the second water dischargers 22 and the third water dischargers 23, impinging on the body of the seat occupant, and flowing down from the front edge of the seat 4 can sufficiently warm the seat occupant including the legs.

In contrast, in the case of the conventional hand shower (D) and the shower bathing apparatus of Patent Document 1 (E), the temperature increase immediately after bathing was as low as 2.3° C. and 2.1° C., respectively. In the case of the conventional hand shower (D), it is not easy to apply water evenly down to the legs of the bather. In the case of the shower bathing apparatus disclosed in Patent Document 1, it is not easy to entirely enclose the legs of the seat occupant with the mist sprayed from the arm. Furthermore, because the temperature of the mist sprayed from the arm decreases rapidly, it is considered difficult to evenly warm the entire legs of the seat occupant.

As described above, according to this working example, the shower bathing apparatus of this embodiment provides a high warming effect on the entire body, shoulders, and legs. For example, for the entire body and the legs, the shower bathing apparatus of this embodiment provides a warming effect comparable to that for bathtub bathing. Here, bathtub bathing needs about 230 liters of water, for example. However, this embodiment only needs a very small amount of water, e.g. 50 liters for 5 minutes' bathing (case A). That is, this embodiment also provides a high water-saving effect. Even successive use by four bathers only needs a smaller amount of water than bathtub bathing (case C) with a comparable warming effect.

With regard to the shoulders, this embodiment provides a greater warming effect than bathtub bathing. Furthermore, this embodiment also provides a massage effect by dropping the discharged water on the body of the seat occupant. Thus it is also possible to provide an effect of alleviating stiffness and pain in the shoulders, for example.

The first to nineteenth embodiment and the working example of the invention have been described.

In the above embodiments, the height of the water dischargers from the seat 4 is 400 to 1400 mm, for example. To ensure the above effects, it is preferably 500 to 1000 mm, and more preferably 650 to 900 mm.

The height of the seat 4 from the floor is 250 to 800 mm, for example. To ensure the above effects, it is preferably 300 to 500 mm, and more preferably 350 to 450 mm.

For use in a shower booth, the height of the seat 4 from the floor can be in the range of about 250 to 800 mm where a user can be seated thereon.

The distance (width) between the outermost third water dischargers paired across the center of the seat 4 is 340 to 1200 mm, for example. To ensure the above effects, it is preferably 500 to 800 mm, and more preferably 550 to 650 mm.

In the above examples, the average droplet diameter of the water discharged from the first water discharger 21 and the second water discharger 52 can be larger than the average droplet diameter of the water discharged from the first water discharger 51, the second water discharger 22, and the third water discharger 23, 53. For example, the average droplet diameter of the water discharged from the first water discharger 21 and the second water discharger 52 can be in the range of 1400 to 3000 micrometers, and the average droplet diameter of the water discharged from the first water discharger 51, the second water discharger 22, and the third water discharger 23, 53 can be in the range of 500 to 1400 micrometers. It is then possible to reduce the temperature decrease of the shower flow discharged from the first and second water discharger 21, 52 and falling on the legs of the seat occupant and to apply water to the legs of the seat occupant. At the same time, the falling shower flow discharged from the first and second water discharger 21, 52 can apply suitable stimuli to the legs of the seat occupant, thereby achieving a massage effect. It is possible to control the droplet diameter of the water by adjusting the size and shape of the water discharge port.

The embodiments of the invention have been described with reference to examples. However, the invention is not limited to the above examples.

For example, the above embodiments can be appropriately combined with each other as long as technically feasible, and such combinations are also encompassed within the scope of the invention. Furthermore, a flow rate regulation means and/or a pressure regulation means capable of regulating the flow rate and/or pressure of discharged water can also be provided in order to enable the discharged water to reach the legs and other parts constantly and stably irrespective of water supply pressure and its variation.

The structure, shape, function, positional relationship, and material of each element in the examples that are variously modified and/or added by those skilled in the art are also encompassed within the scope of the invention as long as they include the features of the invention.

The invention claimed is:

1. A shower bathing apparatus for supporting a user in a sitting posture comprising:

a seat configured to receive a bottom of the user, the seat including a front edge;

a back portion configured to receive a back of the user and including a shoulder region located to support shoulders of the user; and water dischargers solely provided at the back portion and rearward and upward of the seat and having a pair of first water dischargers and a pair of second water dischargers, the pair of first water dischargers being separate from the pair of second water dischargers, the pair of second water dischargers being located outside the pair of first water dischargers, the pair of first water dischargers being provided at the back portion on respective sides of a center of the seat and located upward of the shoulder region and configured to discharge a first continuous water flow from rearward of the seat in a generally horizontal direction toward the front edge of the seat so as to extend beyond the shoulder region and impinge on the seat including the front edge, the pair of second water dischargers being provided at the back portion, located upward of the shoulder region, and located closer to the pair of first water discharges than to the seat surface, which are provided on respective sides of the center of the seat, the pair of second water dischargers being configured to discharge a second continuous water flow from rearward of the seat more downward than the first continuous water flow.

2. The shower bathing apparatus according to claim 1, wherein the first continuous water flow is discharged in a generally horizontal direction and arcs forward and down toward the front edge of the seat.

3. The shower bathing apparatus according to claim 1, wherein the seat is located above a floor such that water from the first continuous water flow and the second continuous water flow collects on the floor.

4. The shower bathing apparatus according to claim 1, wherein the front edge of the seat is configured to permit legs of a user extend downward.

5. The shower bathing apparatus according to claim 1, wherein at least one of the first water dischargers are adjustable in at least one of a water discharge direction and a water discharge position.

6. The shower bathing apparatus according to claim 1, wherein the pair of second water dischargers includes two pairs of water dischargers which are located on the back portion and positioned on respective sides of a center of the seat.

7. The shower bathing apparatus according to claim 6, wherein an average droplet diameter of water discharged from the pair of first water dischargers is larger than an average droplet diameter of water discharged from the second water discharger.

8. The shower bathing apparatus according to claim 1, wherein an average droplet diameter of water discharged from the pair of first water dischargers is larger than an average droplet diameter of water discharged from the second water discharger.

9. The shower bathing apparatus according to claim 1, wherein the second water discharger is adjustable in at least one of a water discharge direction and a water discharge position.

10. The shower bathing apparatus according to claim 1, further comprising:

a third water discharger which is different from the pair of first water dischargers and the second water discharger in at least one a water discharge position and a water discharge direction.

11. The shower bathing apparatus according to claim 10, wherein water discharged from the third water discharger is configured to reach an acromion of the user.

12. The shower bathing apparatus according to claim 10, wherein the third water discharger includes a pair of water dischargers that are provided on the back portion and on respective sides of the seat.

13. The shower bathing apparatus according to claim 12, wherein the third water dischargers are configured to discharge water obliquely downward and obliquely forward inclined to the center of the seat.

14. The shower bathing apparatus according to claim 10, wherein the average droplet diameter of water discharged from the pair of first water dischargers is larger than an average droplet diameter of water discharged from the third water discharger.

15. The shower bathing apparatus according to claim 10, wherein at least one of the pair of first water dischargers and the second water discharger is adjustable in a water discharge direction.

16. The shower bathing apparatus according to claim 1, wherein the back portion includes a backrest provided rearward of the seat and sloped relative to a vertical direction.

17. The shower bathing apparatus according to claim 1, further comprising:

a pair of third water dischargers provided at the back portion on respective sides of a center of the seat, wherein the third water dischargers are configured to discharge shower flow falling from rearward of the user seated on the seat toward an acromion of the user.

* * * * *